US012716665B2

(12) United States Patent
Herd

(10) Patent No.: US 12,716,665 B2
(45) Date of Patent: Aug. 25, 2026

(54) FIREARM

(71) Applicant: Matthew Earl Herd, Malvern, PA (US)

(72) Inventor: Matthew Earl Herd, Malvern, PA (US)

( * ) Notice: Subject to any disclaimer, the term of this patent is extended or adjusted under 35 U.S.C. 154(b) by 27 days.

(21) Appl. No.: 18/918,637

(22) Filed: Oct. 17, 2024

(65) Prior Publication Data

US 2026/0110504 A1 Apr. 23, 2026

Related U.S. Application Data

(60) Provisional application No. 63/591,479, filed on Oct. 19, 2023.

(51) Int. Cl.
*F41A 3/20* (2006.01)
*F41A 3/72* (2006.01)

(52) U.S. Cl.
CPC . *F41A 3/20* (2013.01); *F41A 3/72* (2013.01)

(58) Field of Classification Search
CPC ..... F41A 3/72; F41A 3/12; F41A 3/14; F41A 3/16; F41A 3/18; F41A 3/20; F41A 2/66
See application file for complete search history.

(56) References Cited

U.S. PATENT DOCUMENTS

| | | | | |
|---|---|---|---|---|
| 8,342,075 | B2 * | 1/2013 | Gomez | F41A 3/66 89/191.01 |
| D702,793 | S | 4/2014 | Burt et al. | |
| 9,109,848 | B2 | 8/2015 | Brown | |
| 9,279,628 | B1 * | 3/2016 | Pollack | F41A 3/72 |
| 9,766,026 | B2 | 9/2017 | Hirt et al. | |
| 10,006,726 | B1 * | 6/2018 | Oglesby | F41A 3/20 |
| 10,101,101 | B2 | 10/2018 | Langevin et al. | |
| 10,557,678 | B2 | 2/2020 | Barrett et al. | |
| 11,022,385 | B2 | 6/2021 | Steimke et al. | |
| D1,100,107 | S * | 10/2025 | Herd | D22/103 |
| 2015/0226501 | A1 * | 8/2015 | Gibbens | F41A 3/66 42/16 |
| 2017/0016690 | A1 * | 1/2017 | Timmons | F41A 3/66 |
| 2017/0241724 | A1 * | 8/2017 | Lammers | F41G 11/003 |
| 2018/0045476 | A1 * | 2/2018 | Hamilton | F41A 3/22 |
| 2019/0078849 | A1 * | 3/2019 | Schafer | F41A 3/22 |
| 2019/0257601 | A1 * | 8/2019 | Brown | F41A 3/84 |
| 2020/0182574 | A1 * | 6/2020 | Fellows | F41A 19/06 |
| 2020/0263942 | A1 * | 8/2020 | Karagias | F41A 15/14 |
| 2021/0180896 | A1 * | 6/2021 | Noonan | F41A 3/72 |
| 2024/0318933 | A1 * | 9/2024 | Parker | F41A 3/72 |

* cited by examiner

*Primary Examiner* — Joshua E Freeman

(57) ABSTRACT

A firearm having a straight pull bolt action operating mechanism. The firearm has a lower receiver housing a trigger assembly, an upper receiver having a longitudinal axis, and a bolt carrier assembly within the upper receiver. The bolt carrier assembly has a bolt carrier, a bolt, a follower element, and an operating component. The bolt is received by the bolt carrier and is configured to rotate about the longitudinal axis. The operating component is configured to be manually operated by a user.

20 Claims, 55 Drawing Sheets

FIREARM

CROSS-REFERENCE TO RELATED APPLICATIONS

This application claims the benefit of U.S. Provisional Application 63/591,479, filed Oct. 19, 2023, which is incorporated herein by reference in its entirety.

BACKGROUND

The present disclosure relates generally to firearms, and more particularly to bolt action firearms.

Firearms are available in an ever-increasing variety of action types and calibers. The firearms consumer market demands substantial customization and modification support, increased accuracy and precision, and an ever-broadening range of features. Bolt action firearms having straight pull actions are commonly sold but are less popular than other common action types. These firearms are often lacking in aftermarket support, accessory compatibility, and extensive caliber options.

Improvements in firearms, in particular bolt action firearms, are desired.

BRIEF SUMMARY

The present invention provides a firearm action which allows straight pull operation, with ergonomic benefits and substantial aftermarket compatibility in one embodiment. The present invention also provides related methods for operating and assembling the firearm in other embodiments.

In one implementation, the firearm has a lower receiver housing a trigger assembly, an upper receiver having a longitudinal axis, and a bolt carrier assembly located within the upper receiver. The bolt carrier assembly has a bolt carrier, a bolt, a follower element, and an operating component. The bolt carrier is configured to translate along the longitudinal axis. The bolt carrier has a cam feature. The bolt is received by the bolt carrier and is configured to rotate about the longitudinal axis. The follower element engages the bolt and the cam feature of the bolt carrier. The operating component engages the bolt carrier. The operating component is in surface contact with the upper receiver and the lower receiver.

In another implementation, a firearm has a lower receiver, an upper receiver, and a bolt carrier assembly. The lower receiver houses a trigger assembly. The upper receiver has a longitudinal axis and a passageway extending along the longitudinal axis. The passageway has a main portion and a cam portion. The bolt carrier assembly is located within the passageway of the upper receiver. The bolt carrier assembly has a bolt carrier, a bolt, a follower element, and an operating component. The bolt carrier is configured to translate along the longitudinal axis. The bolt carrier has a cam feature. The bolt is received by the bolt carrier and is configured to rotate about the longitudinal axis. The follower element engages the bolt and the cam feature of the bolt carrier. The operating component engages the bolt carrier. The operating component engages a first guide surface, the first guide surface preventing rotation of the bolt carrier.

In yet another implementation, a firearm has a lower receiver, an upper receiver, and a bolt carrier assembly. The lower receiver houses a trigger assembly. The upper receiver has a longitudinal axis and a passageway extending along the longitudinal axis. The passageway has a main portion and a cam portion. The cam portion has a first surface and a second surface. The bolt carrier assembly is located within the passageway of the upper receiver. The bolt carrier assembly has a bolt carrier, a bolt, a follower element, and an operating component. The bolt carrier is configured to translate along the longitudinal axis. The bolt carrier has a cam feature. The bolt is received by the bolt carrier and is configured to rotate about the longitudinal axis. The follower element engages the bolt and the cam feature of the bolt carrier. The operating component engages the bolt carrier. When the bolt carrier is in a first position, the follower element is constrained from rotation about the longitudinal axis by the first and second surfaces of the cam portion. The operating component engages a first guide surface.

In a further implementation, a bolt carrier assembly for a firearm has a bolt carrier, a bolt, a follower element, and an operating component. The bolt carrier is configured to translate along a longitudinal axis. The bolt carrier has a cam feature. The bolt is received by the bolt carrier and is configured to rotate about the longitudinal axis. The follower element engages the bolt and the cam feature of the bolt carrier. The operating component engages the bolt carrier. The operating component is slidably coupled to the bolt carrier along a coupling direction perpendicular to the longitudinal axis.

In another implementation, a method of operating a firearm may be implemented. First, a bolt carrier assembly of a firearm is positioned in a first position within a passageway extending along a longitudinal axis of an upper receiver so that a follower element engages first and second surfaces of a cam portion of the passageway and an operating component engages a first guide surface. Second, the bolt carrier assembly is translated along the longitudinal axis to a second position, the operating component engaging the first guide surface. Third, a bolt of the bolt carrier assembly is rotated by moving the bolt carrier assembly to a third position, the bolt engaging the follower element. The follower element moves along a cam feature of the bolt carrier and the operating component engages the first guide surface.

In yet another implementation, a method of assembling a firearm may be implemented. First, an upper receiver is provided, the upper receiver having a passageway extending along a longitudinal axis. Second, a bolt carrier assembly is inserted within the passageway through a rear aperture of the upper receiver. Third, an operating component is engaged with a bolt carrier of the bolt carrier assembly. Fourth, the upper receiver is coupled to a lower receiver.

In a further implementation, a firearm has a lower receiver, an upper receiver, and a bolt carrier assembly. The lower receiver houses a trigger assembly. The upper receiver has a longitudinal axis, a passageway extending along the longitudinal axis, and a slot extending from the passageway to an outer surface of the upper receiver. The bolt carrier assembly is located within the passageway of the upper receiver. The bolt carrier assembly has a bolt carrier and an operating component, the operating component detachably coupled to the bolt carrier.

In another implementation, a firearm has a lower receiver, an upper receiver, a bolt carrier assembly, and a detent. The lower receiver houses a trigger assembly. The upper receiver has a longitudinal axis, a passageway extending along the longitudinal axis. The bolt carrier assembly is located within the passageway of the upper receiver. The bolt carrier assembly has a bolt carrier and an operating component. A detent is configured to engage the bolt carrier assembly to maintain the firearm in battery.

In yet another implementation, a firearm has a lower receiver, a magazine, an upper receiver, a bolt carrier assembly, a barrel assembly, and a feed insert. The lower receiver houses a trigger assembly. The magazine is located within a magazine well formed in the lower receiver. The magazine has a magazine body, a follower, a spring configured to provide a biasing force to the follower, and a plurality of cartridges, the plurality of cartridges biased against feed lips of the magazine body by the follower. The upper receiver has a longitudinal axis, a passageway extending along the longitudinal axis. The bolt carrier assembly is located within the passageway of the upper receiver. The bolt carrier assembly has a bolt. The barrel assembly is coupled to the upper receiver. The barrel assembly has a barrel aligned with the longitudinal axis and a barrel extension configured to receive the bolt of the bolt carrier assembly. The barrel extension has a feed ramp. The feed insert is coupled to the upper receiver. The feed insert has a clearance path configured to allow passage of the plurality of cartridges and a secondary ramp configured to engage a first one of the plurality of cartridges and direct the first one of the plurality of cartridges to the feed ramp of the barrel extension.

In a further implementation, a firearm has a lower receiver, an upper receiver, an ejector, and a bolt carrier. The lower receiver houses a trigger assembly. The upper receiver has a longitudinal axis, a passageway extending along the longitudinal axis. The ejector is coupled to the upper receiver, the ejector having an ejection portion extending into the passageway. The bolt carrier assembly is located within the passageway of the upper receiver. The bolt carrier assembly has a bolt carrier and a bolt. The bolt and the bolt carrier each have a slot. The ejection portion is configured to pass within the slots of each of the bolt carrier and the bolt when the bolt carrier assembly is transitioned from a first position to a second position along the longitudinal axis.

Although the firearms may be described herein as straight pull bolt action firearms, this represents one category of use for the disclosed embodiments. It is to be understood that the same features and related processes may further be used for other action types and are not strictly limited to firearms. The embodiments of the invention disclosed herein should therefore be considered broadly as an operating system for a firearm or other projectile launching device. Accordingly, the present invention is expressly not limited to use with straight pull bolt action firearms.

BRIEF DESCRIPTION OF THE DRAWINGS

The present invention will become more fully understood from the detailed description and the accompanying drawings, wherein like elements are labeled similarly and in which.

Figure 1:
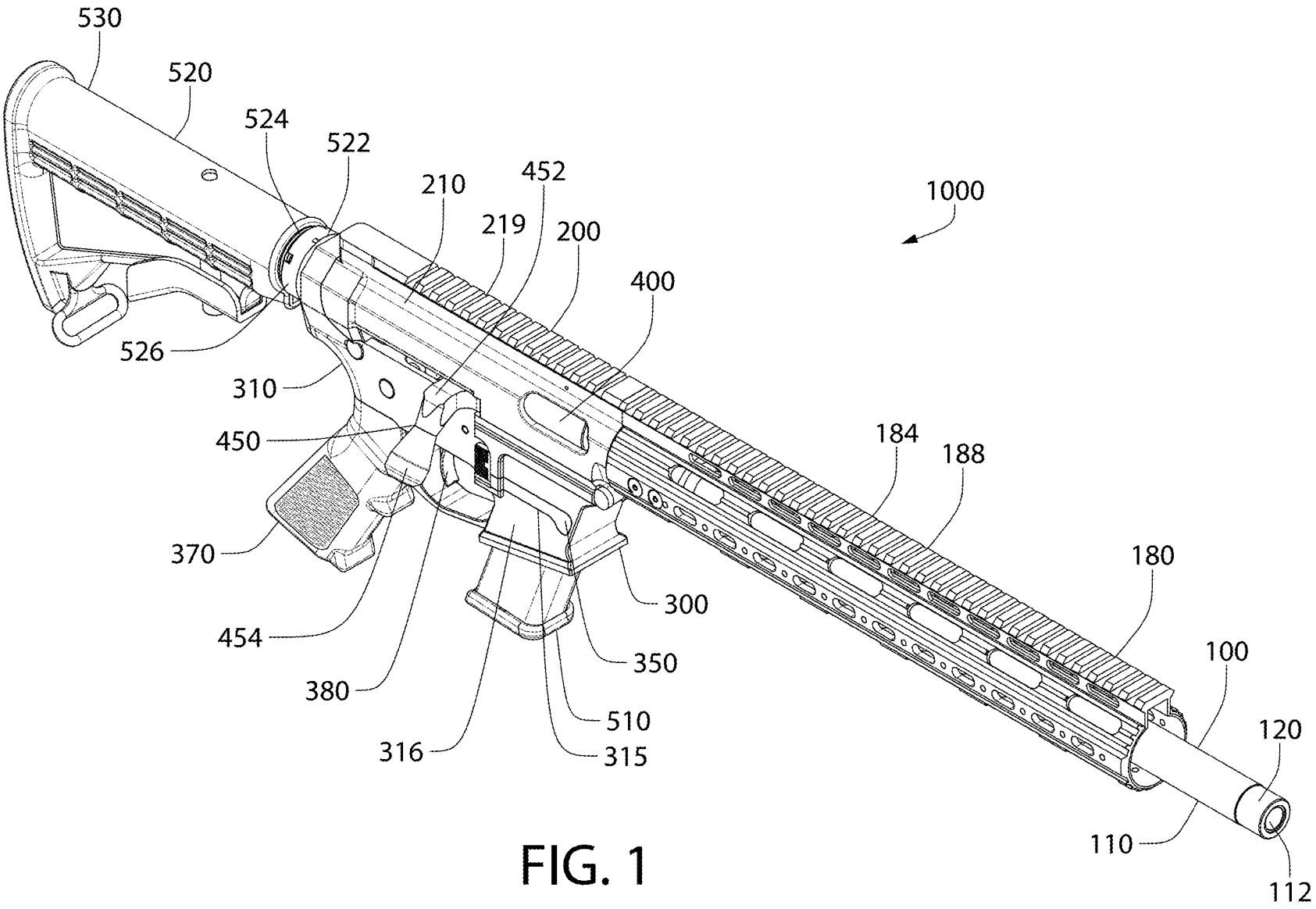
FIG. 1 is a top right perspective view of a firearm of the present invention.
Figure 2:
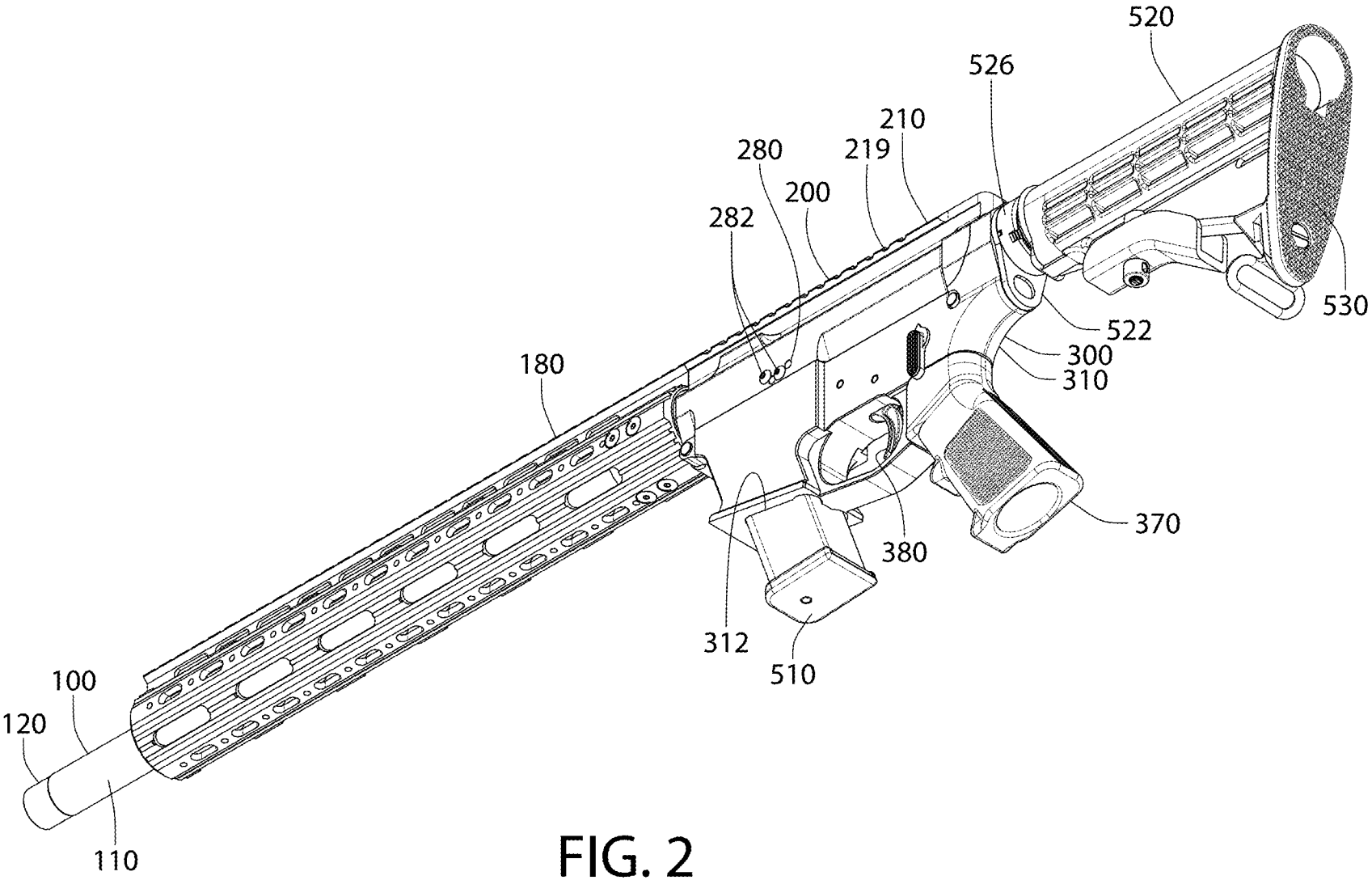
FIG. 2 is a bottom left perspective view of the firearm.
Figure 3:
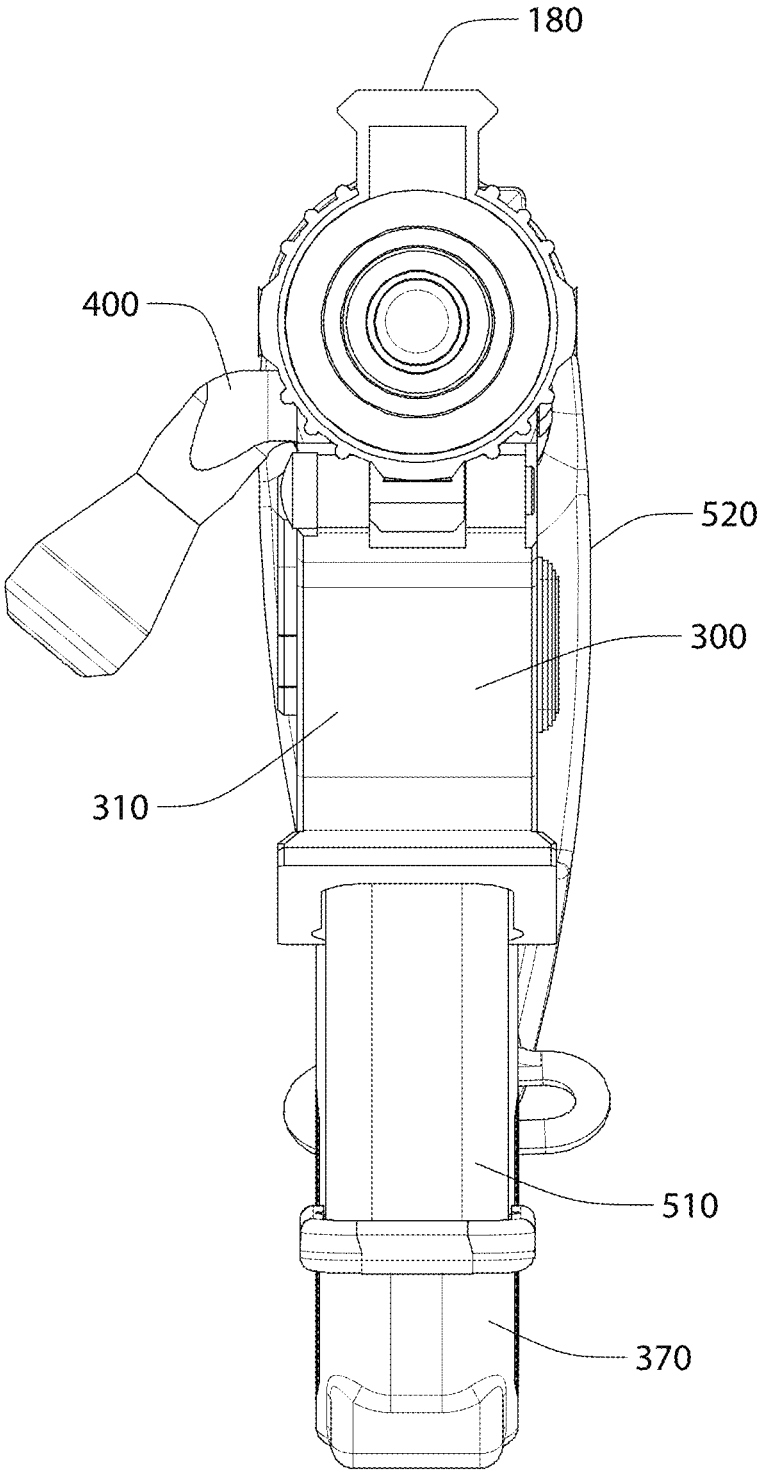
FIG. 3 is a front view of the firearm.
Figure 4:
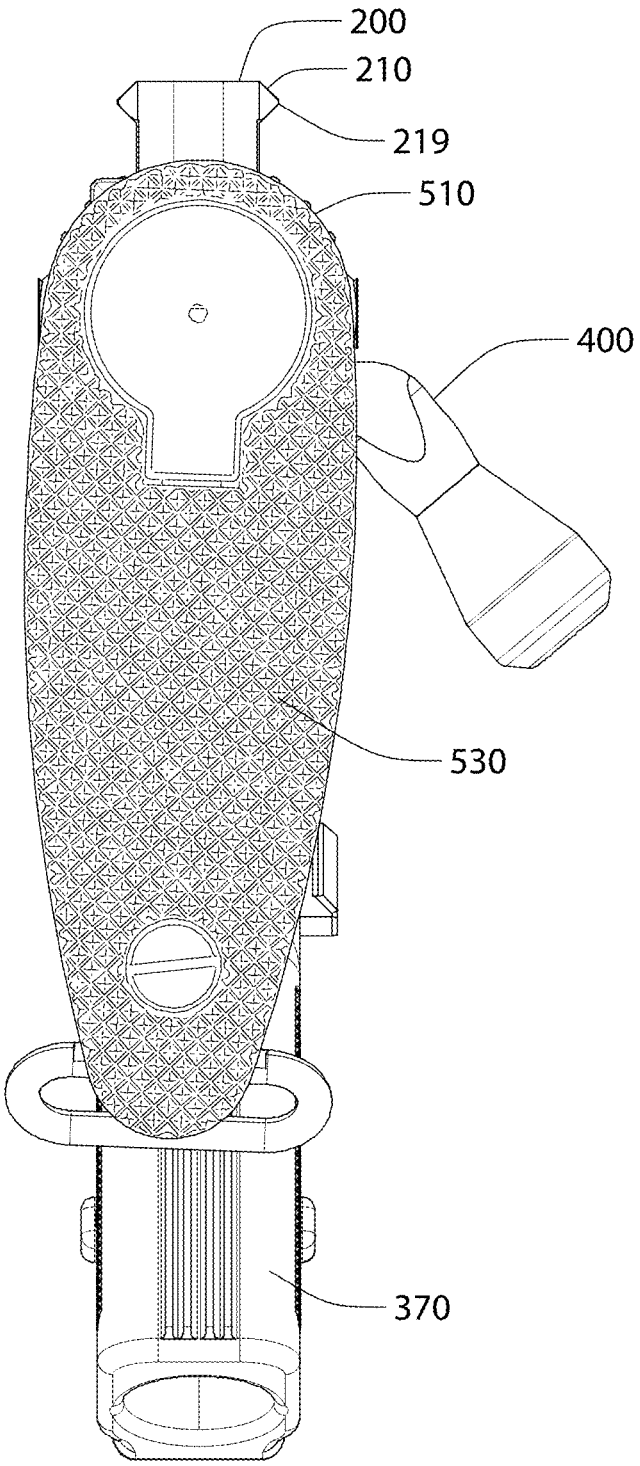
FIG. 4 is a rear view of the firearm.
Figure 5:
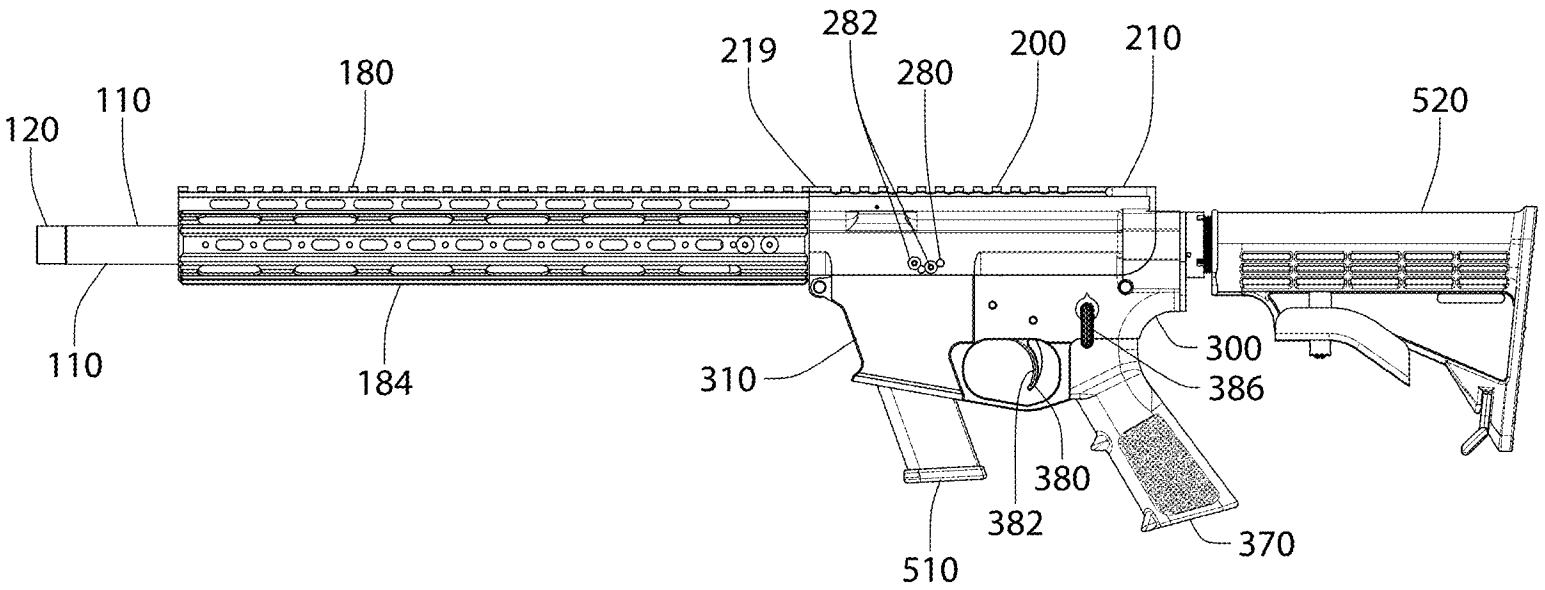
FIG. 5 is a left view of the firearm.
Figure 6:
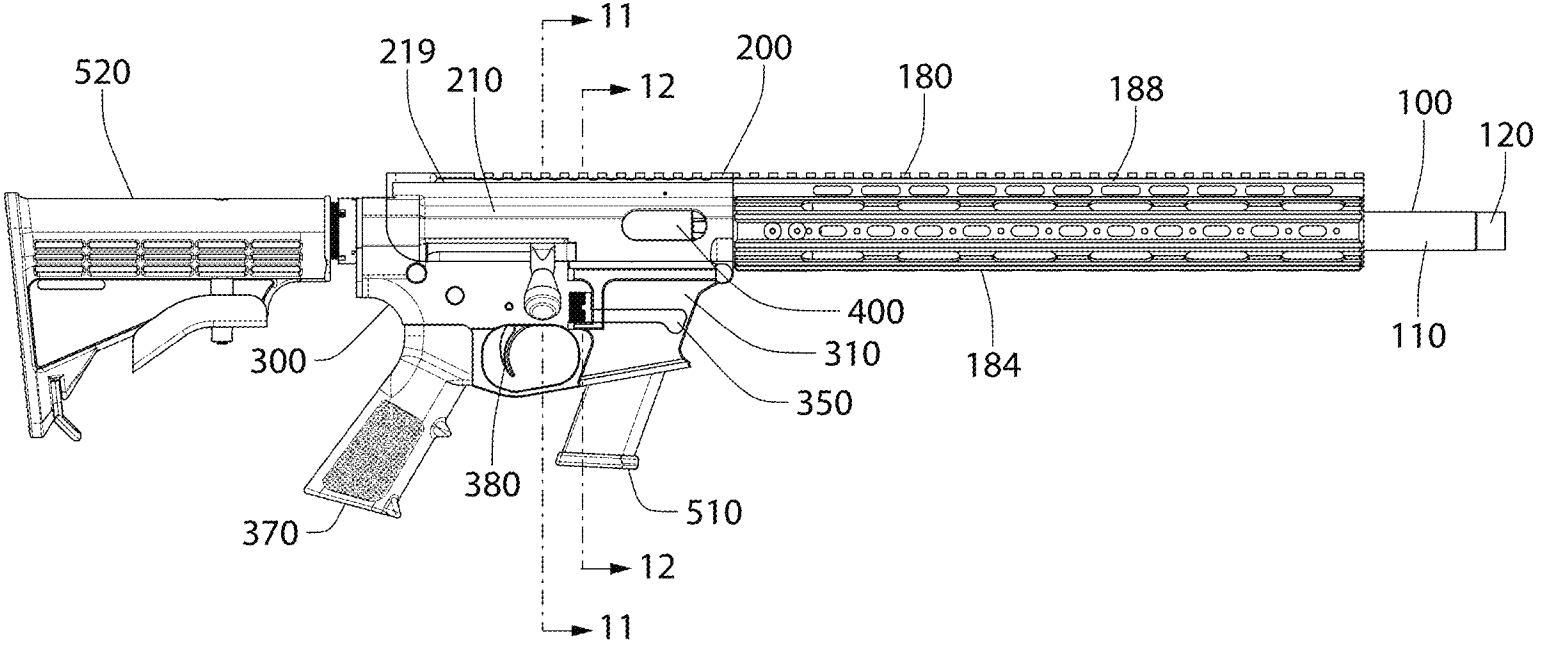
FIG. 6 is a right view of the firearm.
Figure 7:
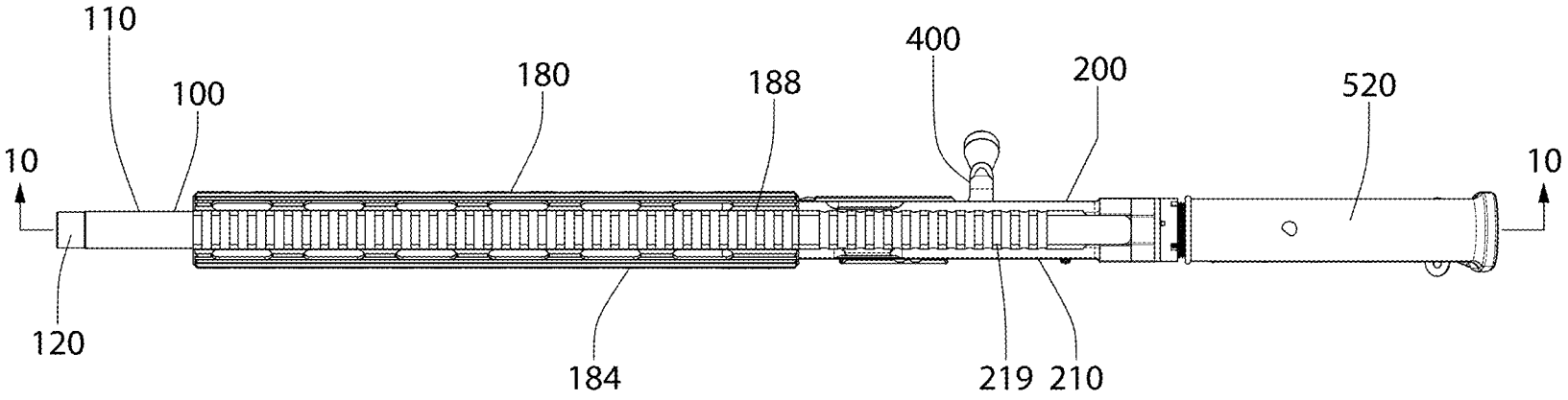
FIG. 7 is a top view of the firearm.
Figure 8:
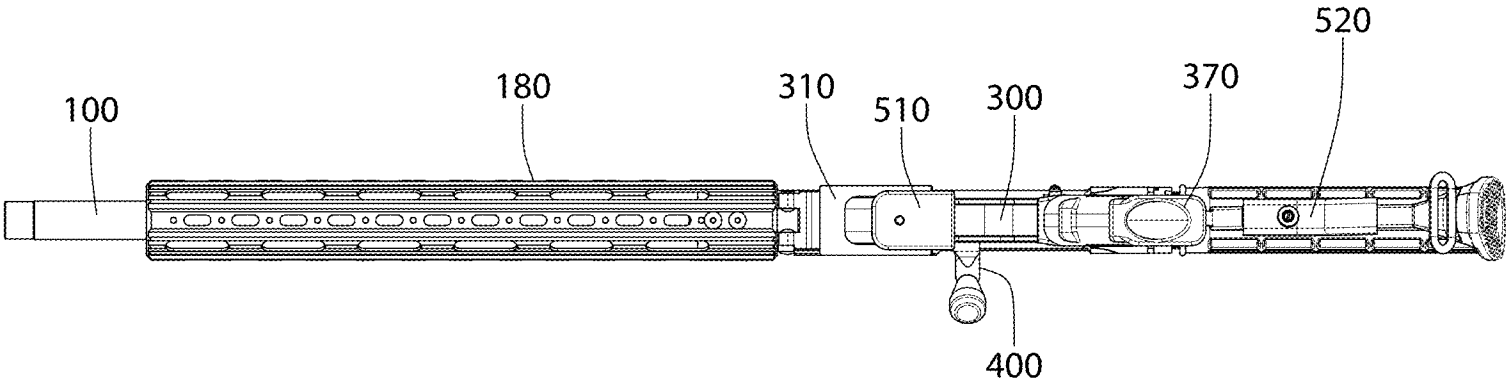
FIG. 8 is a bottom view of the firearm.
Figure 9:
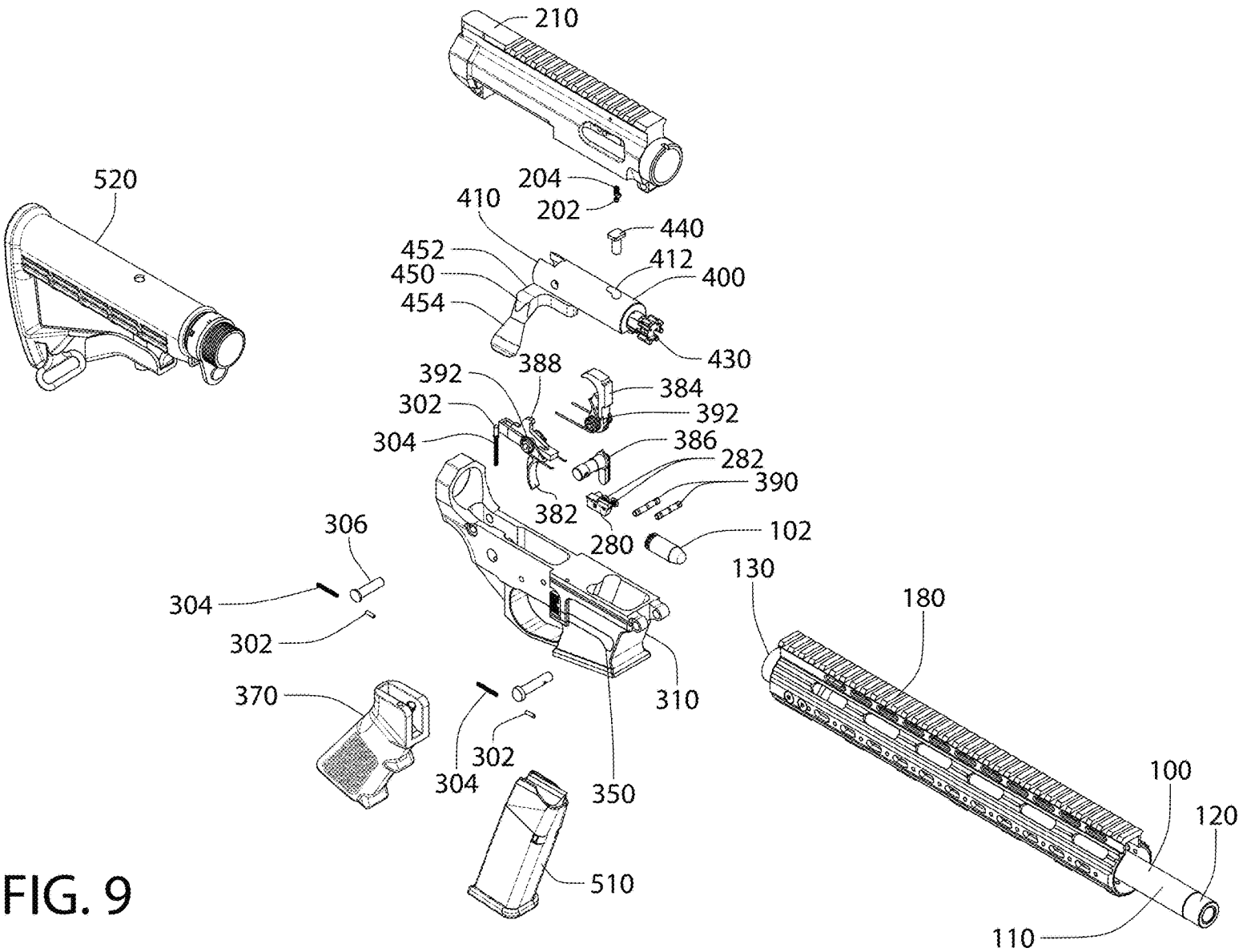
FIG. 9 is an exploded view of the firearm.
Figure 10:
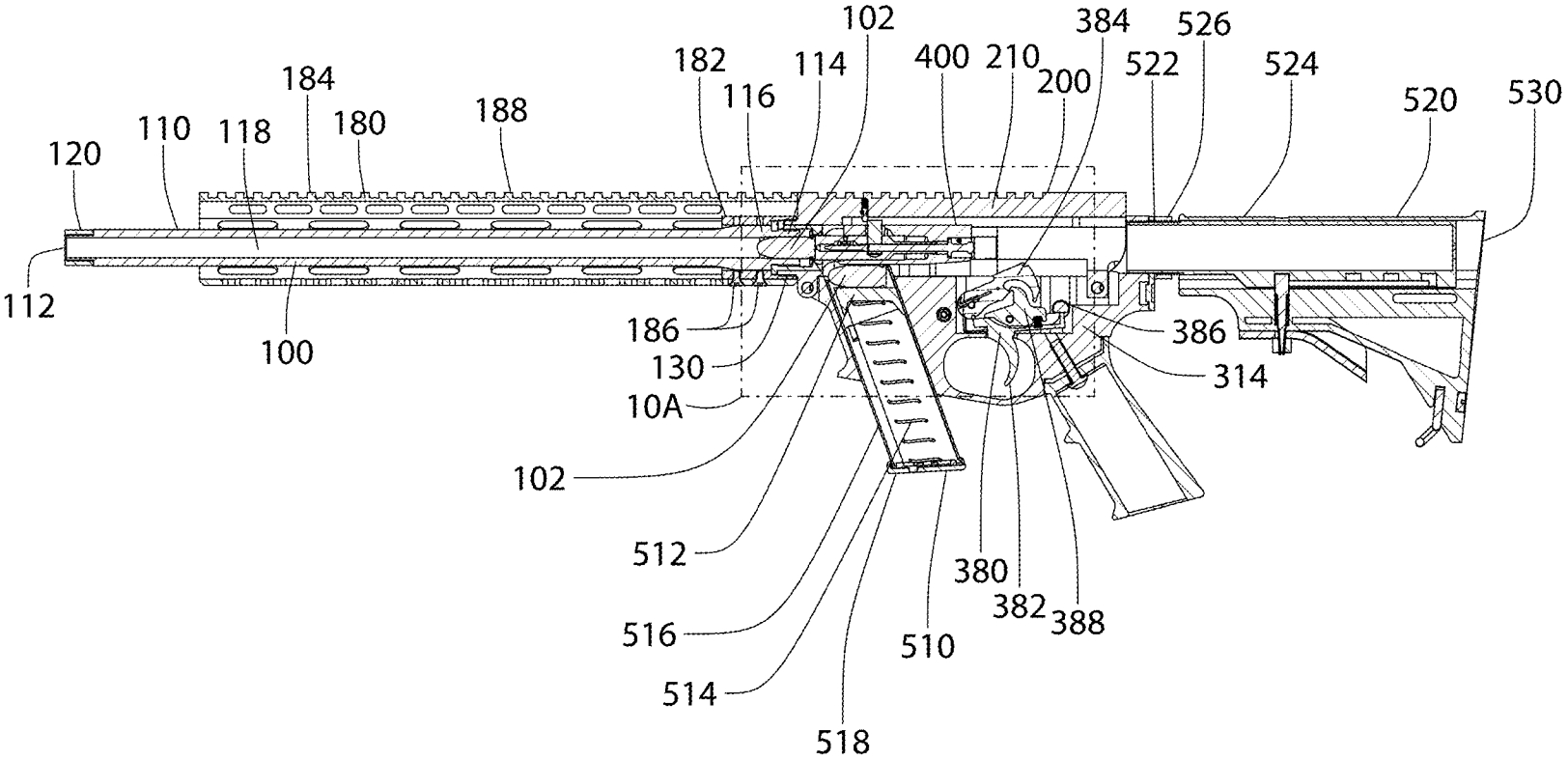
FIG. 10 is a cross-section view of the firearm taken along line 10-10 of FIG. 7.
Figure 10A:
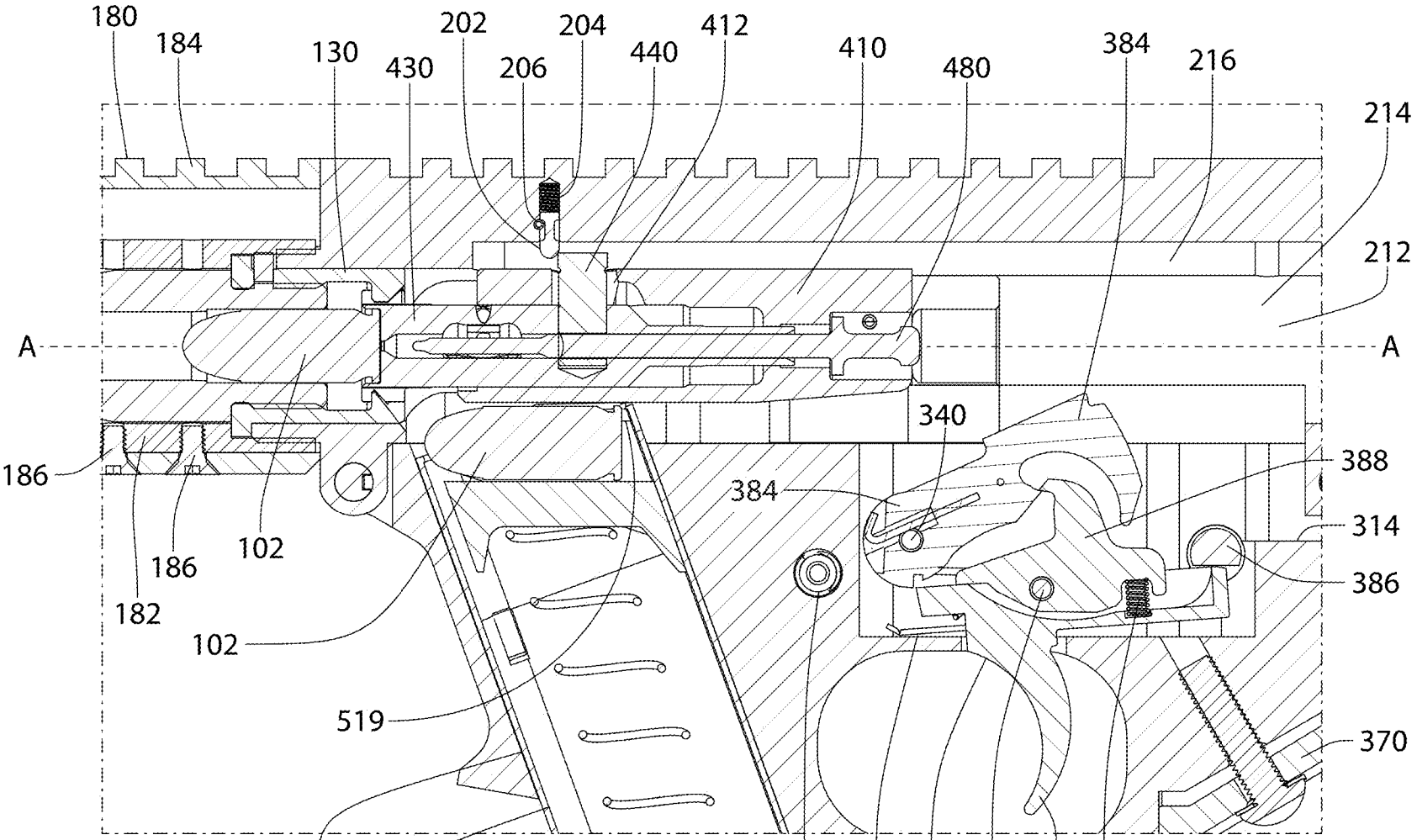
FIG. 10A is a detail view of FIG. 10 showing internal features of the firearm.
Figure 11:
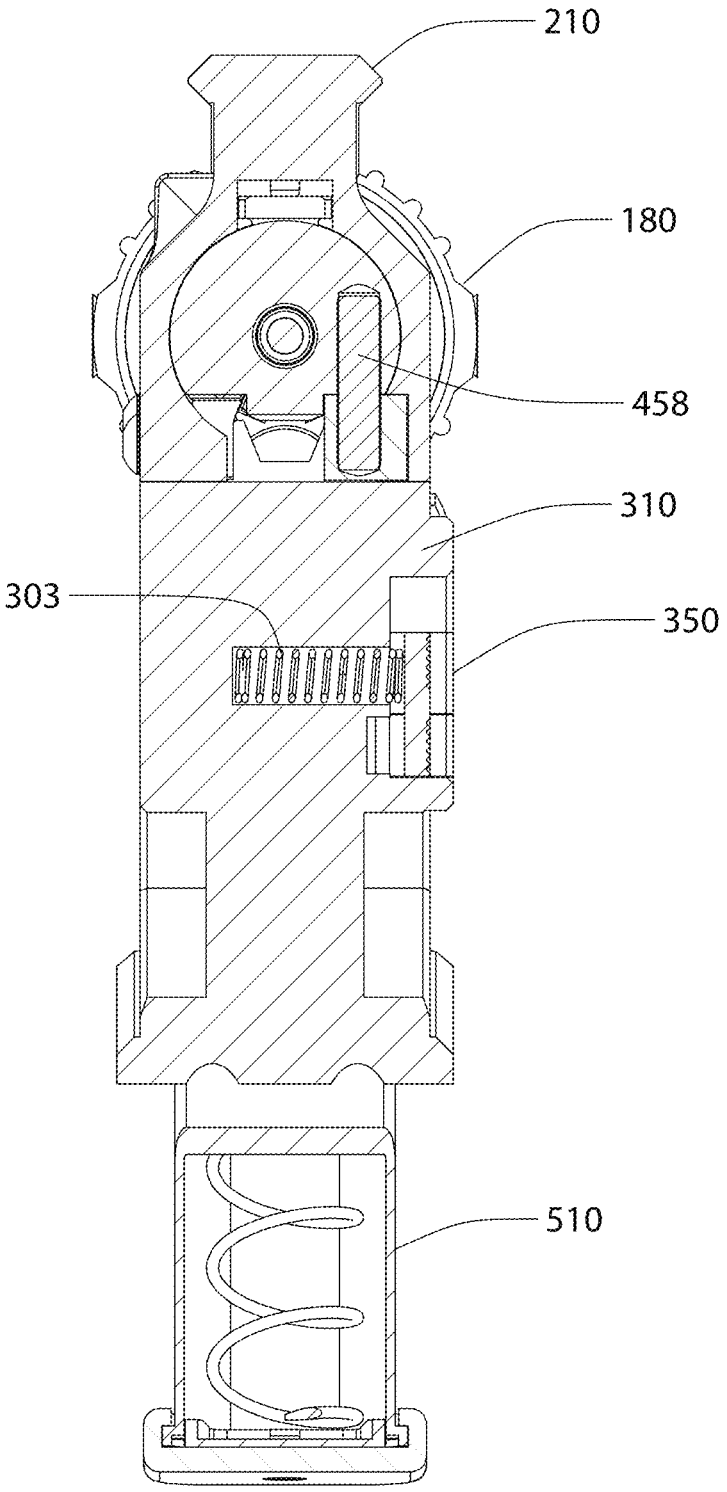
FIG. 11 is another cross-section view of the firearm taken along line 11-11 of FIG. 6.
Figure 12:
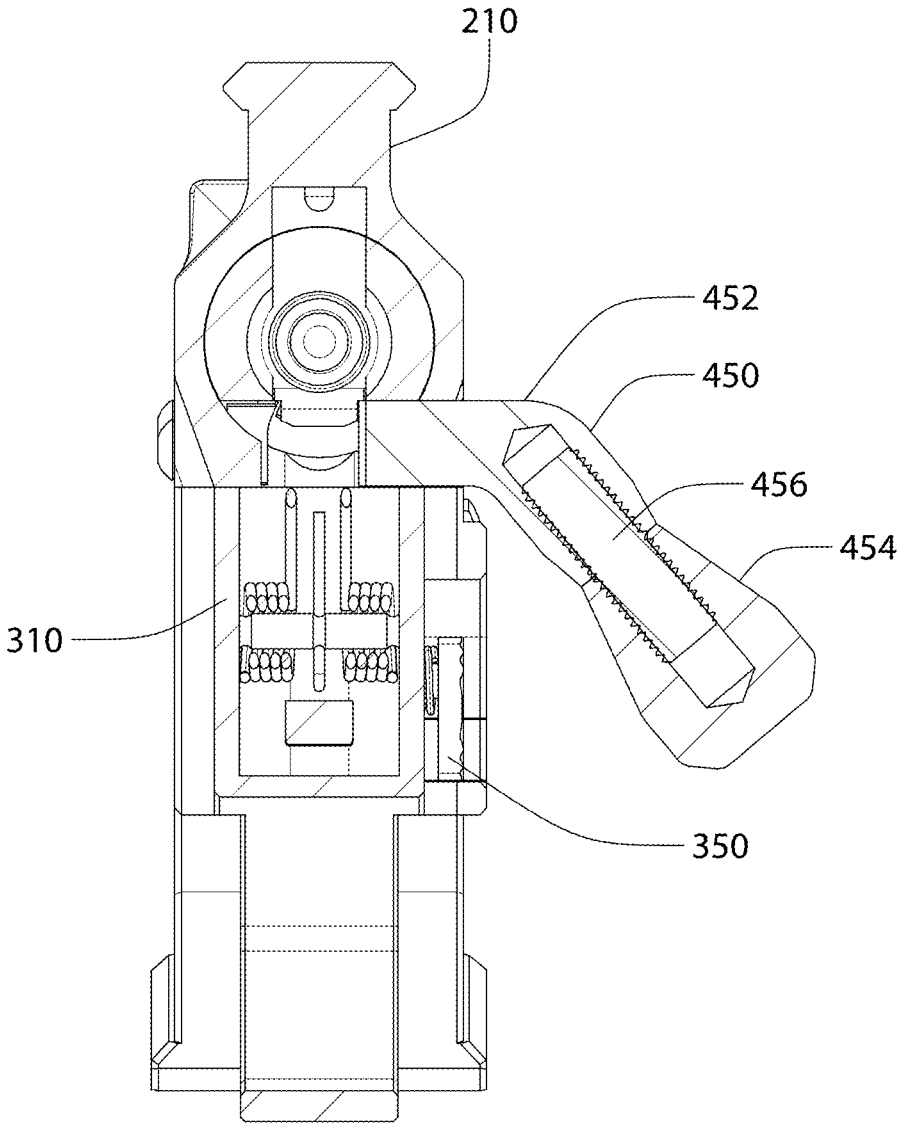
FIG. 12 is another cross-section view of the firearm taken along line 12-12 of FIG. 6.

All drawings are not necessarily to scale. Components numbered and appearing in one figure but appearing unnumbered in other figures are the same unless expressly noted otherwise. A reference herein to a whole figure number which appears in multiple figures bearing the same whole number but with different alphabetical suffixes shall be construed as a general reference to all of those figures unless expressly noted otherwise.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

FIGS. 1-12 illustrate a firearm 1000 according to the present disclosure. The firearm 1000 may be a rifle, pistol, or another type of firearm. The firearm 1000 may be a bolt action firearm or may be a semi-automatic or automatic rifle. In the illustrated embodiment, the firearm 1000 is a straight pull bolt action rifle. However, it is contemplated that the same concepts may be implemented in bolt action pistols or other firearms. It is also contemplated that features of the action may be implemented in other projectile launching devices.

The firearm 1000 has a barrel assembly 100, a hand guard 180, an upper receiver assembly 200, a lower receiver assembly 300, a bolt carrier assembly 400, a magazine 510, and a stock assembly 520. The barrel assembly 100 includes a barrel 110 that extends from a breech end 112 to a muzzle end 114. The muzzle end 114 may be threaded to receive a barrel device such as a thread protector 120, flash hider, muzzle brake, sound suppressor, or other device. The barrel 110 may further include a barrel extension 130 at the breech end 112 to engage with a bolt as will be described below. In other implementations, engagement features which engage the bolt may be incorporated into the upper receiver assembly 200 or another component.

The breech end 112 of the barrel 110 has a chamber 116 which accepts a cartridge 102. The barrel 110 may have a bore 118 which is rifled or smooth as desired, the bore 118 extending from the chamber 116 to the muzzle end 114 of the barrel 110. The bore 118 may be sized to allow firing of a variety of projectiles, and the chamber 116 may also be sized to accept a wide range of cartridges. Thus, a range of cartridges having a variety of different projectile diameters may be adapted to the firearm 1000 by varying dimensions of the barrel 110.

The hand guard 180 may have a multi-part construction or a single component construction. The hand guard 180 may have a nut 182 and a guard portion 184, the nut 182 clamping the barrel extension 130 to an upper receiver 210 of the upper receiver assembly 200. The hand guard 180 may also have a plurality of fasteners 186 which are used to secure the guard portion 184 to the nut 182. The hand guard 180 may incorporate a rail 188 or other features for accessory mounting, mounting of iron sights, optics, or other sighting devices.

The upper receiver assembly 200 is primary formed by the upper receiver 210. The upper receiver 210 will be discussed in greater detail below. The upper receiver assembly 200 also includes an ejector 280 and a plurality of fasteners 282, the fasteners 282 securing the ejector 280 to the upper receiver 210. The ejector 280 will also be discussed in greater detail below. The upper receiver 210 also includes a rail 219, the rail 219 configured to receive accessories, sights, optics, or other devices. For instance, the rail 219 may mount a telescope, a set of iron sights, a light, an imaging device, or other similar devices. The rail 219 of the upper receiver 218 may align with the rail 188 of the guard portion 184 of the hand guard 180. This may allow use of multiple sights or optical devices which are aligned along the rails 188, 218. The upper receiver assembly 200 further includes a detent 202, a spring 204, and a pin 206. The detent 202 is biased downward by the spring 204, and the pin 206 retains the detent as illustrated. In some configurations, the detent 202, spring 204, and pin 206 may be omitted.

The lower receiver assembly 300 has a lower receiver 310, a grip 370, a trigger assembly 380, and a magazine catch 350. The lower receiver 310 receives a magazine 510 in a magazine well 312, and the magazine catch 350 retains the magazine 510 within the magazine well 312. The lower receiver 310 of the lower receiver assembly 300 also receives the stock assembly 520. The stock assembly 520 may incorporate a retainer plate 522, a buffer tube 524, a retainer nut 526, and a stock 530. The buffer tube 524 is threaded into the lower receiver 310, while the retainer plate 522 engages the lower receiver 310 to prevent rotation of the buffer tube 524 and may retain a spring 304 and detent 302 for the rear takedown pin 306.

The rear takedown pin 306 and a front takedown pin 308 are also part of the lower receiver assembly 300, along with their associated detents 302 and springs 304. The rear takedown pin 306 secures the upper receiver 210 of the upper receiver assembly 200 to the lower receiver 310 of the lower receiver assembly 300. Similarly, the front takedown pin 308 secures the upper receiver 210 of the upper receiver assembly 200 to the lower receiver 310 of the lower receiver assembly 300. The front and rear takedown pins 308, 306 are secured within the lower receiver 310 by the detents 302, the detents 302 being biased by the springs 304. The takedown pins 308, 306 allow removal of the upper receiver assembly 200 from the lower receiver assembly 300.

The retainer nut 526 clamps the retainer plate 522 to the lower receiver 310, ensuring that the stock assembly 520 remains securely fastened to the lower receiver 310. The stock 530 may be adjustable, and may slide along the buffer tube 524 when a retainer is retracted from the buffer tube 524, allowing adjustment of the length of pull for the preferences of individual users. In other implementations, the stock assembly 520 may be fixed such that it is not adjustable for length of pull.

The grip 370 may be mounted directly to the lower receiver 310 or may form a part of the stock assembly 520. In other implementations, the grip 370 may be integrated into the lower receiver, the stock assembly 520, or another part. In the present implementation, the grip 370 is a separate component which is secured to the lower receiver 310 by a fastener, but other configurations are contemplated.

The lower receiver 310 has a fire control group pocket 314, the fire control group pocket 314 receiving the trigger assembly 380. The trigger assembly 380 has a trigger 382, a hammer 384, a safety 386, and a disconnector 388. A plurality of pins 390 and springs 392 are also part of the trigger assembly 380, the hammer 384, trigger 382, and disconnector 388 rotating about the pins 390 and the springs 392 biasing the various parts as required to provide the necessary functionality. Other configurations of trigger assemblies 380 may be used, as required. For instance, a striker may be substituted for a hammer. Different triggers, disconnectors, and hammers are also contemplated. Springs may take any desired form required to achieve ignition of the cartridge in question. An additional detent 302 and spring 304 may be used to engage the safety 386 and provide a plurality of detent positions for the safety 386.

The magazine 510 has a follower 512, a spring 514, and a magazine body 516. A floor plate 518 contains the follower 512 and spring 514 within the magazine body 516. The spring 514 provides a biasing force to the follower 512. In turn, the follower presses the cartridges 102 against feed lips 519 of the magazine body 516, presenting the cartridges 102 for feeding into the firearm. The magazine body 516 also comprises a retention feature which engages the magazine catch 350. The magazine catch 350 is part of the lower receiver assembly 300, fitting within a magazine catch aperture 315 extending from an outer surface 316 of the lower receiver 310 to the magazine well 312. The magazine catch 350 is configured to allow insertion and removal of the magazine 510 rapidly and easily using only finger pressure. The lower receiver assembly 300 has a spring 303 which biases the magazine catch 350 into a state where it engages the magazine 510. The spring 302 may fit within a recess formed in the lower receiver 310.

The bolt carrier assembly 400 is located within a passageway 212 of the upper receiver 210. The passageway 212 extends along a longitudinal axis A-A, the longitudinal axis A-A being substantially coaxial and concentric with the bore 118 of the barrel 110. The passageway 212 has a main portion 214 which is generally cylindrical and a cam portion 216. The main portion 214 is concentric and coaxial with the bore 118 while the cam portion 216 extends from the main portion 214. The main portion 214 of the passageway 212 may extend through an entirety of the upper receiver 210. Preferably, the main portion 214 defines a cylinder, the cam portion 216 extending from the cylinder defined by the main portion 214. In some implementations, the cam portion 216 does not extend through an entirety of the upper receiver 210, extending only a portion of a length of the upper receiver 210.

The bolt carrier assembly 400 fits within the passageway as noted above. The bolt carrier assembly 400 has, among other components, a bolt carrier 410, a bolt 430, a follower element 440, and an operating component 450. The bolt carrier 410 is configured to translate along the longitudinal axis A-A and engage the main portion 214 of the passageway 212. The bolt carrier 410 receives the bolt 430, allowing the bolt 430 to rotate within the bolt carrier 410, the bolt 430 being substantially coaxial and concentric with the longitudinal axis A-A. The bolt 430 is configured to receive a cartridge 102, allowing firing of the cartridge 102 when the bolt 430 engages and locks with the barrel extension 130 of the barrel assembly 100.

The bolt carrier 410 also includes a cam feature 412. The cam feature 412 may be a slot or surface formed on the bolt carrier 410, the cam feature 412 guiding the follower element 440 and causing the bolt 430 to rotate. The follower element 440 may be a pin or other component which is configured to engage the cam feature 412. The follower element 440 also engages the bolt 430, the follower element 440 causing the bolt 430 to rotate with respect to the longitudinal axis A-A when the follower element 440 moves along the cam feature 412. Thus, the follower element 440 is non-rotatably coupled to the bolt 430 with respect to the longitudinal axis A-A. As the bolt carrier 410 is advanced along the longitudinal axis A-A, the bolt 430 begins to engage the barrel assembly 100 and cannot move further along the longitudinal axis 430. Subsequently, the follower element 440 moves along the cam feature 412 as the bolt carrier 410 continues to advance along the longitudinal axis A-A, rotating the bolt 430. Retraction of the bolt carrier 410 reverses this process, rotating the bolt 430 back to its original position.

The operating component 450 is detachably fixed to the bolt carrier 410. The operating component 450 may be a bolt handle, a charging handle, or other device configured for manual operation of the firearm 1000. In the present implementation, the operating component 450 is a bolt handle, allowing manual operation of the firearm to achieve chambering of new cartridges 102 and extraction of spent cartridges 102 subsequent to firing. The operating component 450 may be formed as a base portion 452, a grasping portion 454, a fastener 456, and a plurality of pins 458. The grasping portion 454 may be a bolt knob or other component that may be detachably coupled to the base portion 452 via the fastener 456. The fastener 456 may be a threaded stud or other fastener that allows detachable coupling. Optionally, one of the grasping portion 454 or the base portion 452 may incorporate features to allow direct coupling of the grasping portion 454 to the base portion 452. These features may be integrally formed or permanently attached.

The base portion 454 of the operating component 450 is configured for coupling to the bolt carrier 410 such that the operating component 450 can also be detachably coupled to the bolt carrier 410. However, when the operating component 450 is coupled to the bolt carrier 410 in the assembled firearm 1000, the operating component 450 is fixed to the bolt carrier 410 such that force applied to the operating component is directly translated to the bolt carrier 410. When a force parallel to the longitudinal axis A-A is applied to the operating component 450, the bolt carrier assembly 400 is translated along the longitudinal axis A-A in tandem with the operating component 450. Thus, the bolt carrier 410 of the bolt carrier assembly 400 is fixed to the base portion 454 of the operating component 450. Otherwise stated, the bolt carrier 410 and the operating component 450 are fixed such that when the bolt carrier 410 translates along the longitudinal axis A-A, the operating component 450 also translates along the longitudinal axis A-A an equal distance.

Figure 13A:
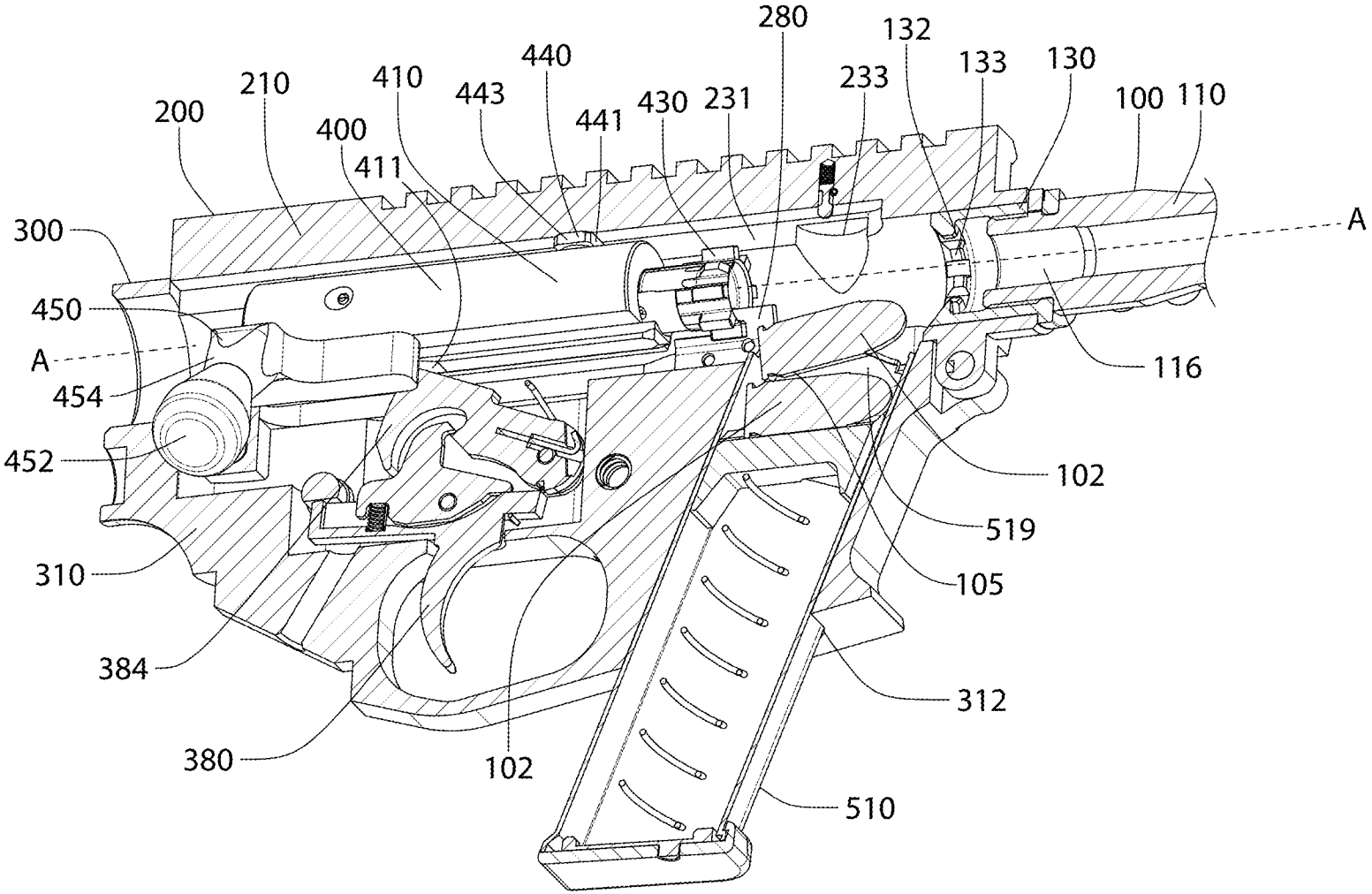
FIG. 13A is a cutaway view showing the firearm in a first state.
Figure 13B:
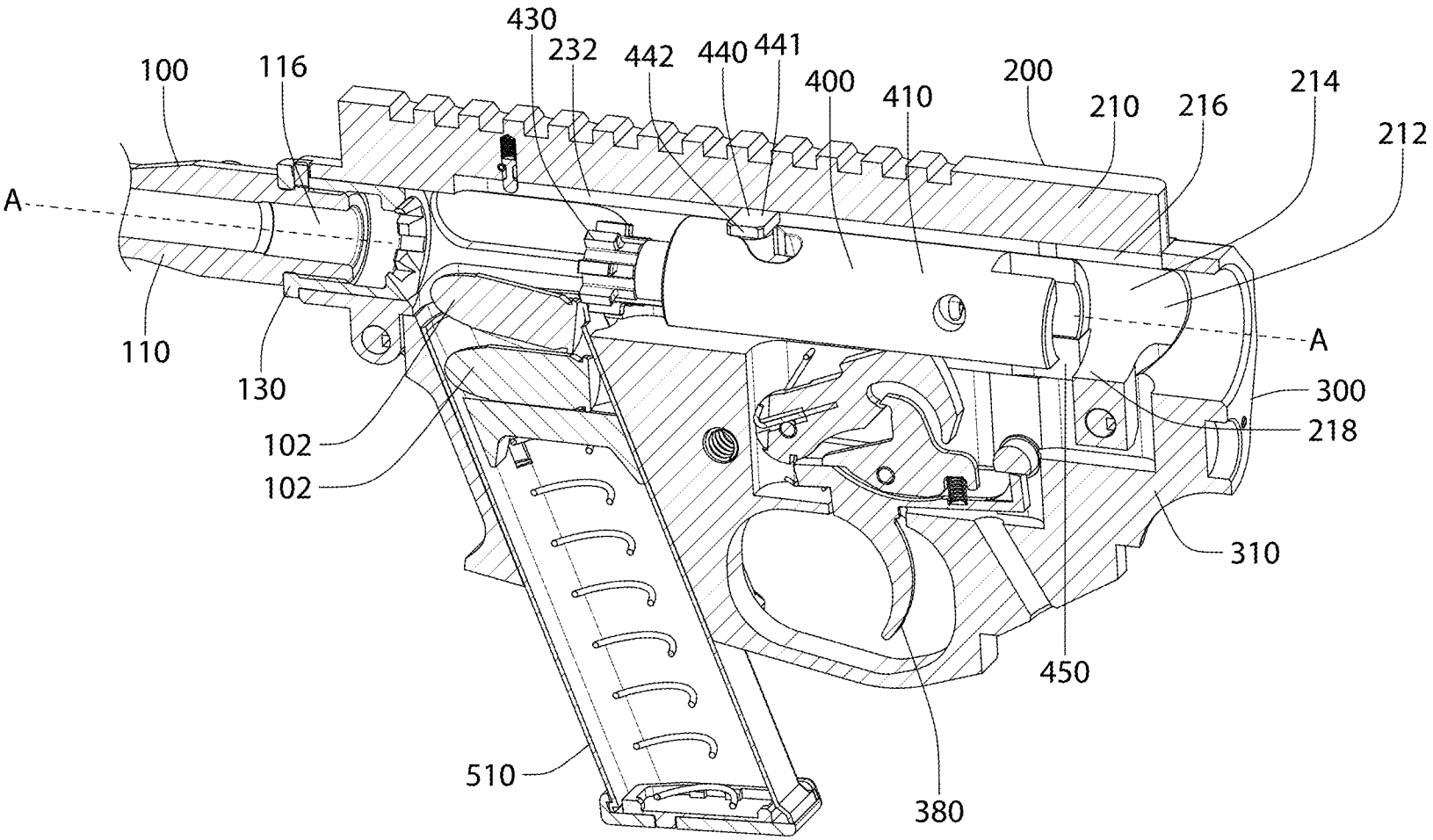
FIG. 13B is another cutaway view showing the firearm in the first state.

Turning to FIGS. 13A-17B, the operations of the firearm 1000 are described in greater detail. Each of these Figures illustrate cutaway views of the firearm 1000 in various states with some components omitted for clarity. In FIGS. 13A and 13B, the firearm is illustrated in a first state. In the first state, the bolt carrier assembly 400 is in a fully retracted position with respect to the longitudinal axis A-A. The operating component 450 engages a stop surface 218 of the upper receiver 210 when the bolt carrier assembly 400 is in a fully retracted position. The bolt 430 of the bolt carrier assembly is oriented such that the ejector 280 protrudes through the bolt 430 and the follower element 440 is oriented vertically. The ejector 280 extends beyond the bolt 430 so that it can engage a case 105 of the cartridge 102 when the bolt carrier assembly 400 is retracted so that the firearm is in the first state. The bolt carrier 410 engages the main portion 214 of the passageway 212. The firearm 1000 is in an out of battery condition when the bolt carrier assembly 400 is in the fully retracted position.

The follower element 440 extends into the cam portion 216 of the passageway 212. The cam portion 216 of the passageway 212 has a first surface 231 and a second surface 232. The follower element 440 has a head 441 having a first surface 442 and a second surface 443. The first surface 231 of the cam portion 216 engages the first surface 442 of the follower element 440 while the second surface 232 of the cam portion 216 engages the second surface 443 of the follower element 440. Thus, the follower element 440 is constrained by the cam portion 216 of the passageway 212, the head 441 extending into the cam portion 216. The bolt 430 cannot rotate with respect to the bolt carrier 410 because the follower element 440 is constrained by the first and second surfaces 231, 232 of the cam portion 216 of the passageway 210 of the upper receiver 210. The cam portion 216 terminates in a clearance recess 233, but the head 441 of the follower element 440 is not located within the clearance recess 233. The bolt carrier 410 is constrained from rotation by first and second guide surfaces as will be discussed in detail below.

When the term constrained is utilized throughout the specification, this term is not intended to denote that the component have no clearance whatsoever. Instead, this term is intended to denote a close or free fit, having sufficient clearance to allow sliding motion. For instance, the follower element 440 may slide within the cam portion 216 of the passageway 212 but will have minimal lost motion between the follower element 440 and the cam portion 216. The other features are constrained in an equivalent manner, allowing sliding without substantial free play.

A cartridge 102 is presented by the magazine 510, ready for loading into the chamber 116. The magazine 510 is located within the magazine well 312 and secured by the magazine catch 350 as discussed earlier. The bolt 430 is spaced from the cartridge 102 when the bolt carrier assembly 400 is in the first state. The trigger assembly 380 is also in a cocked position where the hammer 384 is under spring pressure in preparation for firing a cartridge 102. The hammer 384 is cocked by a cocking surface 411 formed on the bolt carrier 410. Once again, when the bolt carrier assembly 400 is in the first state, the firearm 1000 is in an out of battery condition, whereby the bolt 430 is not locked with the barrel extension 130.

Figure 14A:
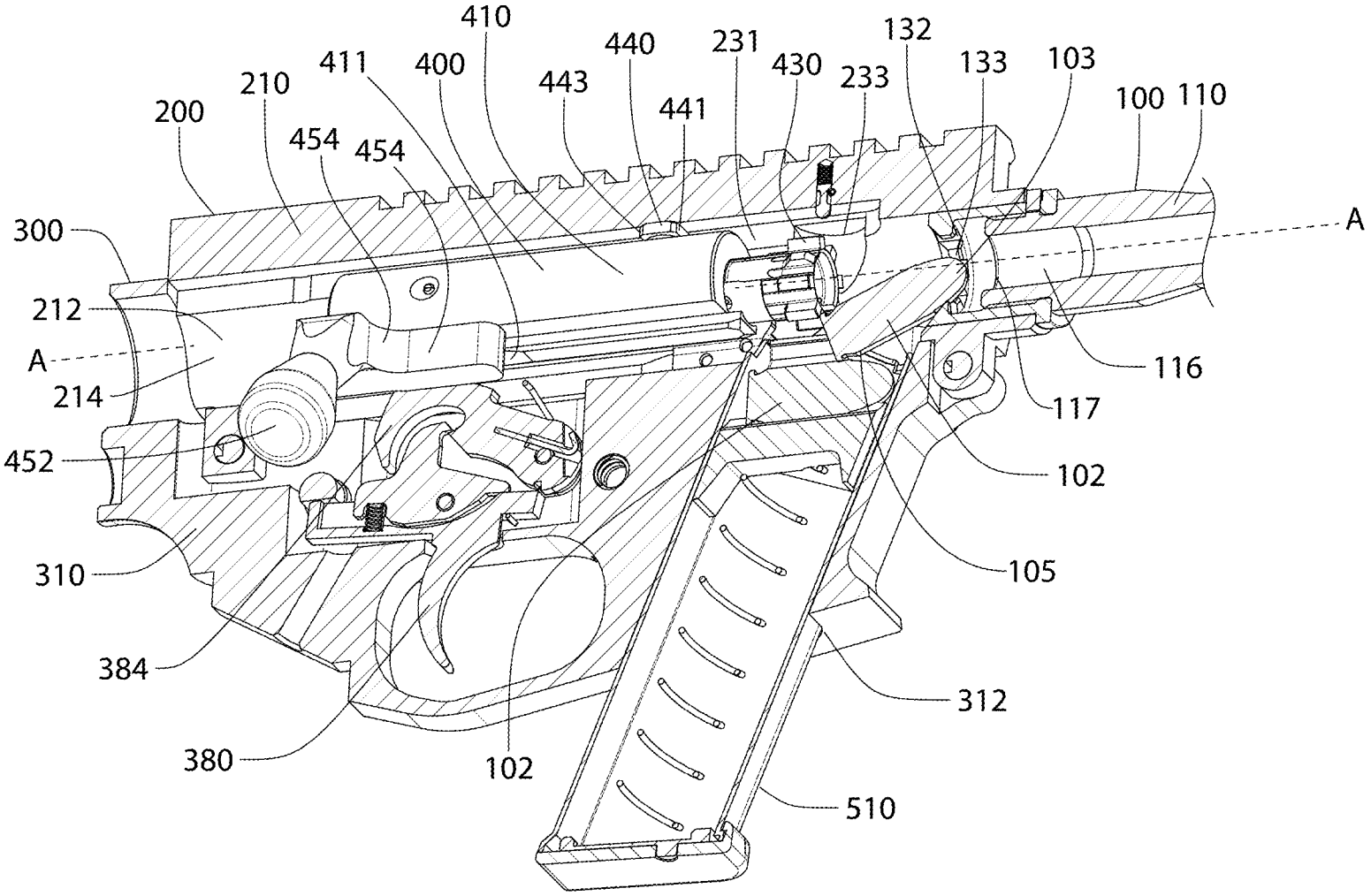
FIG. 14A is a cutaway view showing the firearm in a second state.
Figure 14B:
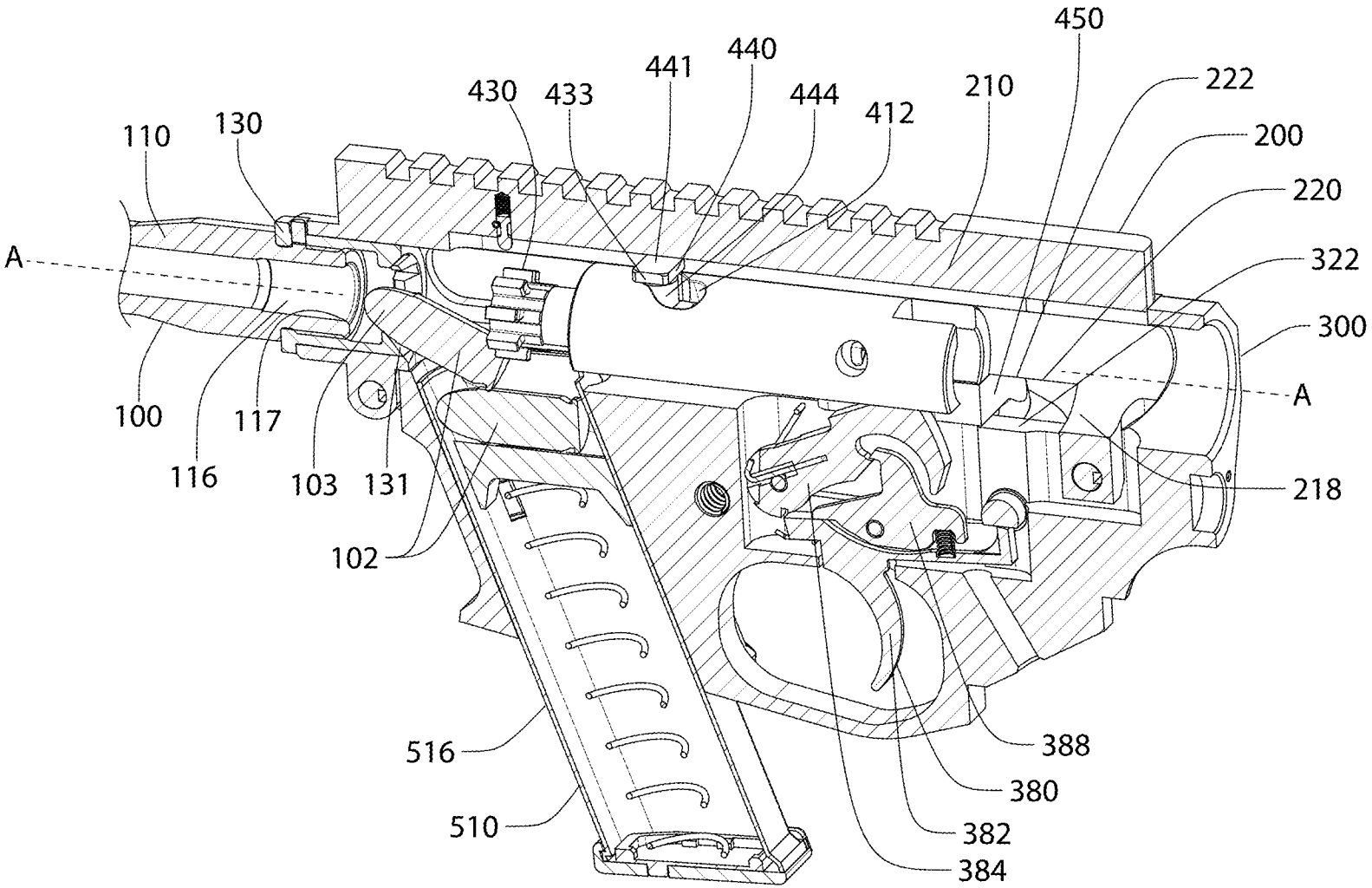
FIG. 14B is another cutaway view showing the firearm in the second state.

FIGS. 14A and 14B illustrate the firearm 1000 in a second state. In the second state, the bolt carrier assembly 400 is advanced along the longitudinal axis A-A. The bolt 430 comes in contact with a cartridge 102 in the magazine 510, pushing the cartridge 102 toward the chamber 116 of the barrel 110. A bullet 103 of the cartridge 102 engages a feed ramp 131 of the barrel extension 130 as the cartridge 102 is advanced toward the chamber 116 of the barrel 110. The feed ramp 131 may extend onto the upper receiver 210, providing a feeding surface that assists with directing the cartridge 102 to the chamber 116. The barrel 110 may also incorporate a feed cone 117 which extends from the chamber 116 to facilitate feeding of the cartridge 102. The feed lips 519 of the magazine body 516 assist in constraining the cartridges 102 as they are fed from the magazine 510. Thus, the cartridge 102 is in contact with the bolt 430, the feed lips 519 of the magazine 510, and the feed ramp 131 simultaneously as the cartridge 102 is transitioned from the magazine 510 to the chamber 116 in the second state. In the second state, the firearm 1000 remains in an out of battery condition.

The operating component 450 of the bolt carrier assembly 400 is spaced from the stop surface 218 when the bolt carrier assembly 400 is in the second state. The first and second surfaces 442, 443 of the head 441 of the follower element 440 are located within the cam portion 216 of the passageway 212 while the bolt carrier 410 is located within the main portion 214 of the passageway 212. The first and second surfaces 442, 443 of the follower element 440 engage the first and second surfaces 231, 232 of the cam portion 216 of the passageway 212. Once again, the head 441 protrudes into the cam portion 216 of the passageway 212, the first and second surfaces 231, 232 of the cam portion 216 constraining the first and second surfaces 442, 443 of the follower element 440, preventing rotation of the follower element 440 with respect to the longitudinal axis A-A. The follower element 440 also has a follower surface 444, the follower surface 444 engaging the cam feature 412 of the bolt carrier 410. The head 441 of the follower element 440 is not located within the clearance recess 233 of the cam portion 216.

The bolt carrier 410 is constrained from rotation about the longitudinal axis A-A by first and second guide surfaces 222, 322. The operating component 450 is located within a slot 220, the stop surface 218 forming a rear-most portion of the slot 220. The slot 220 is formed into the upper receiver 210 and is configured to constrain the operating component 450 from rotation about the longitudinal axis A-A. The first guide surface 222 forms an uppermost portion of the slot 220, while the second guide surface 322 is formed onto the lower receiver 310. When the upper and lower receivers 210, 310 are coupled, the first and second guide surfaces 222, 322 engage and constrain the operating component 450, and prevent movement of the operating component 450 upwardly or downwardly. This, in turn, prevents rotation of the bolt carrier 410 about the longitudinal axis A-A. The hammer 384 is in the cocked position, retained by the disconnector 388 and the trigger 382. The disconnector 388 and the trigger 382 prevent the hammer 384 from moving in response to spring force.

Figure 15A:
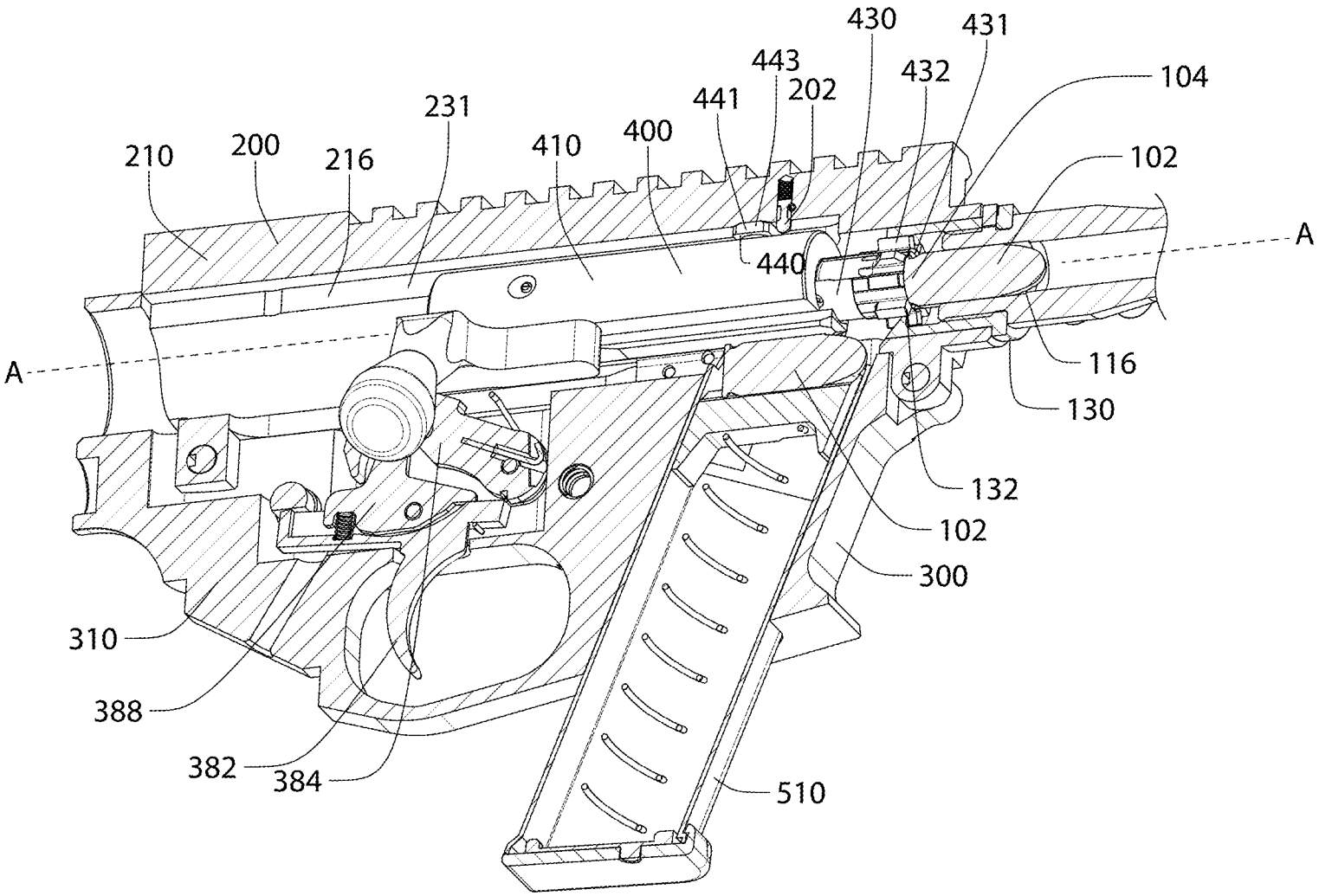
FIG. 15A is a cutaway view showing the firearm in a third state.
Figure 15B:
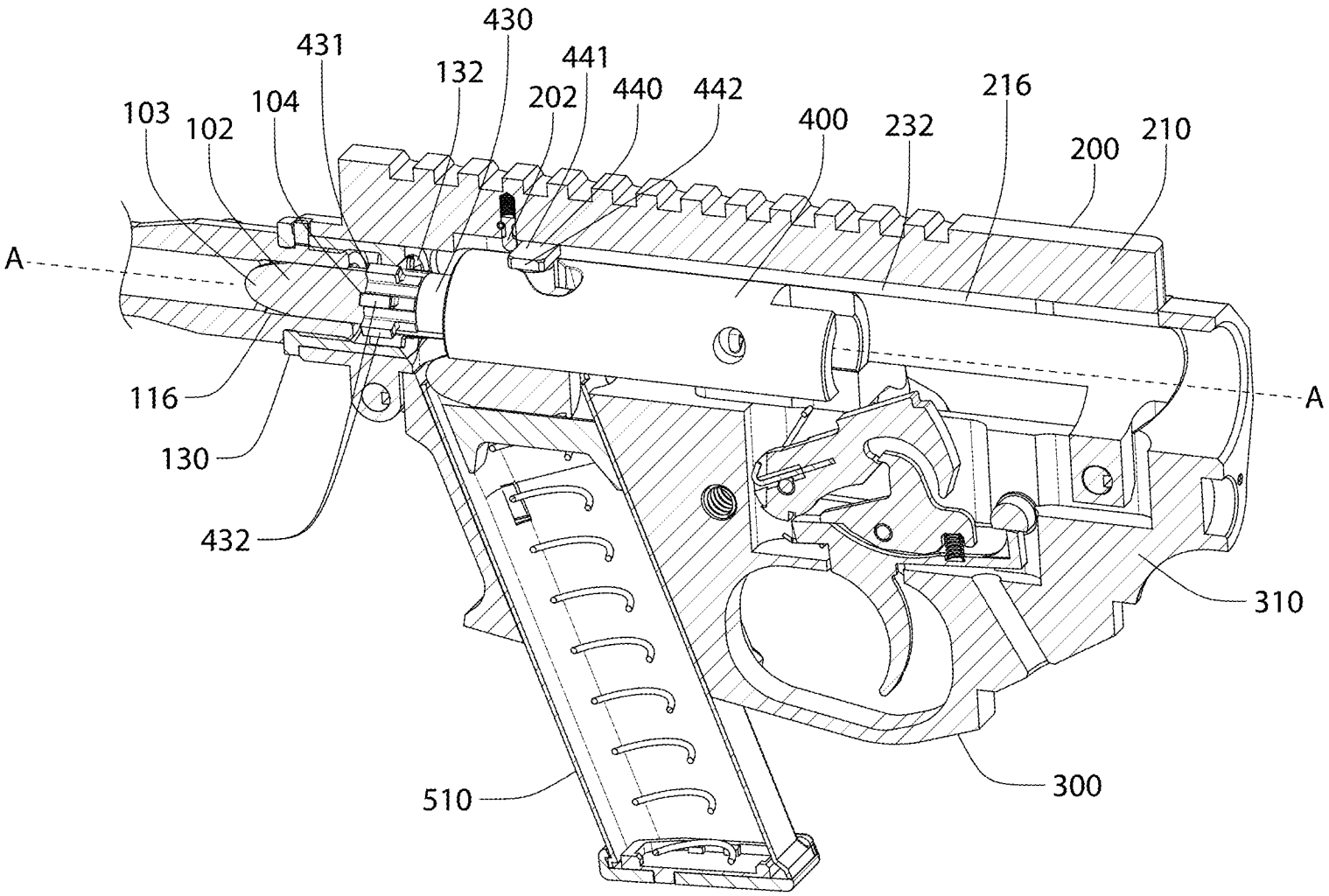
FIG. 15B is another cutaway view showing the firearm in the third state.

FIGS. 15A and 15B illustrate the firearm 1000 in a third state, where the bolt carrier assembly 400 is further advanced along the longitudinal axis A-A such that the cartridge 102 is within the chamber 116 but not fully seated. A rear portion 104 of the cartridge 102 is received within a recess 431 of the bolt 430, and lugs 432 of the bolt 430 are passing through slots 132 of the barrel extension 130. The detent 202 engages the head 441 of the follower element 440, the detent 202 optionally omitted if desired. The first and second surfaces 442, 443 are constrained by the first and second surfaces 231, 232 of the cam portion 216 of the passageway 212. The hammer 384 remains in the cocked position, retained by the disconnector 388 and the trigger 382. The bolt carrier 410 remains constrained from rotation about the longitudinal axis A-A by the first and second guide surfaces 222, 322. The firearm 1000 remains in an out of battery condition in the third state.

Figure 16A:
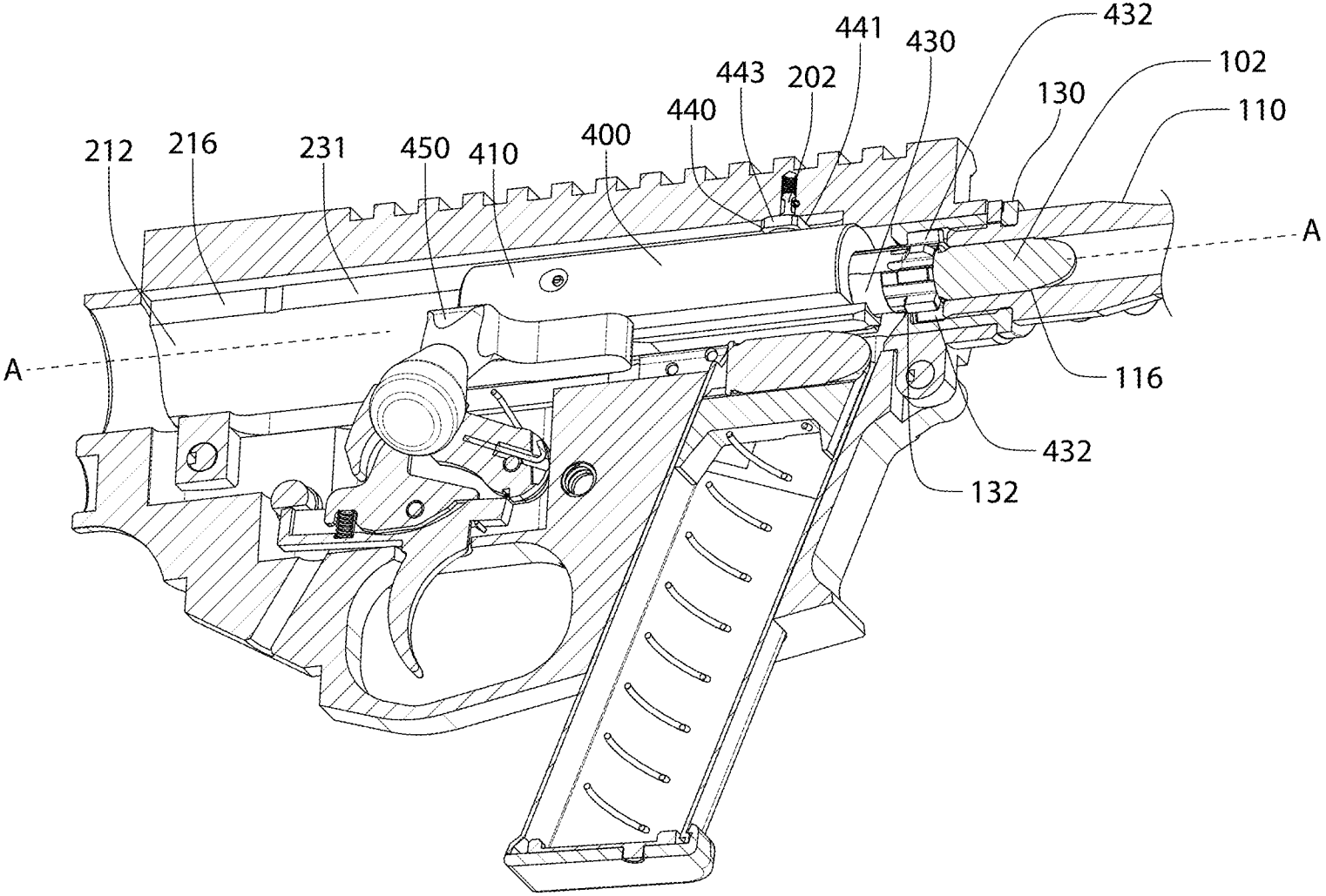
FIG. 16A is a cutaway view showing the firearm in a fourth state.
Figure 16B:
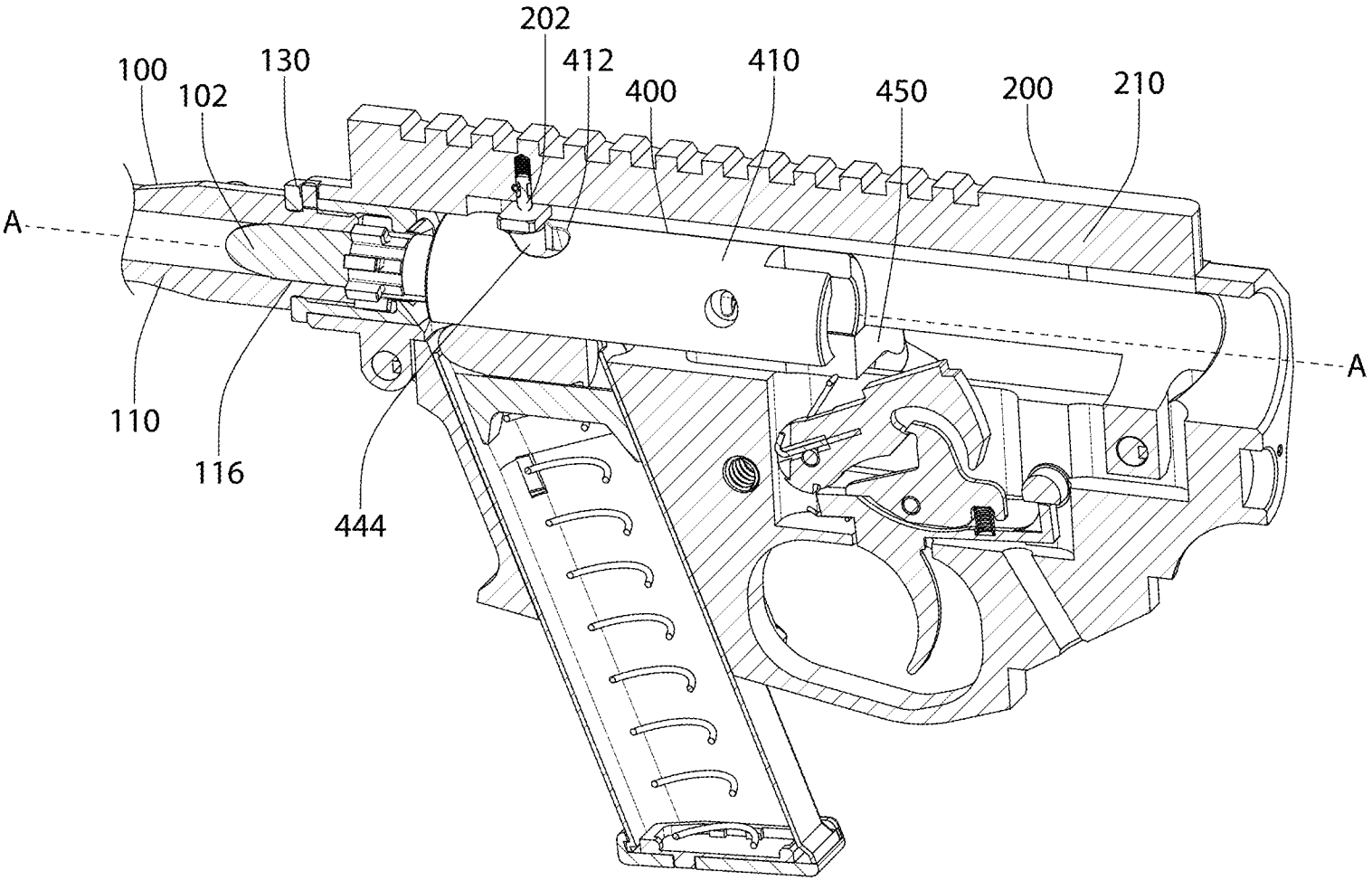
FIG. 16B is another cutaway view showing the firearm in the fourth state.

FIGS. 16A and 16B illustrate the firearm 1000 in a fourth state, where the bolt carrier assembly 400 is further advanced along the longitudinal axis A-A. The bolt 430 of the bolt carrier assembly 400 is moved fully forward, seating the cartridge 102 within the chamber 116. However, the bolt 430 has not been rotated by the follower element 440. The lugs 432 of the bolt 430 have completely passed through the slots 132 of the bolt carrier, but remain aligned with the slots 132. The head 441 of the follower element 440 is positioned within the cam portion 216 of the passageway 212 but the first and second surfaces 231, 232 of the cam portion 216 no longer engage the first and second surfaces 442, 443 of the head 441 of the follower element 440. Instead, the head 441 is located within the clearance recess 233 of the cam portion 216, allowing the follower element 440 to rotate with respect to the longitudinal axis A-A while the bolt carrier remains constrained from rotation by the first and second guide surfaces 222, 322 engaging the operating component 450. The detent 202 engages the head 441 of the follower element 440 as a result of the advancement. The firearm 1000 remains in an out of battery condition in the fourth state.

Figure 17A:
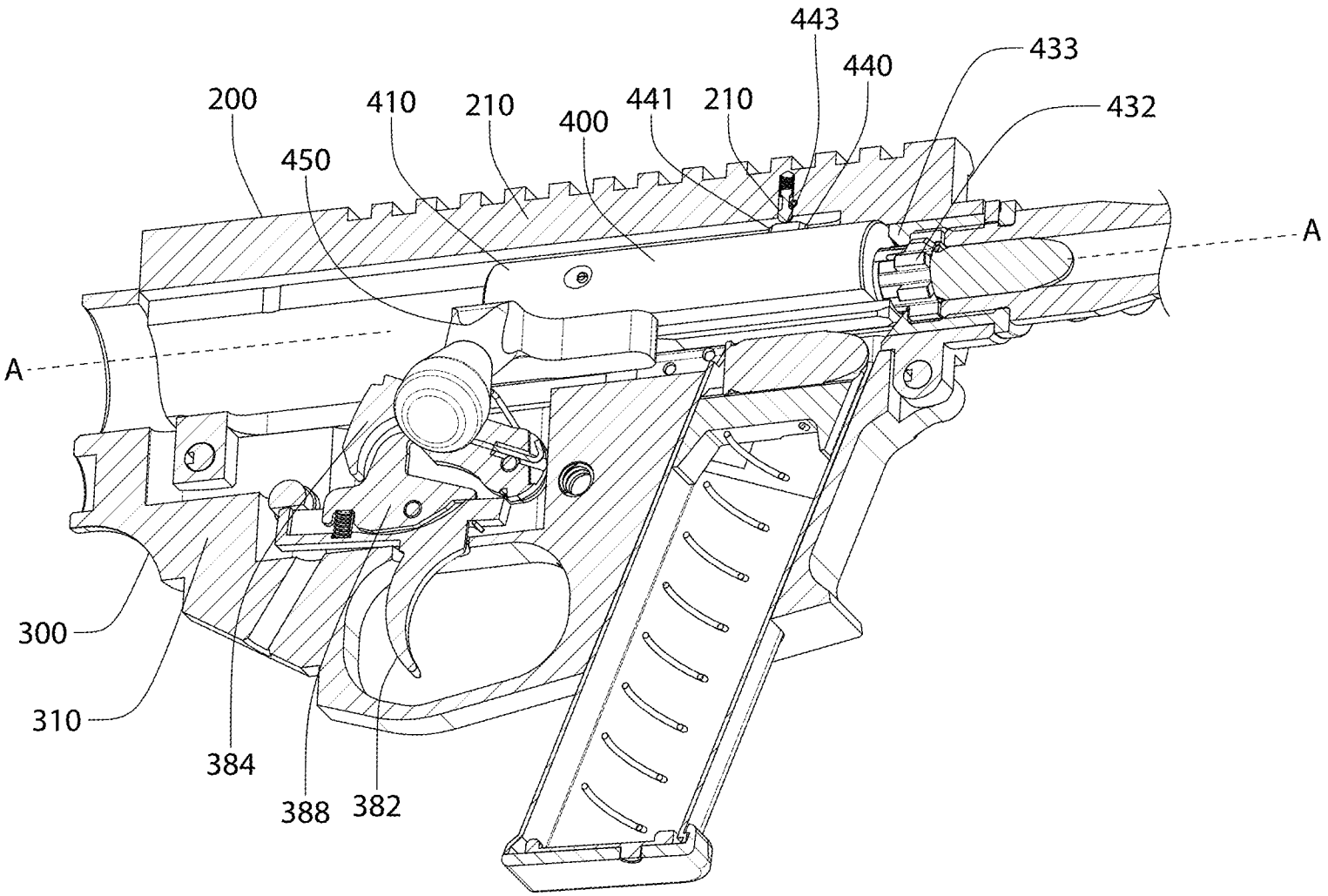
FIG. 17A is a cutaway view showing the firearm in a fifth state.
Figure 17B:
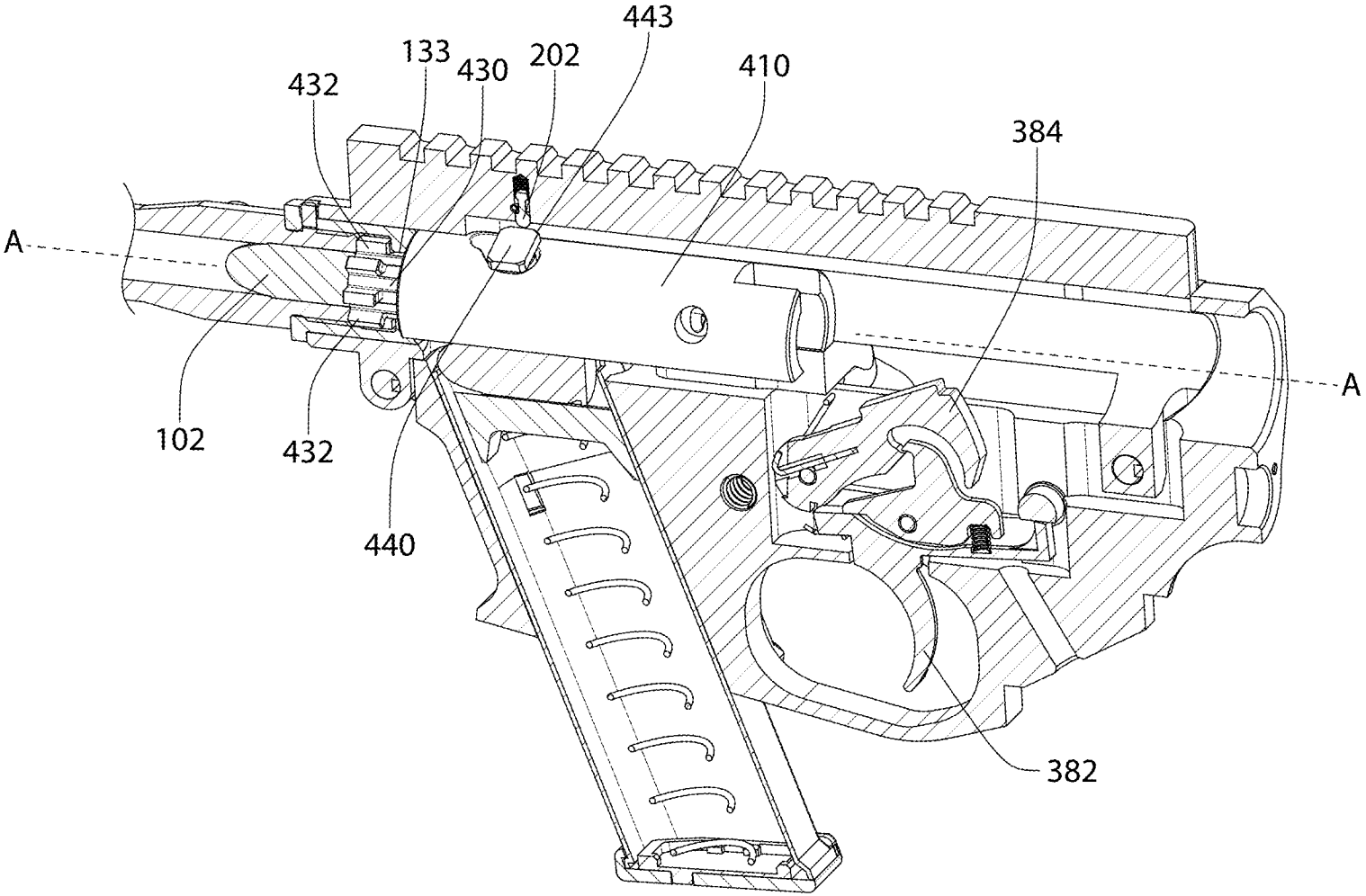
FIG. 17B is another cutaway view showing the firearm in the fifth state.
Figure 18:
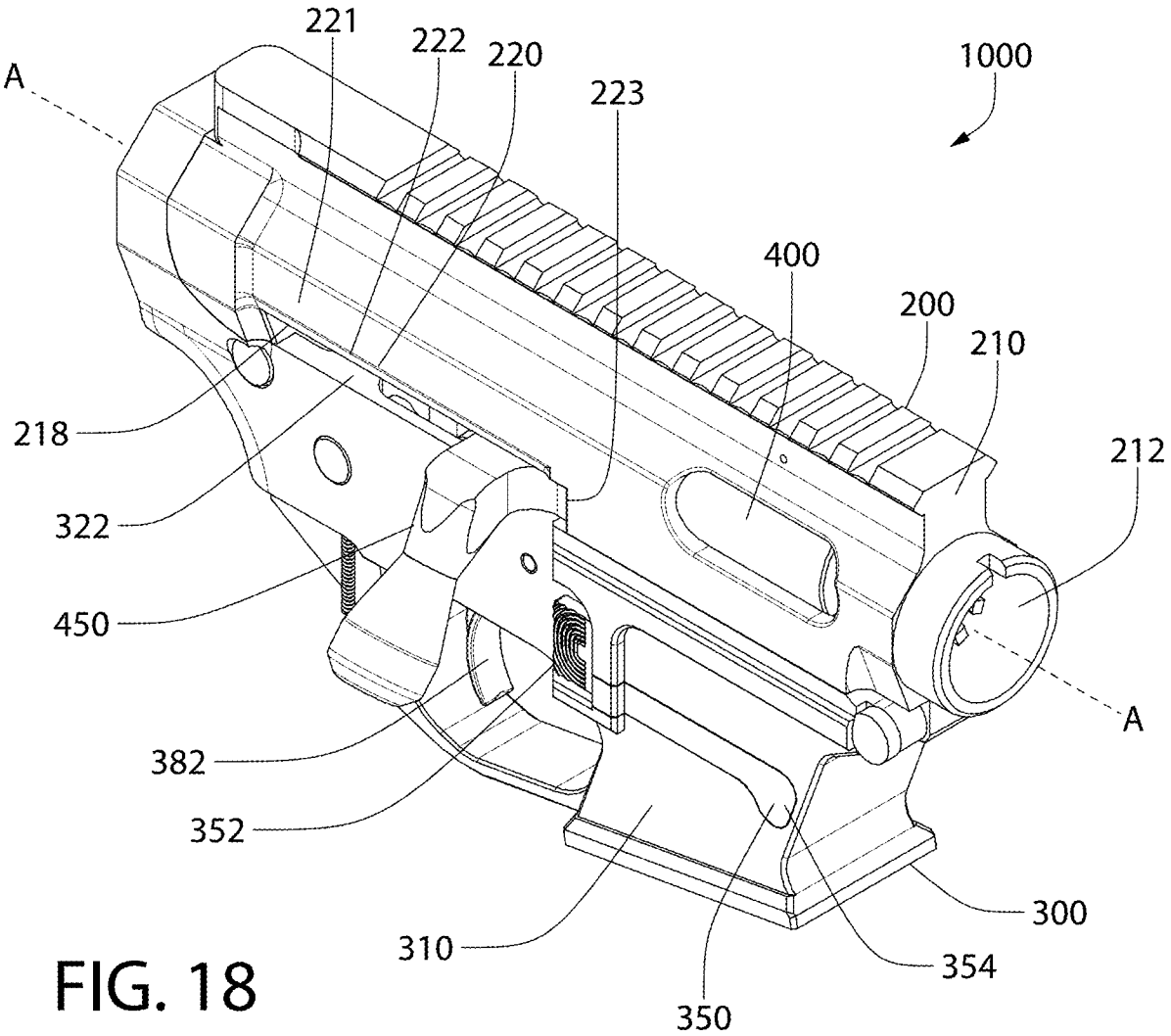
FIG. 18 is a top right perspective view of a portion of the firearm.
Figure 19:
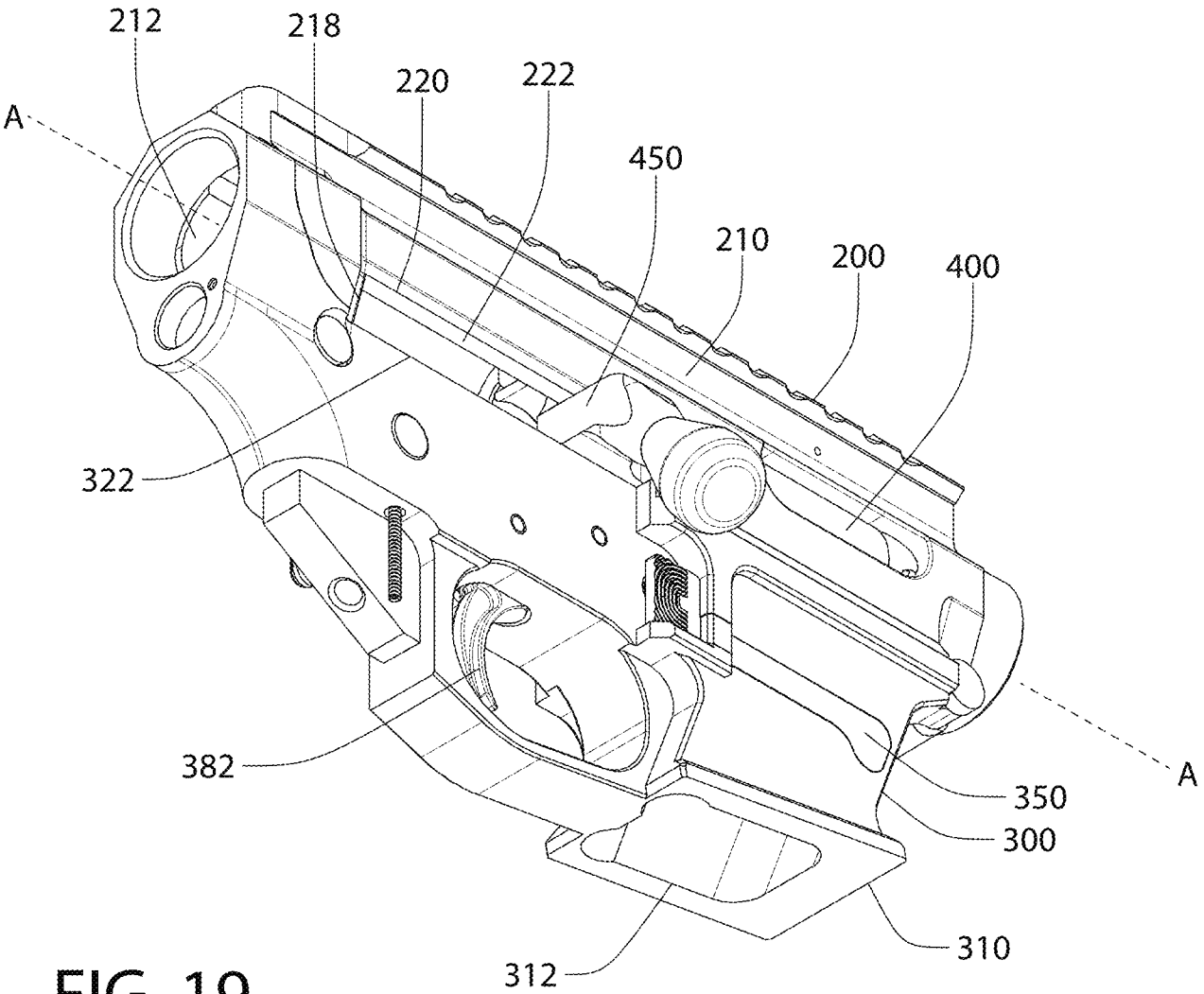
FIG. 19 is a bottom left perspective view of the portion of the firearm.
Figure 20:
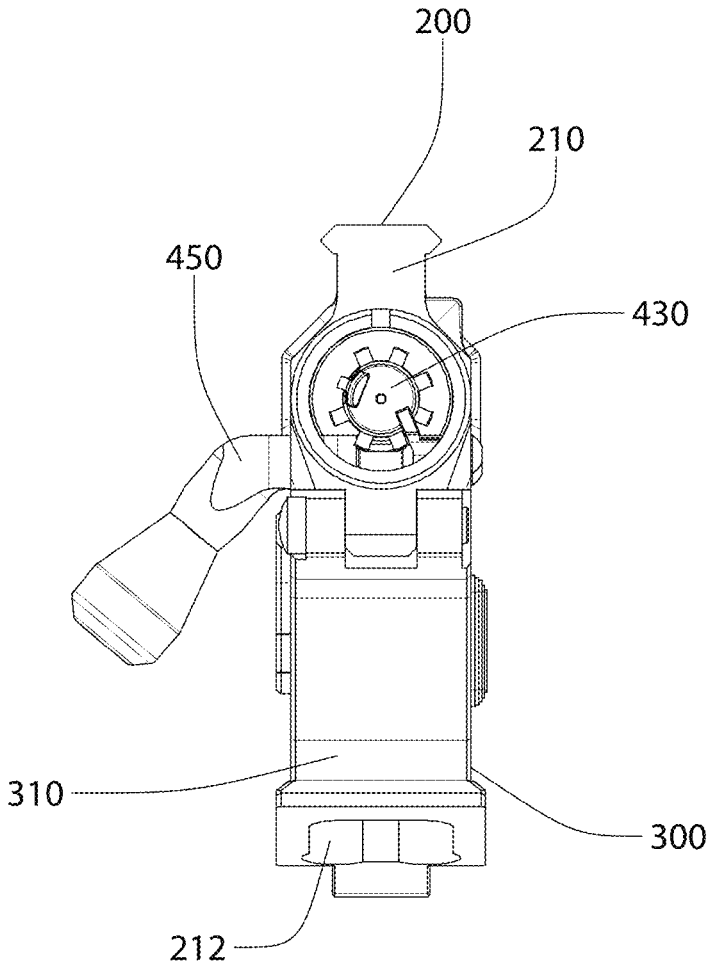
FIG. 20 is a front view of the portion of the firearm.
Figure 21:
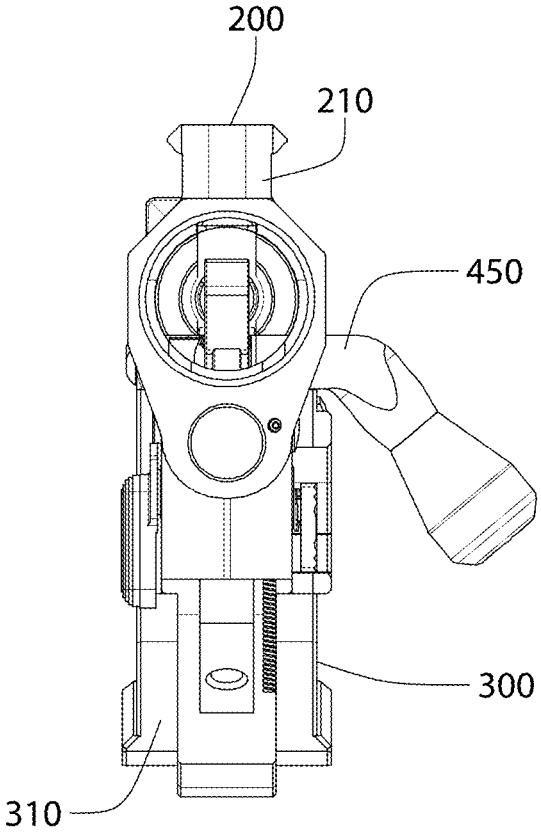
FIG. 21 is a rear view of the portion of the firearm.

FIGS. 17A and 17B illustrate the firearm 1000 in a fifth state, where the bolt 430 is rotated with respect to the longitudinal axis A-A without advancing along the longitudinal axis A-A, placing the firearm 1000 in the battery condition and ready for firing. The lugs 432 of the bolt 430 engage corresponding lugs 133 of the barrel extension 130, the bolt 430 having been rotated as a result of the follower surface 444 of the follower element 440 sliding along the cam feature 412 of the bolt carrier 410 as the bolt carrier 410 is moved to a closed position. In the closed position, the bolt carrier 410 rests against the barrel extension 130 and the bolt 430 is rotated such that the follower element 440 is no longer in a vertical orientation. Instead, the head 441 is within the clearance recess 233 of the cam portion 216 of the passageway 212, the clearance recess 233 configured to provide space for the head 441 of the follower element 440 to rotate without any part of the upper receiver 210 contacting the follower element 440. In the closed position, the firearm 1000 may be fired by actuating the trigger 382 to release the hammer 384, causing a firing pin to strike the cartridge 102 and ignite the cartridge 102.

The bolt carrier 410 remains constrained by the first and second guide surfaces 222, 322 engaging the operating component 450 as the bolt carrier 410 transitions to the closed position and the firearm 1000 is placed in the fifth state. The detent 202 engages the second surface 443 of the head 441 of the follower element 440 in the fifth state, providing a biasing force to the follower element 440 to retain the bolt 430 and the rest of the bolt carrier assembly 400 in the closed position.

Turning to FIGS. 18-27, a portion of the firearm 1000 is illustrated. The portion of the firearm 1000 omits the stock 520, barrel assembly 100, and some other components for the sake of clarity. The upper receiver assembly 200, a portion of the lower receiver assembly 300, and the bolt carrier assembly are illustrated. In particular, the upper receiver 210 has the slot 210 formed from the passageway 212 to an outer surface 221. The slot 210, in combination with the lower receiver 310, defines a closed contour. Thus, the stop surface 218, the first guide surface 222 of the upper receiver 210, the second guide surface 322 of the lower receiver 310, and a front portion 223 of the slot 220 define the contour.

The slot 220 is sized to ensure that the first and second guide surfaces 222, 322 constrain the operating component 450 to prevent rotation of the bolt carrier assembly 400 about the longitudinal axis A-A. When the bolt carrier assembly 400 is transitioned from the first state where the bolt carrier assembly 400 is fully rearward and the operating component 450 engages the stop surface 218 to the fifth state where the bolt 430 is closed on a chambered cartridge 102, the operating component 450 remains constrained by the first and second guide surfaces 222, 322.

The magazine well 312 of the lower receiver 310 may be sized to accept a variety of magazines 510, including both different cartridge types and different manufacturer's magazines. Thus, the magazine well 312 may be adapted in any desired manner to accept different cartridges. It is contemplated that the firearm 1000 may have magazine wells 312 suitable for use with a wide variety of manufacturer's magazines in a wide range of cartridge types. Thus, the exact geometry of the magazine well 312 may vary in specific models of the firearm 1000.

The magazine catch 350 may include an actuation portion 352 and a retention portion 354, the actuation portion 352 positioned proximate the trigger 382 to permit rapid actuation by a user's finger. The actuation portion 352 may include texturing or other features which facilitate the user's grip. In addition, the spring 303 is preferably selected to achieve secure retention of the magazine 510 without undue force requirements at the actuation portion 352. It is contemplated that the spring 303 may be housed within the lower receiver 310 as illustrated in previous figures, with the spring 303 behind the actuation portion 352 to apply force against the actuation portion 352. The magazine catch 350 may hinge about a pivot pin as will be discussed in greater detail below. The pivoting of the magazine catch 350 allows the retention portion 354 to come into and out of contact with the magazine 510, allowing retention features on the magazine 510 to be selectively engaged with the retention portion 354.

Figure 22:
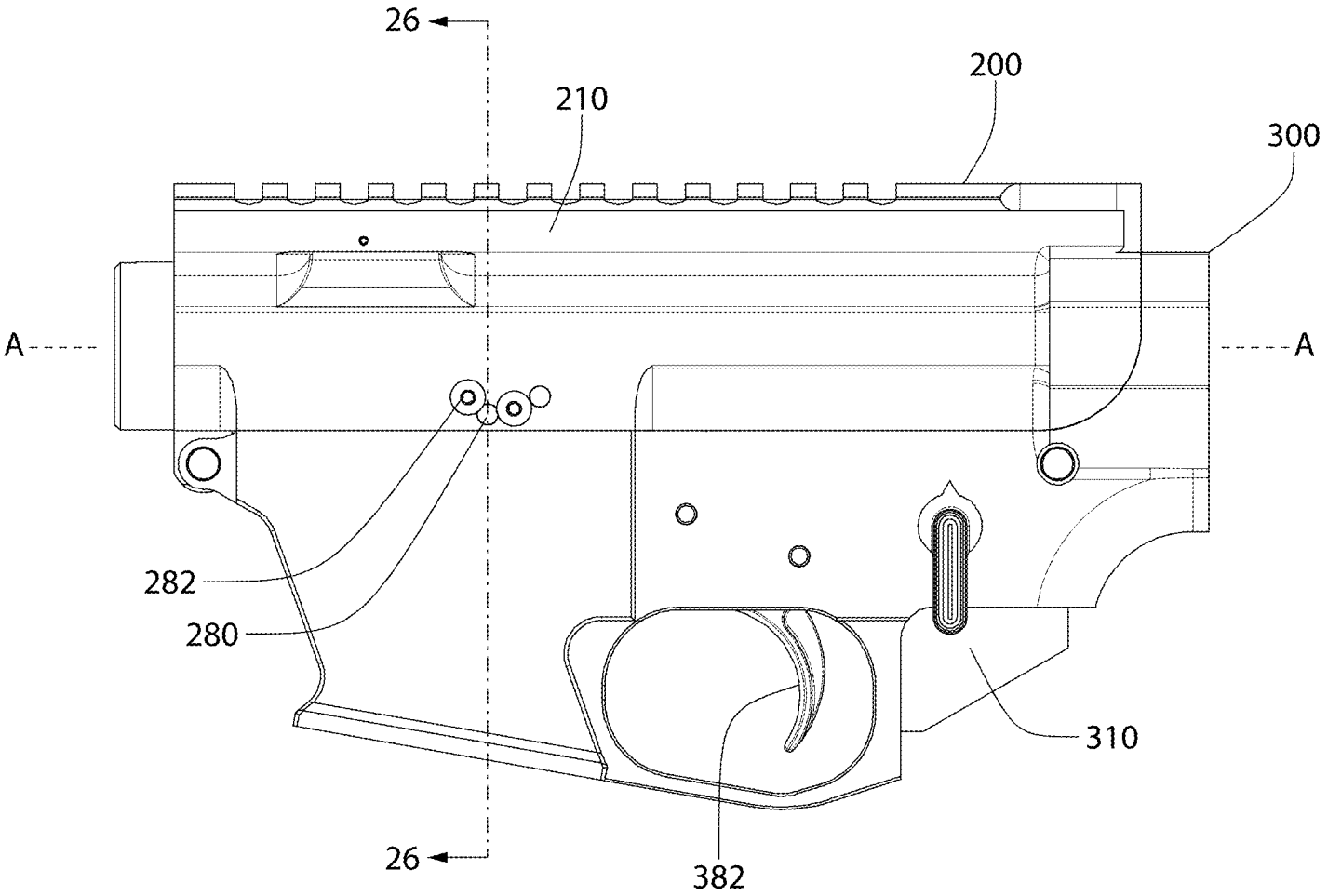
FIG. 22 is a left view of the portion of the firearm.
Figure 23:
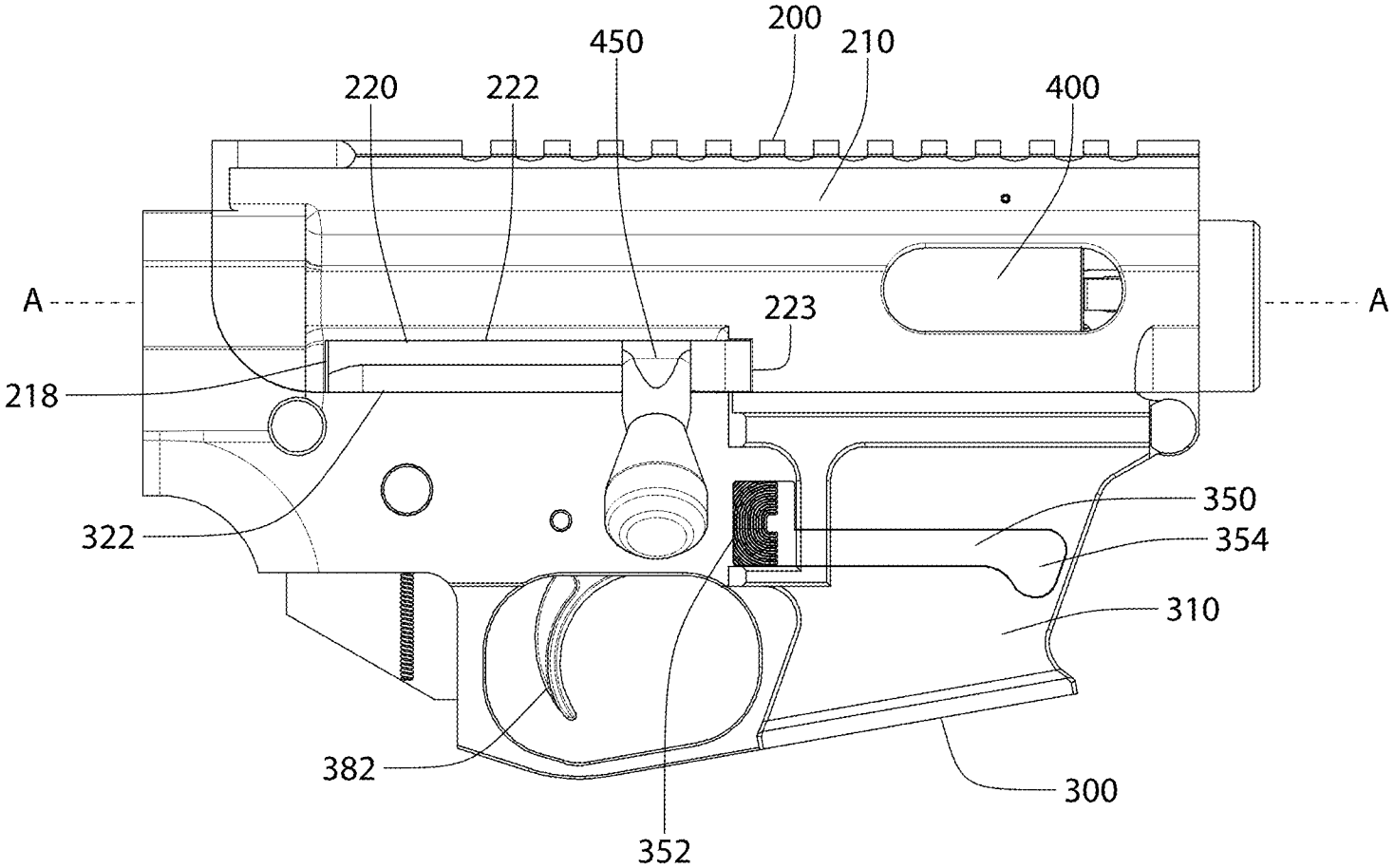
FIG. 23 is a right view of the portion of the firearm.
Figure 24:
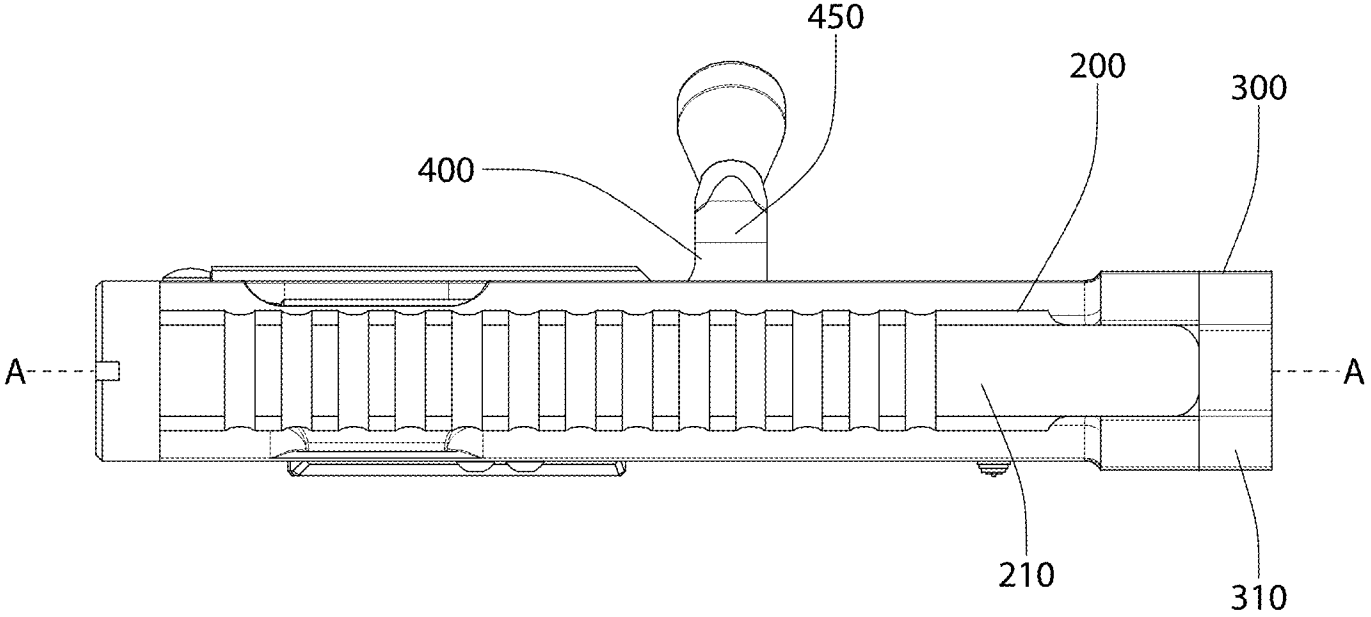
FIG. 24 is a top view of the portion of the firearm.
Figure 25:
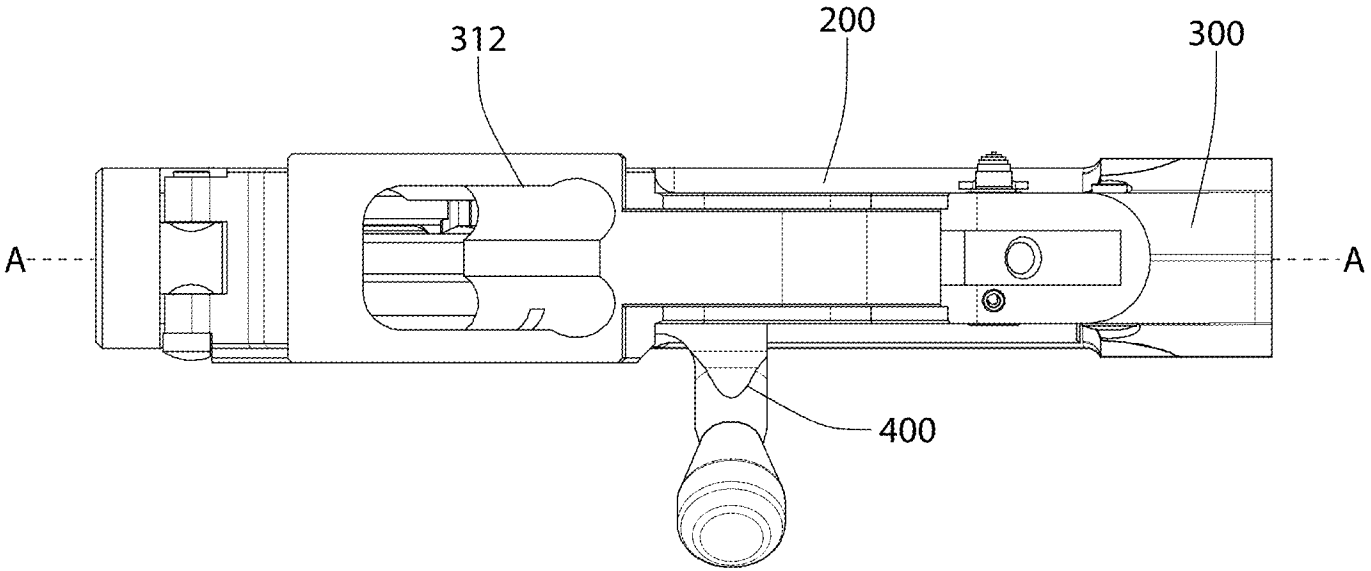
FIG. 25 is a bottom view of the portion of the firearm.
Figure 26:
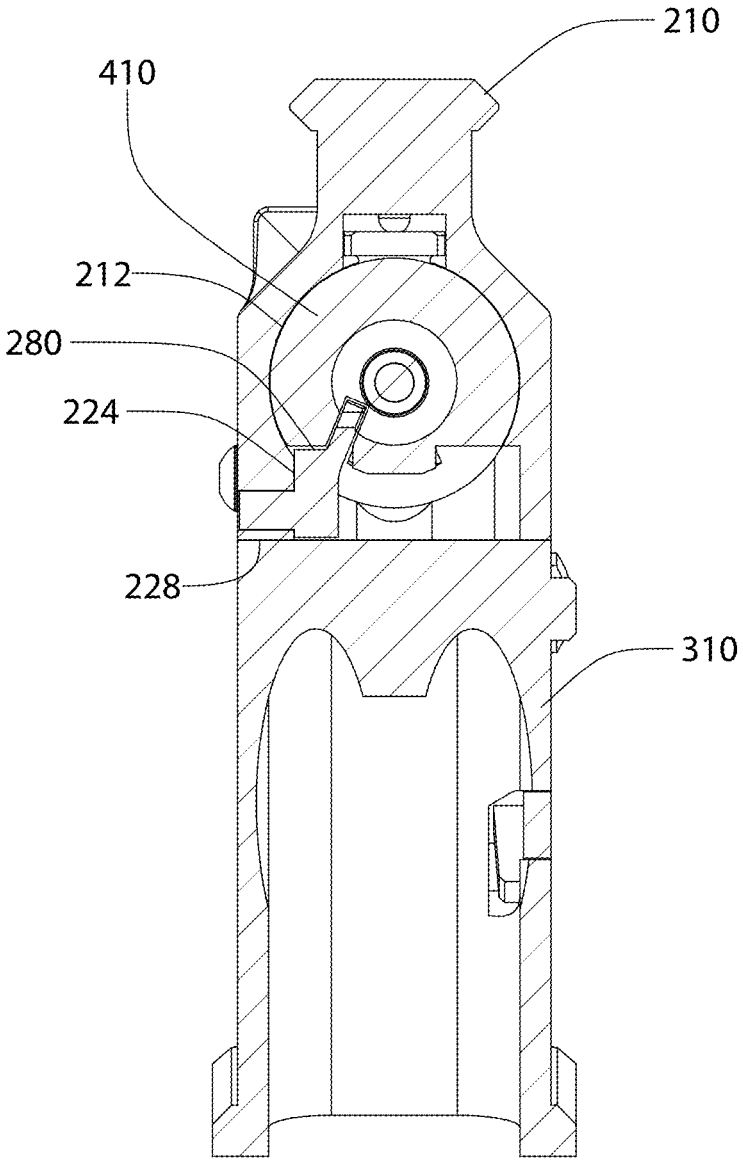
FIG. 26 is a cross-section view of the portion of the firearm taken along line 26-26 of FIG. 22.
Figure 27:
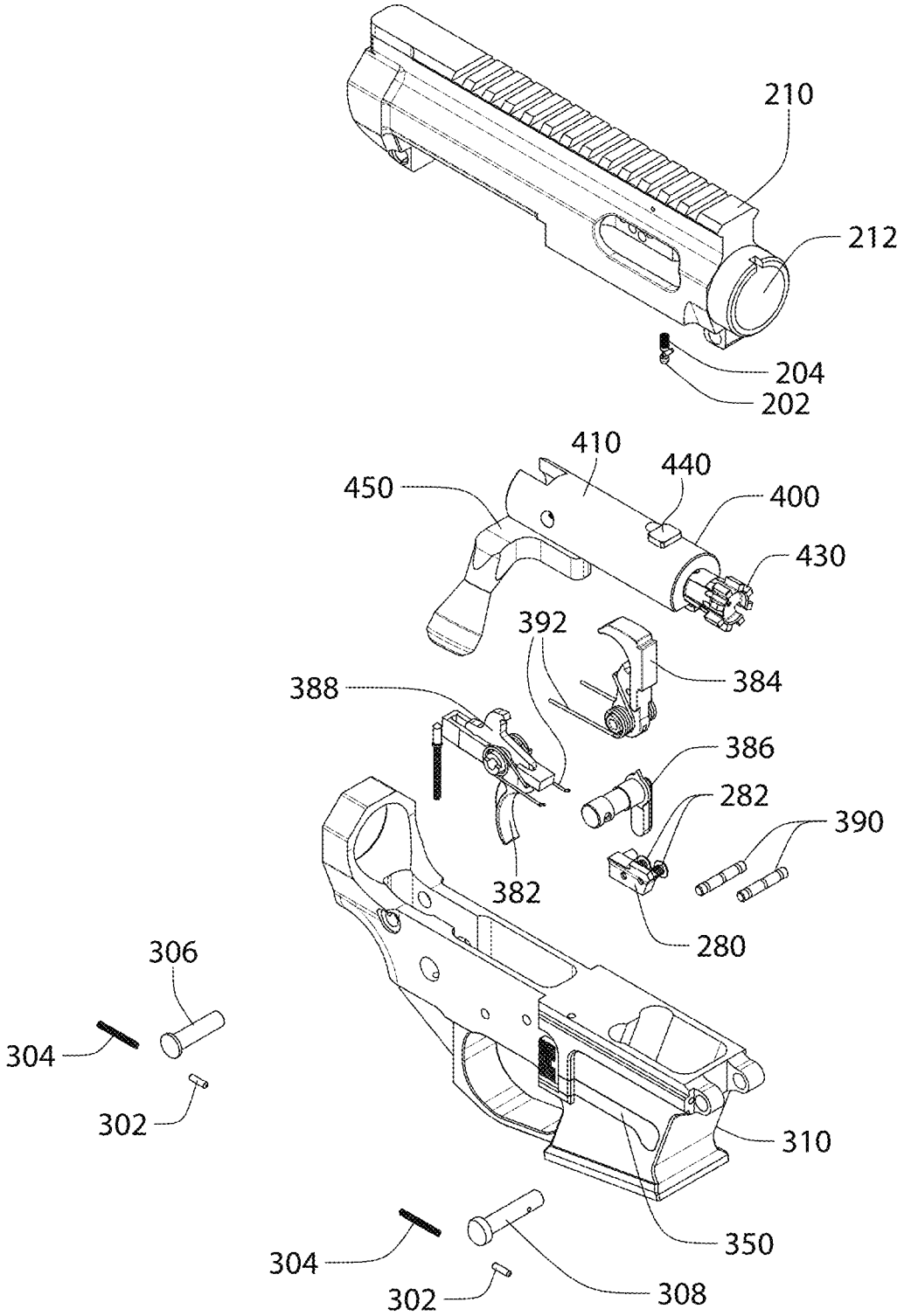
FIG. 27 is an exploded view of the portion of the firearm.
Figure 28:
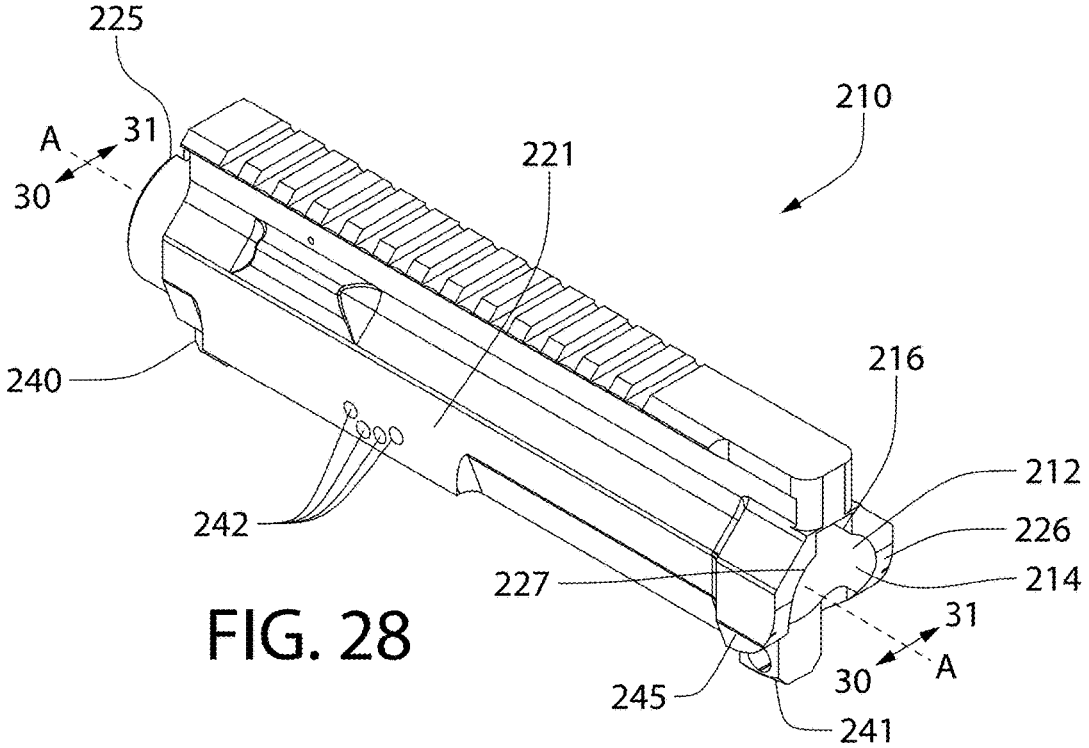
FIG. 28 is a top right perspective view of an upper receiver of the firearm.
Figure 29:
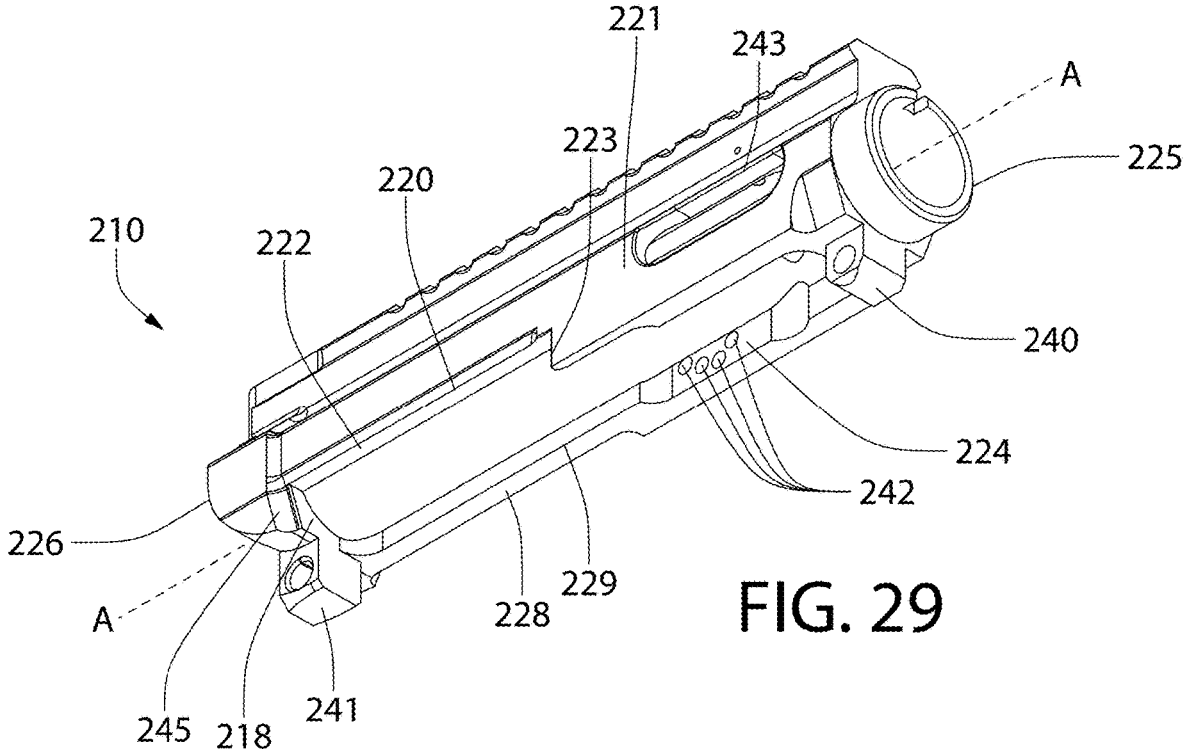
FIG. 29 is a bottom left perspective view of the upper receiver.
Figure 30:
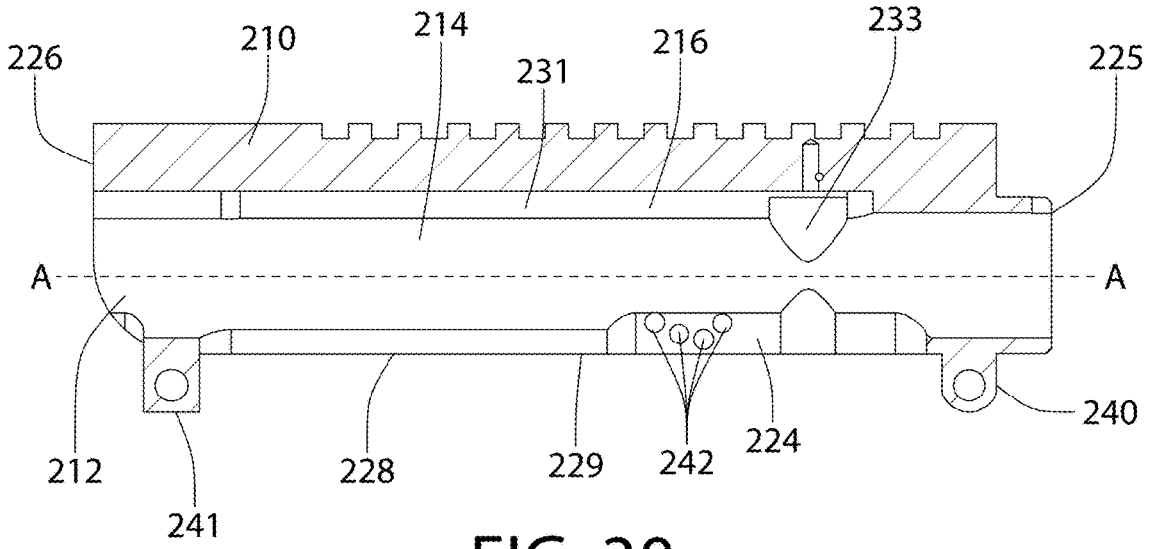
FIG. 30 is a cross-section view of the upper receiver taken along line 30-30 of FIG. 28.
Figure 31:
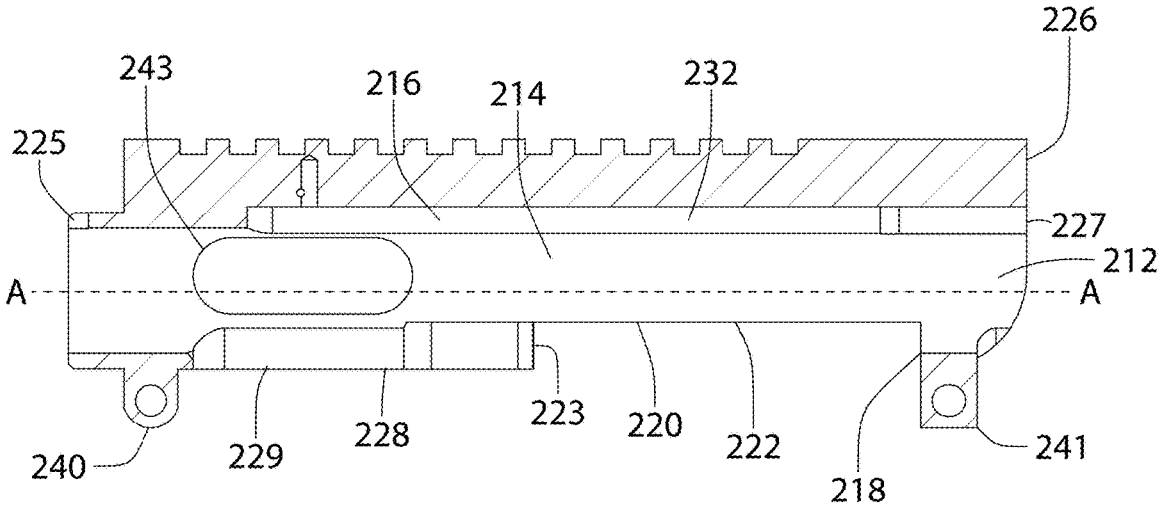
FIG. 31 is a cross-section view of the upper receiver taken along line 31-31 of FIG. 28.

As best seen in FIGS. 22 and 26, the ejector 280 is coupled to the upper receiver 210. The ejector 280 is secured to the upper receiver 210 by the fasteners 282 as noted above. The ejector 280 serves to eject spent cartridge cases from the cartridges 102 subsequent to firing. The ejector 280 is fixed to the upper receiver 210, ejecting the spent cartridges 102 when the bolt carrier assembly 400 is moved past the ejector 280.

The ejector 280 extends through a slot in the bolt 430 and a corresponding slot in the bolt carrier 410. The slots align when the bolt carrier assembly 400 is not in the closed position and the firearm 1000 is not in the fifth state in a battery condition. Thus, the ejector 280 is free to pass through the bolt 430 from the bolt carrier 410 as the bolt carrier assembly 400 is retracted from the closed position to the fully retracted position and the firearm 1000 is moved from the fifth state to the first state.

The ejector 280 is mounted to a lateral surface 224 of the upper receiver 210, the lateral surface 224 extending from the passageway 212 to a lower surface 228 of the upper receiver 210. The fasteners 282 extend through the upper receiver 210 from the outer surface 221 and into the ejector 280, securing the ejector 280 to the upper receiver 210. The ejector 280 is preferably positioned such that it is spaced and isolated from the lower receiver 310.

Turning to FIGS. 28-31, the upper receiver 210 is illustrated in greater detail. As discussed above, the passageway 212 of the upper receiver 210 extends along the longitudinal axis A-A. The passageway 212 extends from a front surface 225 to a rear surface 226. The main portion 214 extends the entirety of the way from the front surface 225 to the rear surface 226 while the cam portion 216 extends from the rear surface 226 to the clearance recess 233. A rear aperture 227 is formed into the rear surface 226, the rear aperture 227 defining the opening of the passageway 212 on the rear surface 226. The main portion 214 and the cam portion 216 extend through the rear aperture 227. The rear aperture 227 forms or defines a closed contour.

The upper receiver 210 also has a lower surface 228, the lower surface 228 in surface contact with the lower receiver 310 when the lower receiver 210 is coupled to the lower receiver 310. The lower surface 228 has a lower opening 229 extending from the lower surface 228 to the main portion 214 of the passageway 212. The lower opening 229 and the slot 220 collectively define a closed contour. The lower opening 229 is configured to allow passage of a portion of the magazine 510, the hammer 384, and cartridges 102 from the magazine 510 to the barrel assembly 100. The lower opening 229 is sized so that the bolt carrier 410 does not pass through the lower opening 229. Thus, the bolt carrier 410 must pass through the rear aperture 227 to be inserted into the upper receiver 210. The lower opening 229 and the slot 220 collectively form or define a closed contour.

The upper receiver 210 further incorporates front and rear takedown lugs 240, 241, the front and rear takedown lugs 240, 241 extending from the lower surface 228 of the upper receiver 210. Proximate the front and rear takedown lugs 240, 241, the lower opening 229 terminates, with the passageway 212 having a closed profile when viewed perpendicular to the longitudinal axis A-A. Otherwise stated, the passageway 212 is completely enclosed at the front takedown lug 240 and is completely enclosed at the rear takedown lug 241. Proximate the rear takedown lug 241, the upper receiver 210 has a rear hoop 245. The rear hoop 245 completely encircles the passageway 212 and incorporates the stop surface 218. Thus, no component can pass through the passageway 212 unless that component fits within the passageway 212. Thus, the operating component 450, when coupled to the bolt carrier 410, cannot pass through the rear aperture 227. Instead, the operating component 450 must be assembled to the bolt carrier 410 subsequent to the installation of the bolt carrier 410 within the passageway 212. The method of assembly will be described in greater detail below.

Formed into the lateral surface 224 are a plurality of holes 242. One or more of the holes 242 are sized to accept the fasteners 282, while other ones of the holes 242 may be sized to accept features of the ejector 280 to facilitate positioning and constraint of the ejector 280 with respect to the upper receiver 210. In addition, an ejection port 243 extends from the passageway 212 to the outer surface 221, the ejection port 243 sized and located to permit ejection of spent cases of cartridges 102.

Figure 32:
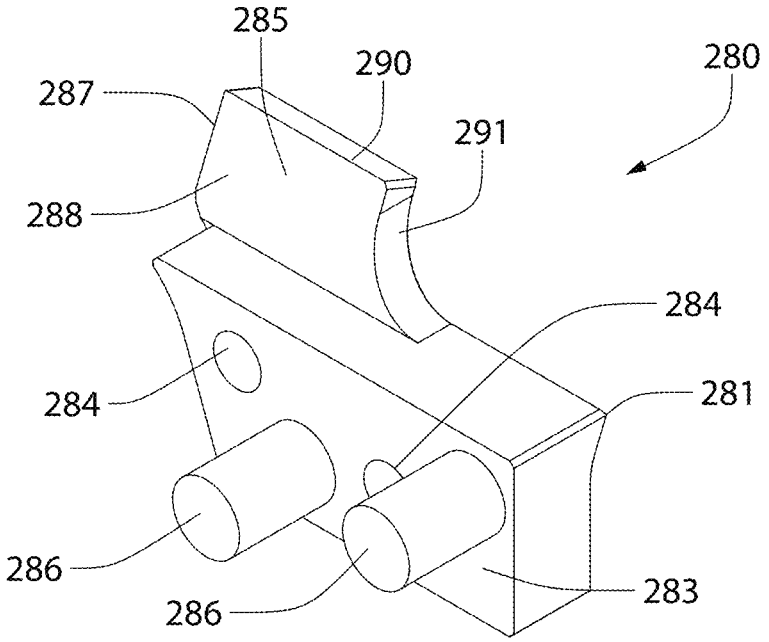
FIG. 32 is a top right perspective view of an ejector of the firearm.
Figure 33:
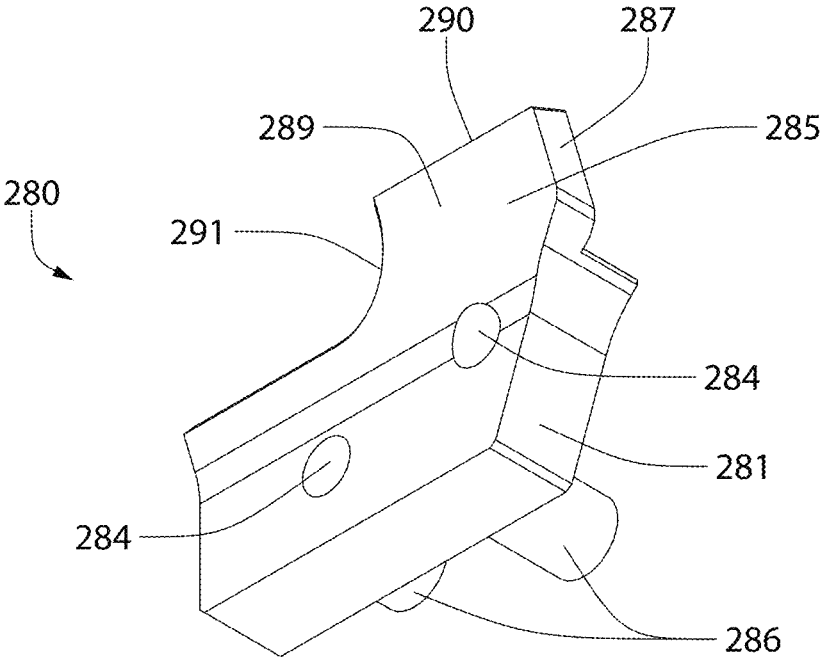
FIG. 33 is a bottom left perspective view of the ejector.
Figure 34:
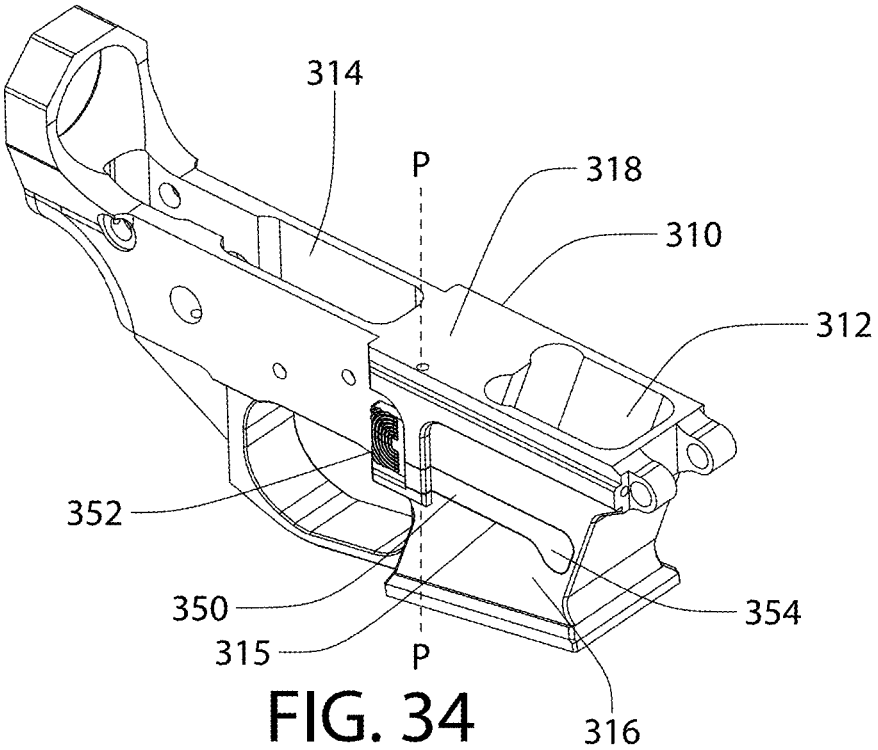
FIG. 34 is a top right perspective view of a portion of the lower receiver assembly of the firearm.
Figure 35:
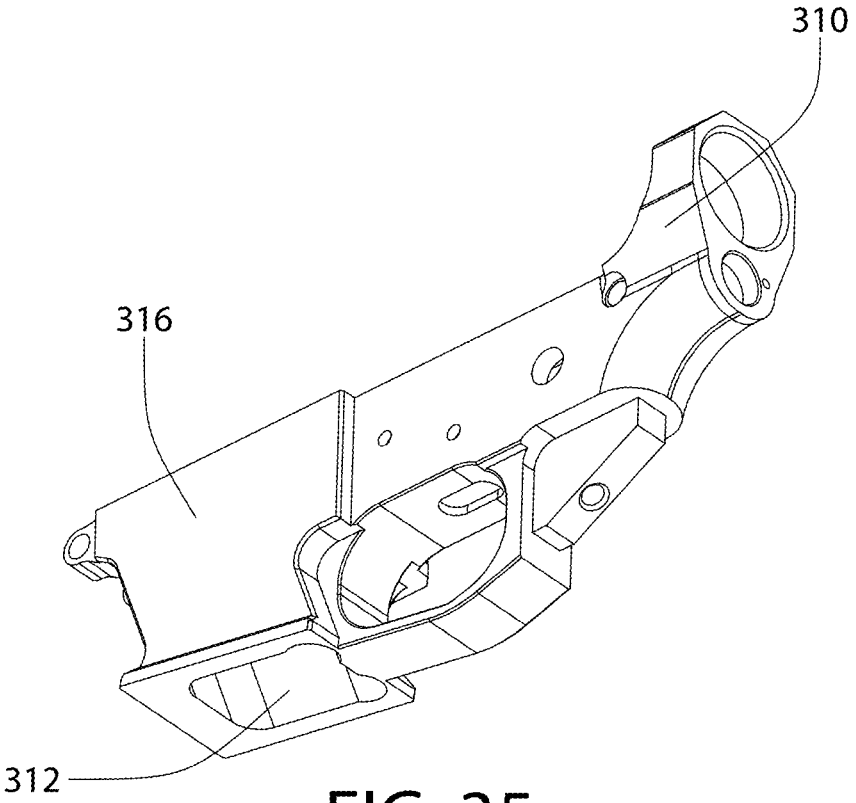
FIG. 35 is a bottom left perspective view of the portion of the lower receiver assembly.
Figure 36:
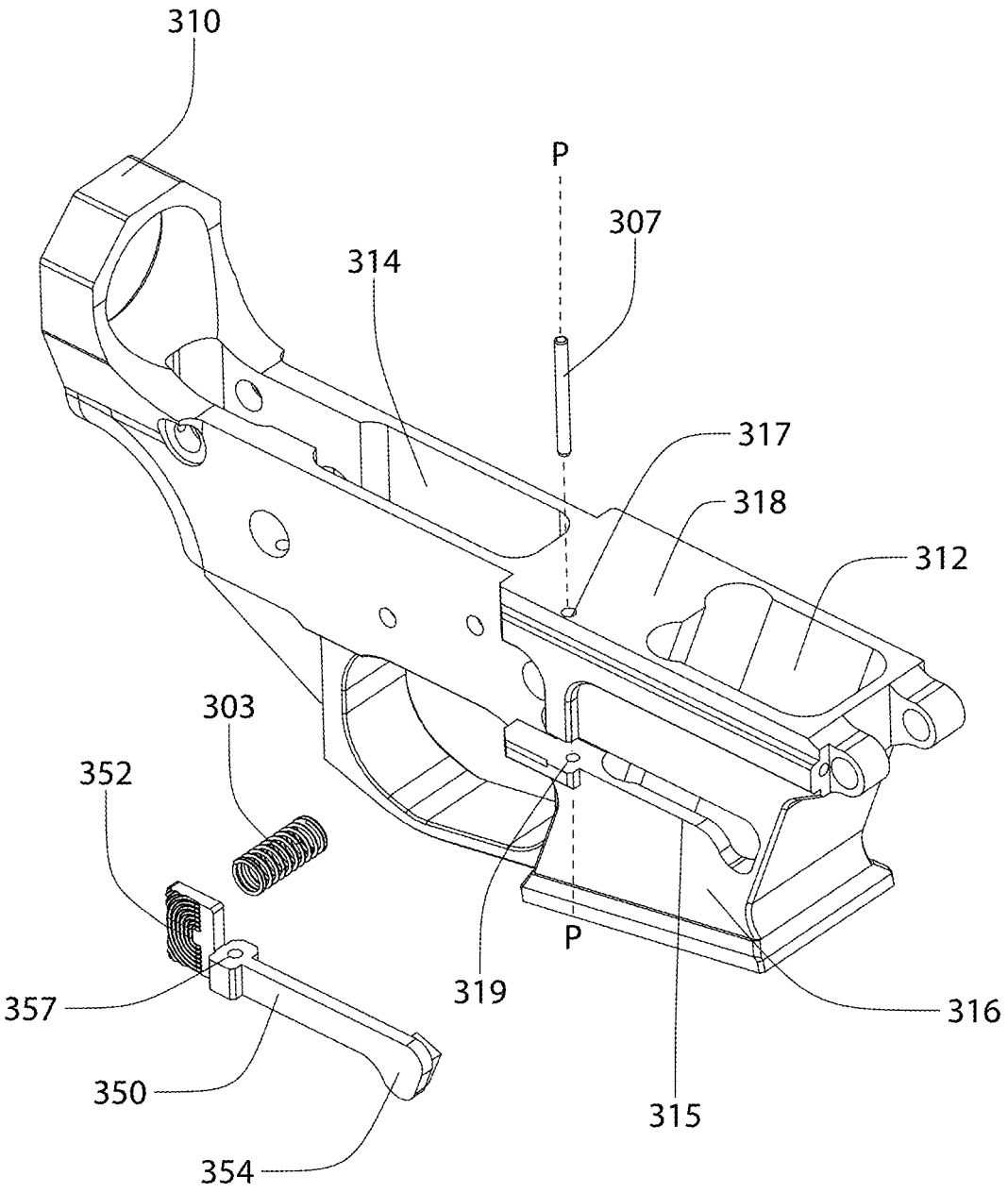
FIG. 36 is an exploded view of the portion of the lower receiver assembly.
Figure 37:
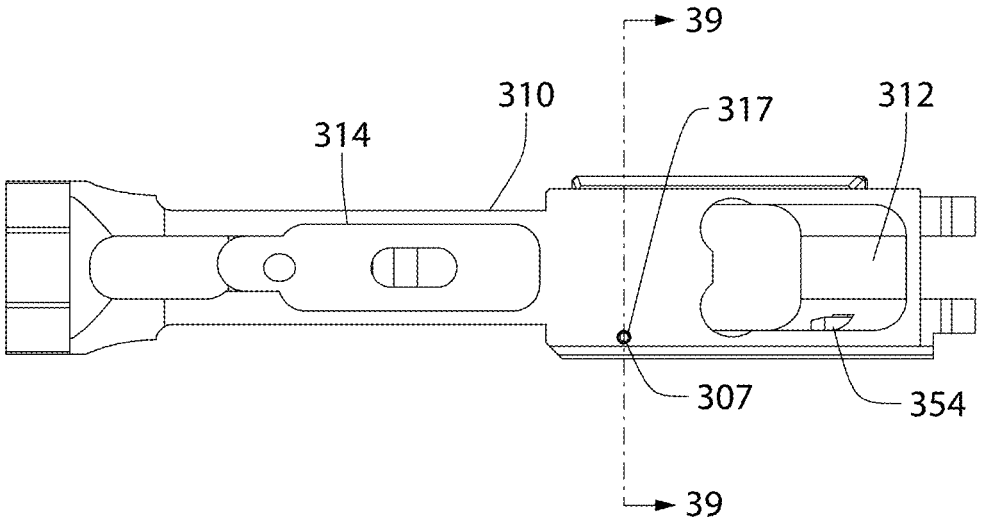
FIG. 37 is a top view of the portion of the lower receiver assembly.
Figure 38:
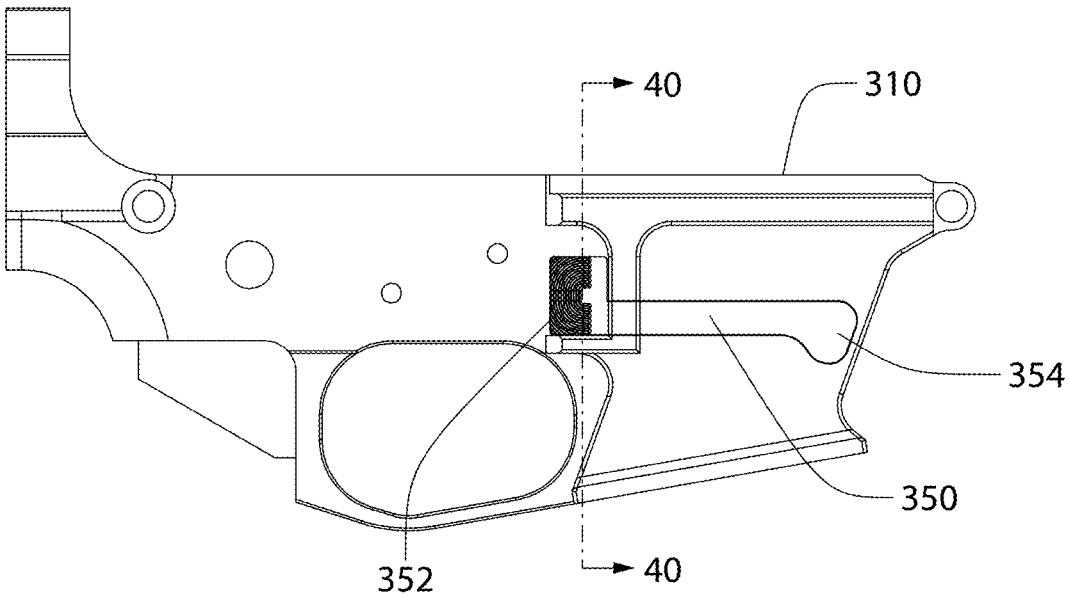
FIG. 38 is a right side view of the portion of the lower receiver assembly.
Figure 39:
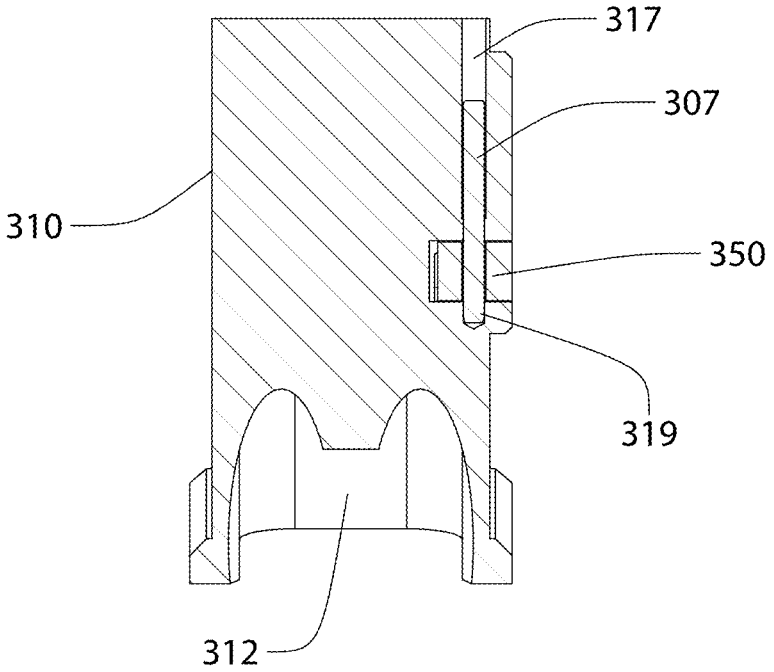
FIG. 39 is a cross-section of the portion of the lower receiver assembly taken along line 39-39 of FIG. 37.
Figure 40:
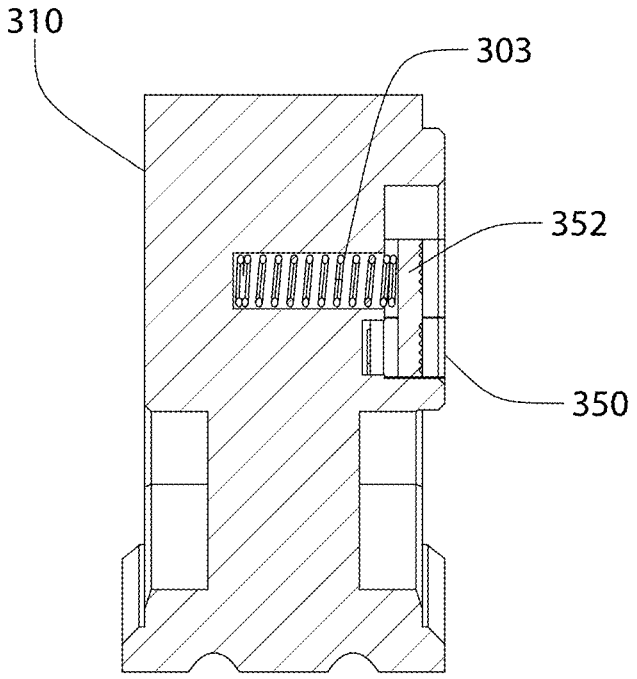
FIG. 40 is another cross-section of the portion of the lower receiver assembly taken along line 40-40 of FIG. 38.

Turning to FIGS. 32 and 33, the ejector 280 is illustrated in greater detail. The ejector 280 has a base portion 281 and an ejection portion 285. The base portion 281 has a mounting surface 283 which is configured to be coupled to the lateral surface 224 of the upper receiver. The mounting surface 283 further includes holes 284 which may be threaded or plain holes and are configured to receive the fasteners 282. The holes 284 may extend through the base portion 281 or may be blind holes that do not extend through the base portion 281.

The mounting surface 283 also has protuberances 286 which extend from the mounting surface 283, the protuberances 286 being cylindrical pins, diamond shaped pins, or any other feature which allows the ejector 280 to be constrained with respect to the upper receiver 210. The protuberances 286 may be integrally formed with the ejector 280 or may be pressed, welded, or otherwise assembled with the ejector 280 as desired. Preferably, the protuberances and the rest of the ejector 280 are formed as a single integrally formed, monolithic component rather than being formed separately and joined together. The protuberances 286 are sized to provide a close fit with corresponding ones of the holes 242 provided in the upper receiver 210.

The mounting surface 283 need not be planar and may be any shape that corresponds with the lateral surface 224 of the upper receiver. For instance, the lateral surface 224 and the mounting surface 283 may be a corresponding combination of convex and concave surfaces, or may incorporate ribs, grooves, or other features which aid in positioning of the ejector 280. Furthermore, the base portion 281 may be sized to ensure that it does not interfere with the bolt carrier 410 during operation of the firearm 1000. The base portion 281 may extend into the passageway 212 but will be sized and positioned such that the ejector 280 does not interfere with the bolt carrier assembly 400.

The ejection portion 285 extends from the base portion 281 of the ejector 280. The ejection portion 285 is configured to contact the cartridges 102 as they are being extracted from the chamber 116. Preferably, the ejection portion 285 extends such that it is approximately opposite an extractor of the bolt carrier assembly 400 and is able to contact a portion of the cartridge 102, causing the cartridge to pivot about the extractor and be ejected via the ejection port 243 of the upper receiver 210. The ejection portion 285 includes an ejection surface 287, a first lateral surface 288, a second lateral surface 289, and a top surface 290 opposite the base portion 281. A rear surface 291 is located opposite the ejection surface 287. As can be seen, the ejection surface 287 is designed to come into contact with the cartridge 102. The first and second lateral surfaces 288, 289 and the top surface 290 are arranged so as to fit within slots in the bolt 430 and the bolt carrier 410. The rear surface 291 is configured to minimize stress risers while minimizing the size of the ejection portion 285.

Optionally, the ejection surface 287 may extend perpendicular to the longitudinal axis A-A or may extend at an angle to the longitudinal axis A-A. In some implementations, the ejection surface 287 may be angled or incorporate a radius to control where on the cartridge 102 the ejection surface 287 contacts. Furthermore, the ejection surface 287 may have a convex or concave portion to allow multiple regions on the ejection surface 287 to contact the cartridge 102 at different areas as the cartridge 102 is ejected from the bolt 430.

FIGS. 34-40 illustrate a portion of the lower receiver assembly 300. These figures specifically illustrate the lower receiver 310, the magazine catch 350, and the components associated with the magazine catch 350. In particular, the lower receiver has an upper surface 318, the fire control group pocket 314 formed into the upper surface 318. The magazine well 312 also extends to the upper surface 318, allowing the magazine 510 to extend into the upper receiver 210 and present cartridges 102 to the bolt carrier assembly 400 for feeding into the chamber 116.

The magazine catch 350 is inserted within the magazine catch aperture 315, the magazine catch aperture 315 extending from the outer surface 316 to the magazine well 312 as noted above. The magazine catch aperture 315 is sized to allow free movement of the magazine catch 350 within the magazine catch aperture 315. The magazine catch aperture 315 may be made slightly oversize to allow for the pivoting movement of the magazine catch 350 during use. As best illustrated in FIGS. 36-40, the magazine catch 350 is secured by a pin 307 which is inserted into a hole 317 of the lower receiver 310. The pin 307 also extends through a hole 357 of the magazine catch 350 and rests within a lower portion 319 of the hole 317. Optionally, the pin 307 may be press fit into the hole 317 or may be secured with a set screw, adhesive compound, or another method. The hole 317 preferably extends completely across the magazine catch aperture 315 so that pin 307 can extend completely through the magazine catch 350 and be supported on both top and bottom of the magazine catch 350.

As noted above, the spring 303 applies a biasing force to the actuation portion 352 of the magazine catch 350. This biases the retention portion 354 inward toward the magazine well 312. The retention portion 354 protrudes into the magazine well 312 in the default state where the user does not apply a force to the actuation portion 352 and the spring 303 biases the magazine catch 350. When the user applies a force to the actuation portion 352, the magazine catch 350 rotates about a pivot axis P-P defined by the pin 307, and the retention portion 354 exits the magazine well 312, allowing insertion and removal of the magazine 510. When inserting the magazine 510 into the magazine well 312, the magazine 510 may also displace the retention portion 354 out of the magazine well 312 and allow insertion of the magazine 510 without a force applied to the actuation portion 352 of the magazine catch 350.

Figure 41:
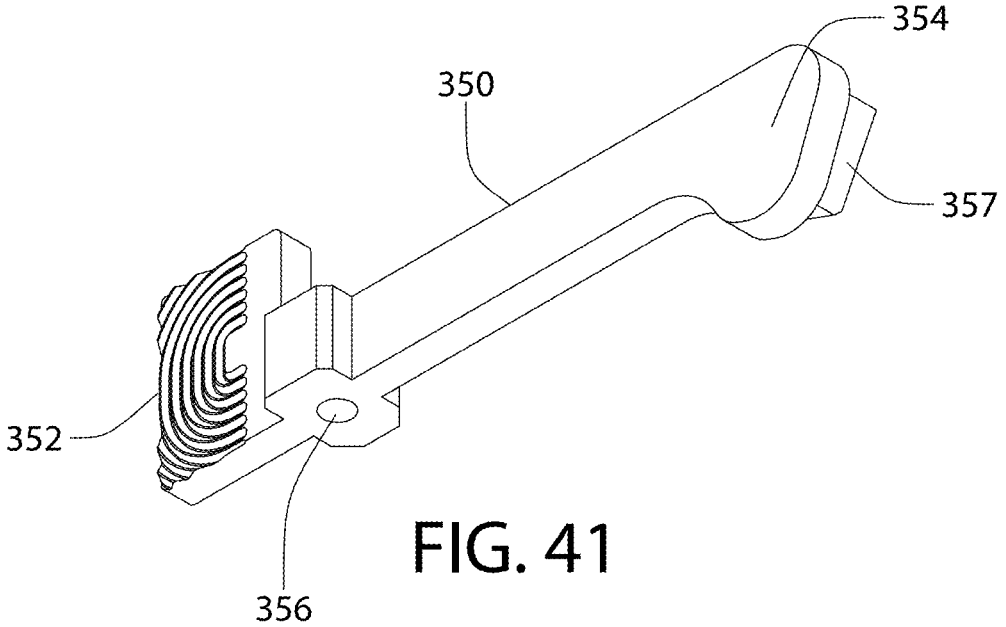
FIG. 41 is a top right perspective view of a magazine catch of the lower receiver assembly.
Figure 42:
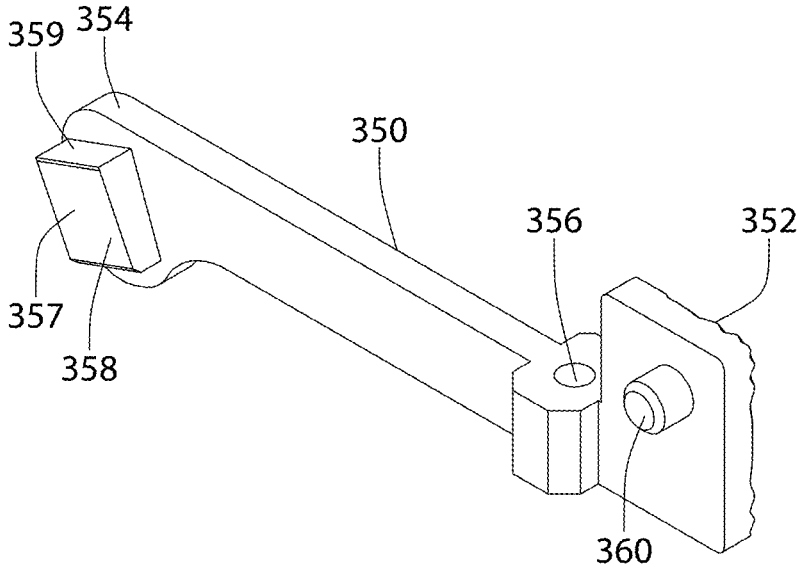
FIG. 42 is a bottom left perspective view of the magazine catch.
Figure 43:
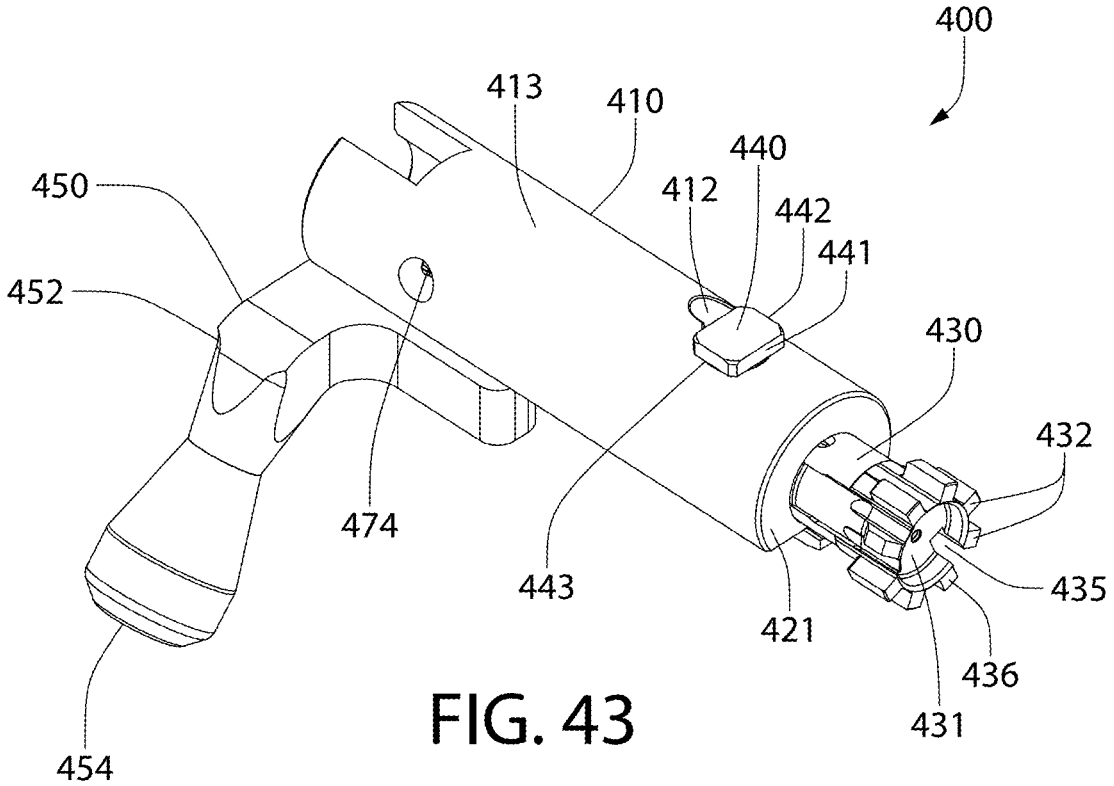
FIG. 43 is a top right perspective view of a bolt carrier assembly of the firearm.
Figure 44:
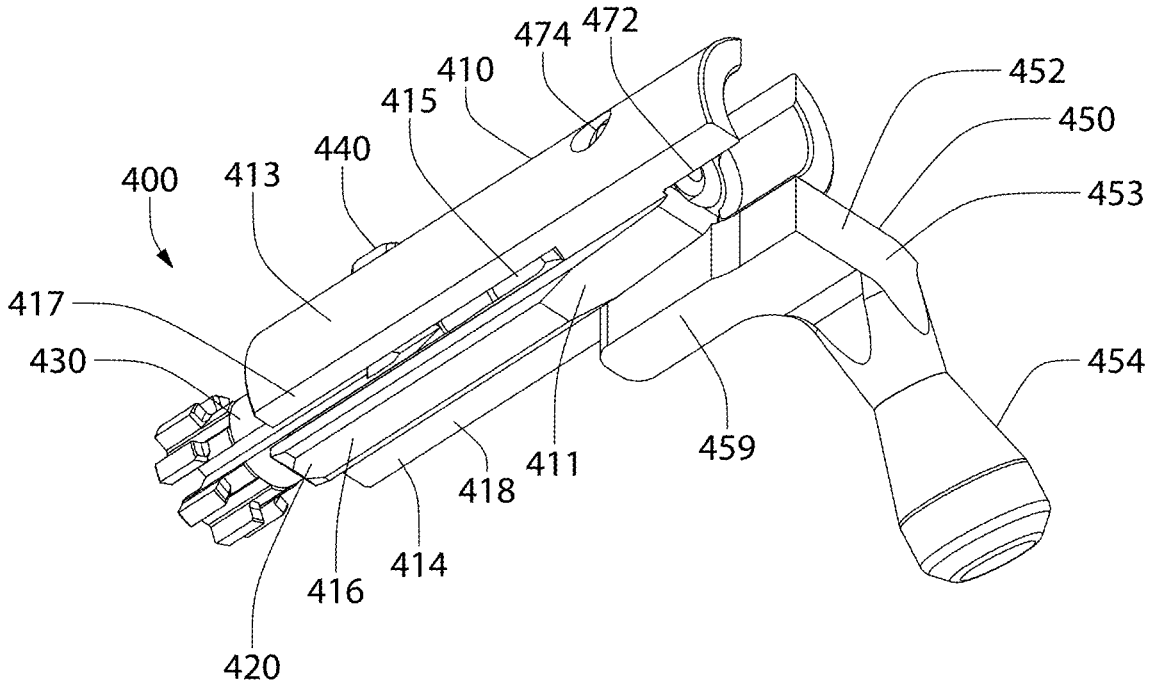
FIG. 44 is a bottom left perspective view of the bolt carrier assembly.
Figure 45:
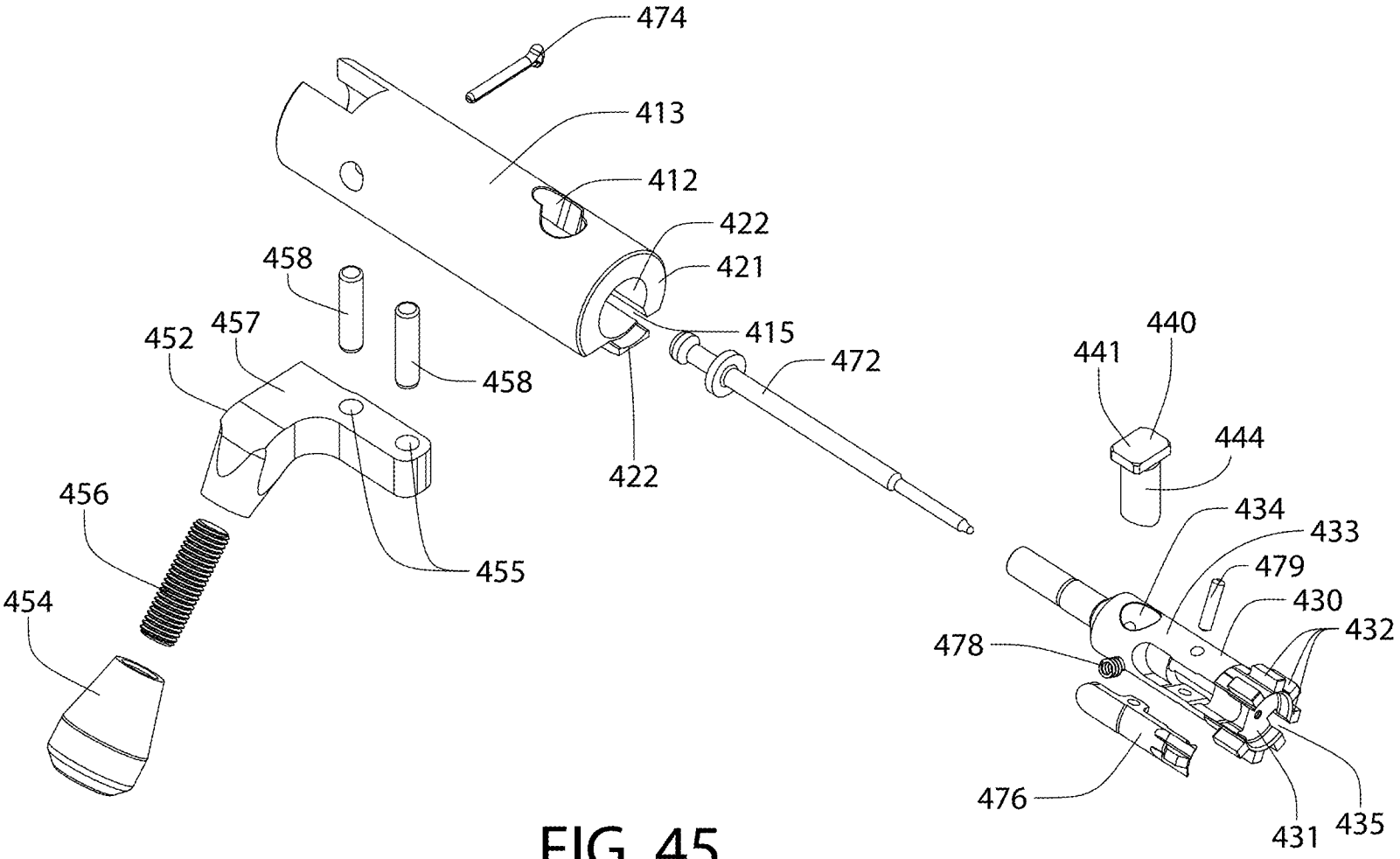
FIG. 45 is an exploded view of the bolt carrier assembly.
Figure 46:
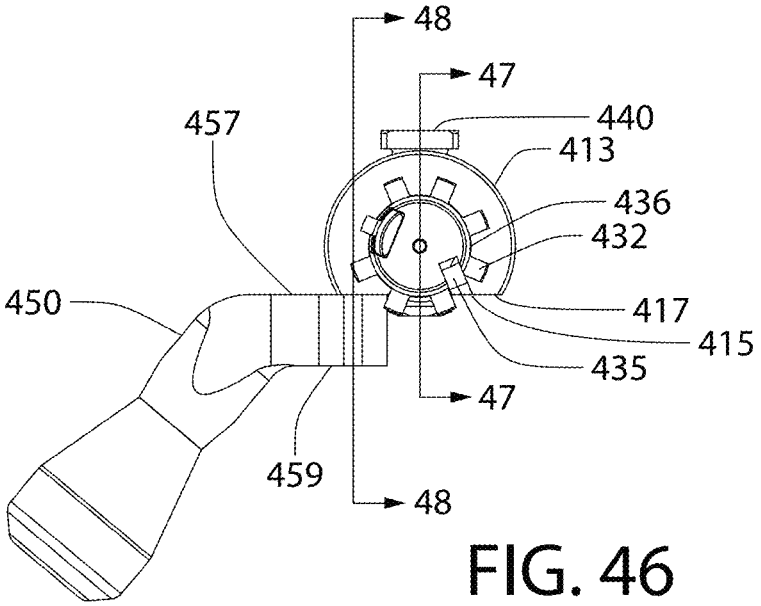
FIG. 46 is a front view of the bolt carrier assembly.
Figure 47:
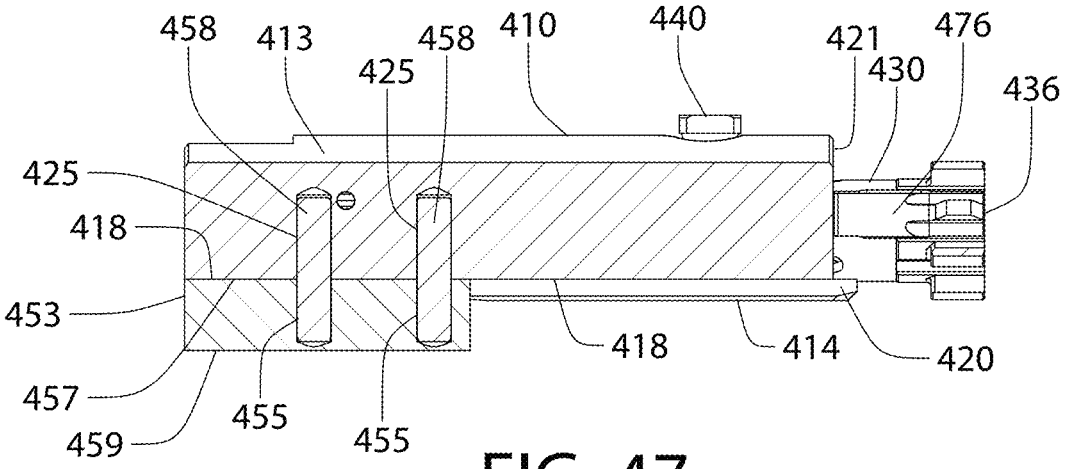
FIG. 47 is a cross-section view of the bolt carrier assembly taken along line 47-47 of FIG. 46.
Figure 48:
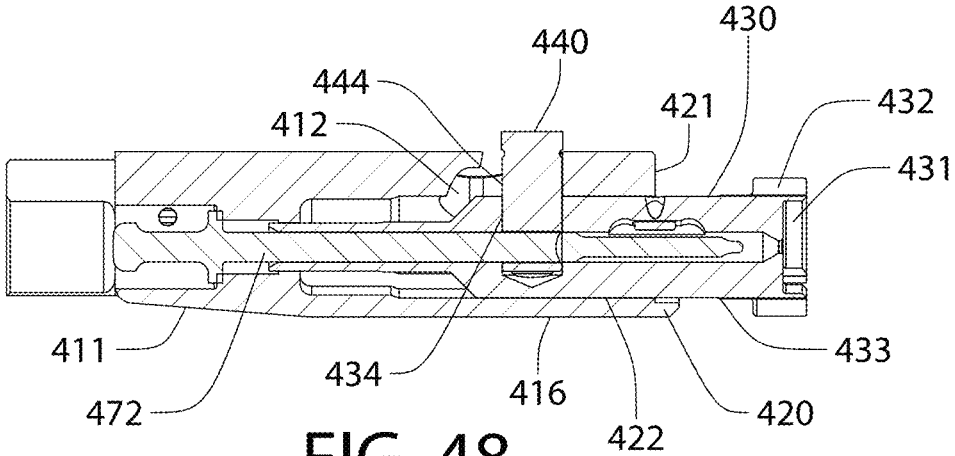
FIG. 48 is another cross-section view of the bolt carrier assembly taken along line 48-48 of FIG. 46.
Figure 49:
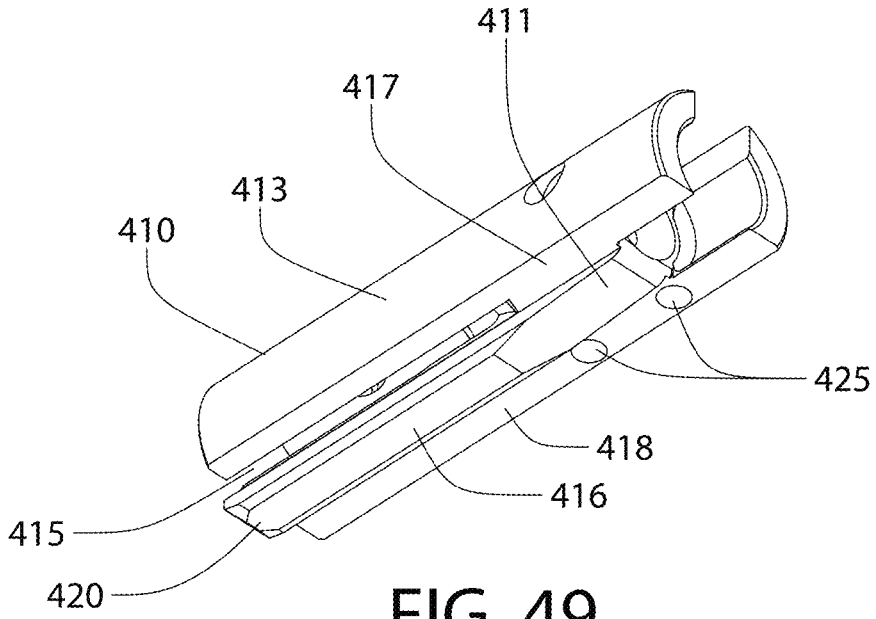
FIG. 49 is a bottom left perspective view of a bolt carrier of the bolt carrier assembly.
Figure 50:
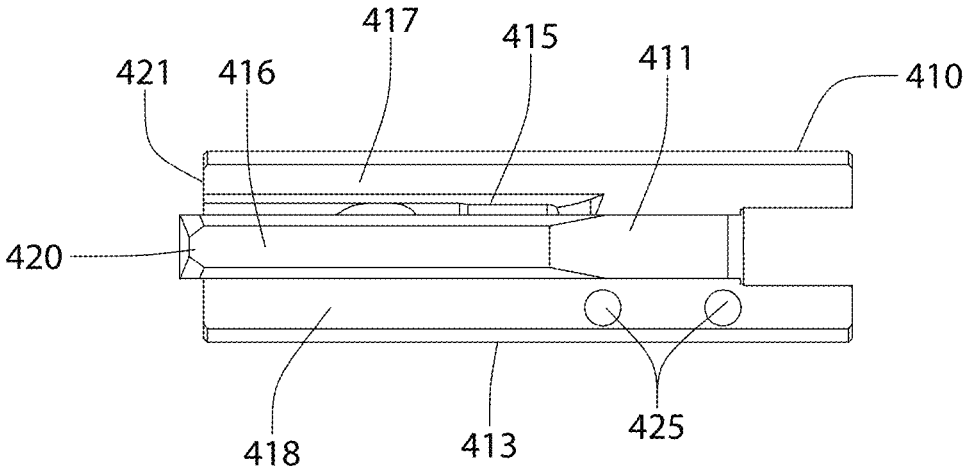
FIG. 50 is a bottom view of the bolt carrier of the bolt carrier assembly.
Figure 51:
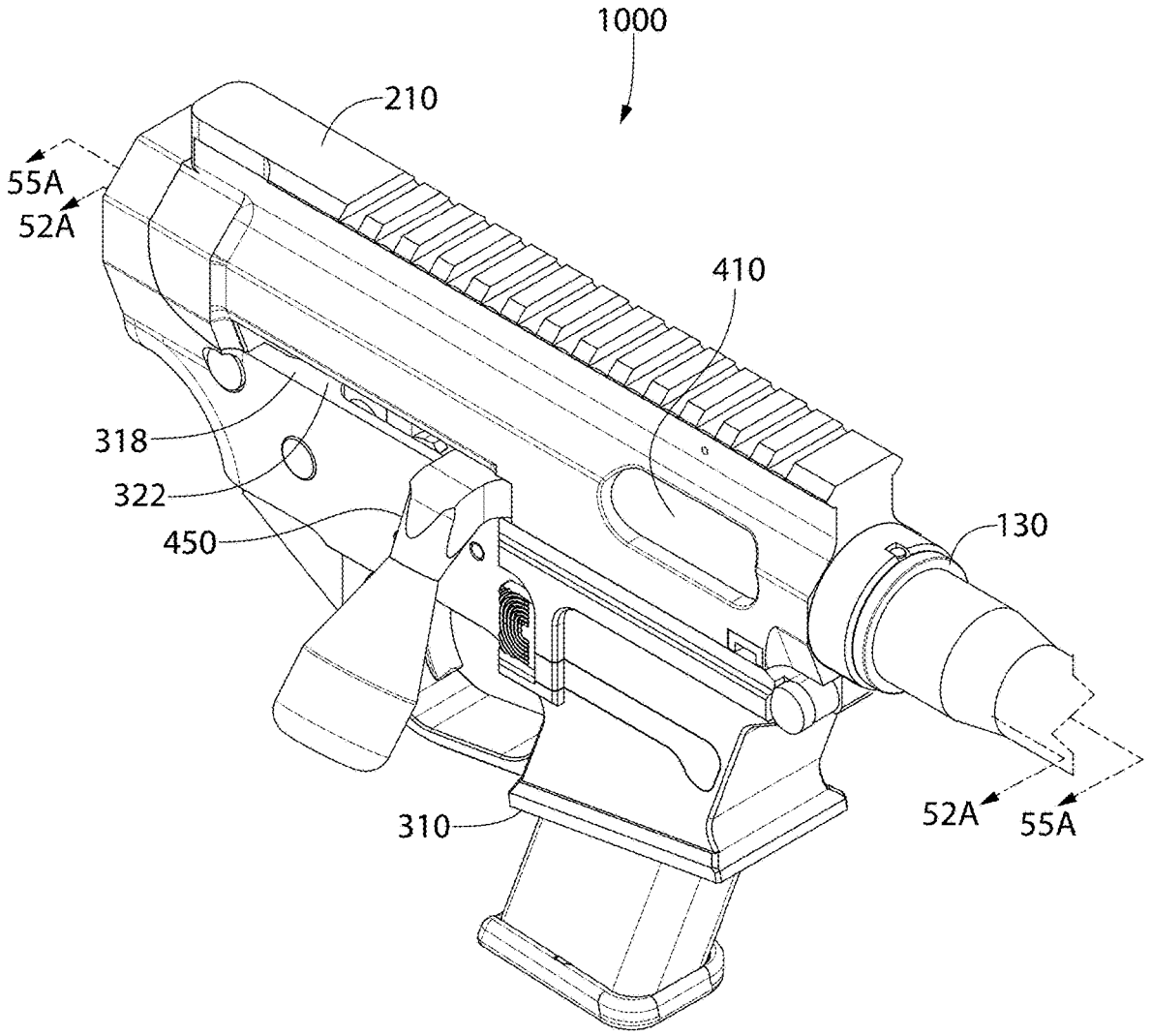
FIG. 51 is a perspective view of another embodiment of the firearm.
Figure 52A:
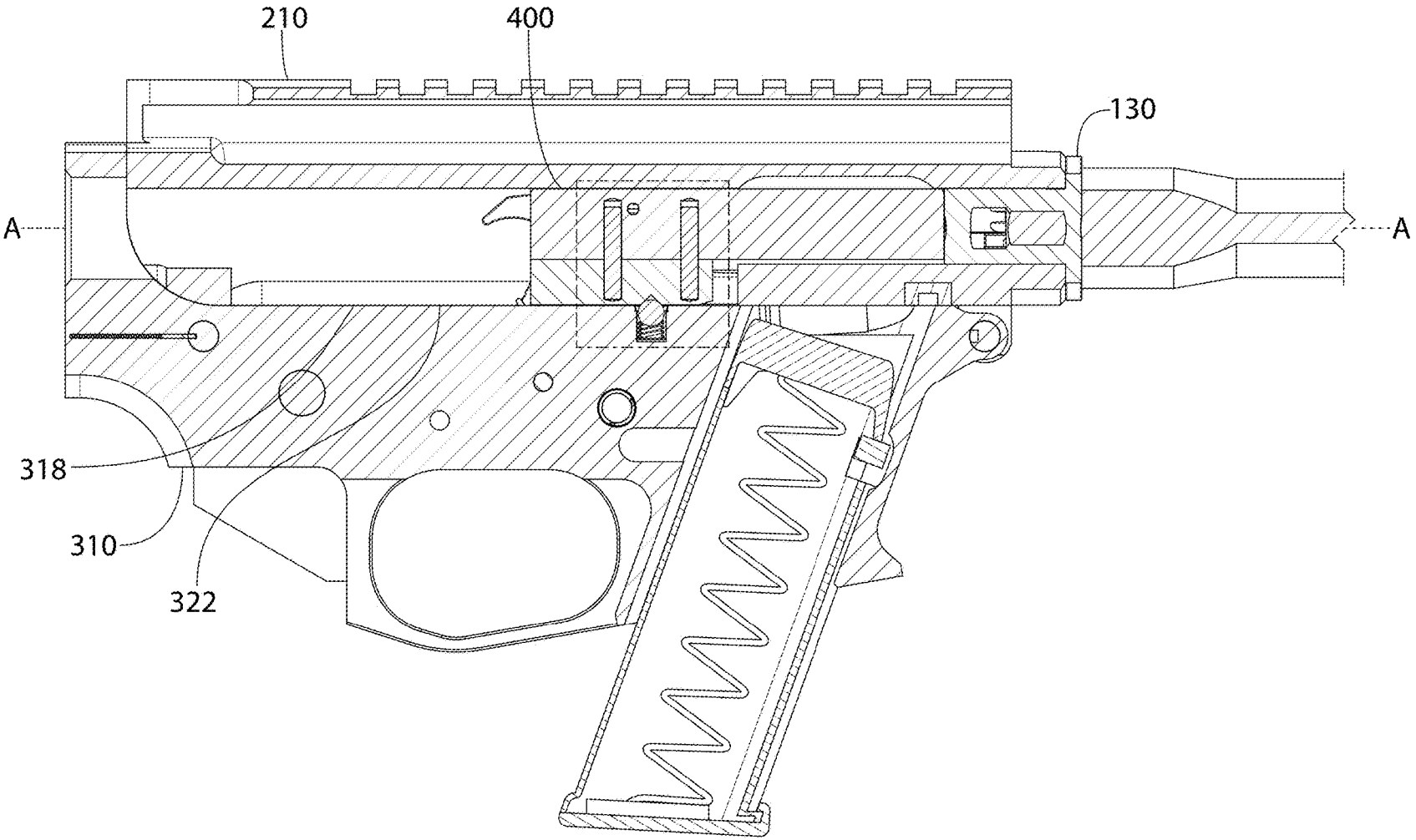
FIG. 52A is a cross-section view of the firearm taken along line 52A-52A of FIG. 51.
Figure 52B:
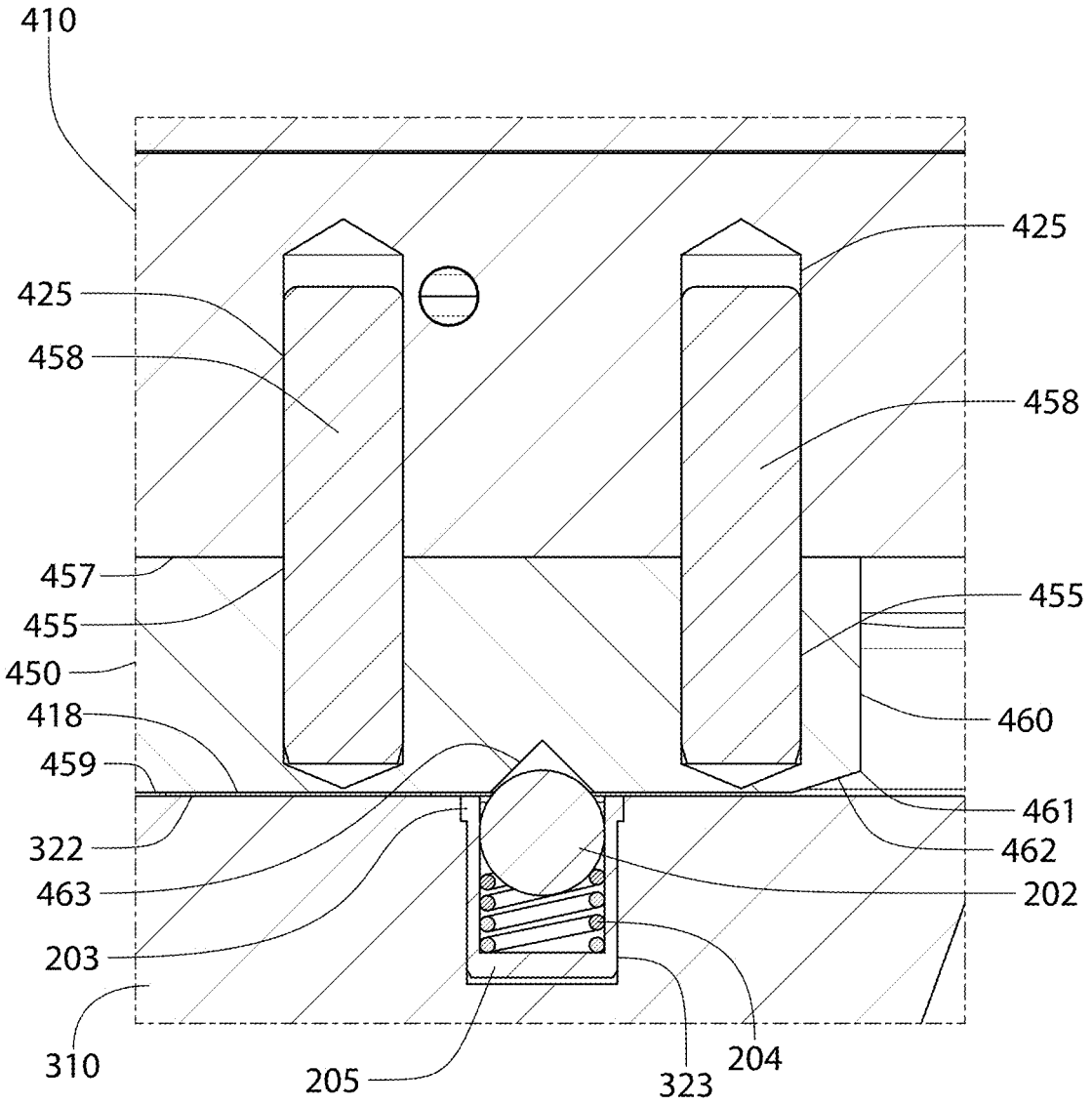
FIG. 52B is a detail cross-section view of area 52B of FIG. 52A.

Turning to FIGS. 41 and 42, the magazine catch 350 is illustrated in greater detail. The magazine catch 350 has a retention portion 354 and an actuation portion 352 as noted above. The magazine catch 350 pivots about a hole 356 when the pin 307 is inserted through the hole 356. In other implementations, the magazine catch 350 may be actuated by sliding instead of pivoting, or by any other known means. The actuation portion 352 also includes a retaining feature 360 which engages the spring 303 to assist in retaining the spring 303 during use.

As best illustrated in FIG. 42, the retention portion 354 includes a protuberance 357, the protuberance 357 having a sloped surface 358 and a retention surface 359. The sloped surface 358 causes the retention portion 354 to move outward from the magazine well 312 when a magazine 510 is inserted into the magazine well 312. The retention surface 359 engages a corresponding feature on the magazine 510 to hold the magazine 510 in place. The shape and width of the protuberance 357 may vary depending on the specific brand or caliber of the magazine 510 or as required to function with any and all magazines 510 that are used with the firearm 1000.

FIGS. 43-50, the bolt carrier assembly 400 and the bolt carrier 410 are illustrated. The bolt carrier assembly 400 includes the bolt carrier 410, the bolt 430, the follower element 440, the operating component 450, and numerous other components. The bolt carrier assembly 400 further includes a firing pin 472, a firing pin retention pin 474, an extractor 476, an extractor spring 478, and an extractor pin 479. The extractor 476, extractor spring 478, and extractor pin 479 are assembled to the bolt 430, the extractor 476 extracting cartridge cases of spent cartridges 102. The extractor spring 478 biases the extractor 476 into contact with the cartridge 102, the extractor 476 rotating about the extractor pin 479. In other implementations, the extractor 476 may deflect over a rim of the cartridge 102, eliminating the need for a separate spring and pin. Numerous other extractor configurations are known and may be implemented in the firearm 1000.

The firing pin 472 ignites a primer of the cartridge 102 when struck by the hammer 384 as discussed above. The firing pin 472 may be biased away from the cartridge 102 by a spring in some implementations. The firing pin retention pin 474 retains the firing pin 472 within the bolt carrier 410, ensuring that it does not fall out of place during operation of the firearm 1000.

The bolt carrier 410 has a cylindrical outer surface 413 and a lower surface 414. Optionally, the outer surface 413 may define a cylinder in a plurality of discrete portions or may be a single cylindrical surface as illustrated. Stated otherwise, the outer surface 413 may be any shape that lies within a cylinder, the cylindrical portion(s) configured to engage the main portion 214 of the passageway 212 of the upper receiver 210 and allow sliding of the bolt carrier 410 along the longitudinal axis A-A. Preferably, the outer surface 413 is concentric and coaxial with the longitudinal axis A-A. No portion of the bolt carrier 410 extends into the cam portion 216 of the passageway 212. An entirety of the bolt carrier 410 is located within the main portion 214 of the passageway 212. The bolt carrier 410 is free to rotate within the passageway 212 when the operating component 450 is detached from the bolt carrier 410 and the follower element 440 is removed. This is because only the follower element 440 and the operating component 450 extend beyond a cylinder defined by the outer surface 413 of the bolt carrier 410. In addition, due to the movement of the follower element 440 within the cam feature 412 of the bolt carrier 410, the bolt carrier 410 is free to rotate within the passageway 212 when the operating component 450 is removed and the follower element 440 is installed to the bolt carrier 410.

The lower surface 414 incorporates the cocking surface 411, as well as a slot 415, a cartridge guide surface 416, and first and second clearance surfaces 417, 418. The slot 415 is sized to allow passage of the ejection portion 285 of the ejector 280. The slot 415 is formed in the first clearance surface 417. The first and second clearance surfaces 417, 418 extend from the outer surface 413 to the cartridge guide surface 416, and may not be planar, but instead may include a plurality of different surfaces, these surfaces potentially arcuate, and concave or convex. The clearance surfaces 417, 418 may be any shape required to provide adequate clearance for the magazine 510.

The cartridge guide surface 416 may be in contact with cartridges 102 in the magazine when the firearm is transitioned from the first to the fifth states, the bolt carrier assembly 400 traveling from the fully retracted position to the closed position. Thus, while a single cartridge 102 is fed from the magazine, the topmost one of the remaining cartridges 102 may be in contact with the cartridge guide surface 416. Once again, the cartridge guide surface 416 may be concave or convex, may incorporate planar surfaces, and some of the surfaces may be angled with respect to other ones of the surfaces as required. The cartridge guide surface 416 may also remain isolated from the cartridges 102 in the magazine 510, depending on the exact positioning of the magazine 510 within the magazine well 312.

The bolt carrier 410 further incorporates a protuberance 420 extending from a front surface 421, the protuberance 420 extending the cartridge guide surface 416 beyond the front surface 421. The protuberance 420 nests within the barrel extension 130 and does not interfere with the barrel extension 130 when the front surface 421 is in contact with the barrel extension 130. The protuberance 420 is adjacent the feed ramp 131 when the firearm is in the fifth state with the barrel extension 130 in contact with the front surface 421 of the bolt carrier 410.

The operating component 450 also incorporates a stop surface 453, the stop surface 453 engaging the stop surface 218 of the slot 220 of the upper receiver 210 when the firearm 1000 is in the first state and the bolt carrier assembly 400 is in a fully retracted position. The stop surface 453 forms a part of the base portion 452. The base portion 452 also includes holes 455 formed into a first surface 457, the holes 455 receiving the pins 458, the pins 458 preferably being press fit, threaded, glued, or otherwise secured into the holes. In other implementations, the pins 458 may be a sliding fit with the holes 455. Optionally, the holes 455 may be blind holes or may extend through the base portion 452 from the first surface 457 to a second surface 459.

Further optionally, the grasping portion 454 may be integrally formed with the base portion 452 and positioned at a variety of angles with respect to the first and second surfaces 457, 459. The grasping portion 454 may extend a variety of lengths from the longitudinal axis A-A to accommodate different user preferences, with the grasping portion 454 having a wide range of dimensions, textures, and other features to allow customization for user preferences. Thus, the design is intended to allow flexibility and customization but will preferably provide the grasping portion at a convenient location with respect to the grip 370 to allow convenient operation of the firearm 1000.

The first surface 457 of the operating component 450 is in direct surface contact with the second clearance surface 418 of the bolt carrier 410, the second clearance surface 418 having holes 425 which are a sliding fit with the pins 458. The first surface 457 is in direct surface contact with the first guide surface 222 of the upper receiver 210, allowing for some clearance between the first guide surface 222 of the upper receiver 210 and the first surface 457 to allow sliding motion. In other configurations, holes 425 may be provided in the first clearance surface 417. In other implementations the pins 458 may be permanently fixed within the holes 425, and the holes 455 may be a sliding fit with the pins 458 as noted above. Preferably the pins 458 are not fixed within both holes 425, 455 but are a sliding fit with one of the holes 425, 455 and are fixed within the other one of the holes 425, 455. Stated differently, the holes 425, 455 may be referred to as cylindrical bores while the pins 458 may be referred to as cylindrical protuberances. Thus, the pins 458 may be fixed to the operating component 450 within the holes 455 and may be referred to as cylindrical protuberances which engage cylindrical bores of the bolt carrier 410.

The pins 458 allow a sliding connection between the operating component 450 and the bolt carrier 410. The pins 458 allow the operating component 450 to be non-rotatably coupled to the bolt carrier 410 with respect to the longitudinal axis A-A, fixing the operating component 450 to the bolt carrier 410 without relative motion between these two components both circumferentially about the longitudinal axis A-A and along the longitudinal axis A-A. The operating component 450 is also rotationally fixed to the bolt carrier 410 about axes perpendicular to the longitudinal axis A-A. The operating component 450 can be separated from the bolt carrier 410 with translation in a direction perpendicular to the longitudinal axis A-A. This allows the bolt carrier 410 to be inserted and removed from the upper receiver 210 via the rear aperture 227 after the operating component 450 is separated from the bolt carrier 410.

The operating component 450 is contained by the slot 220, with the slot 220 being opened to allow removal of the operating component 450 when the upper receiver 210 is pivoted or removed from the lower receiver 310. The front or rear takedown pins 306, 308 may be removed from the upper receiver 210 to allow the upper receiver 210 to be pivoted or removed from the lower receiver 310.

The bolt 430 is a sliding fit within a bore 422 formed into the front surface 421 of the bolt carrier 410. The bore 422 may have a diameter which varies along the longitudinal axis A-A. The bore 422 accepts the bolt 430, the bore 422 being a close fit on at least one portion of an outer surface 433 of the bolt 430. The slot 415 may extend along the bore 422, extending from the bore 422 to the outer surface 413. The outer surface 433 of the bolt 430 has a receiving surface 434 that receives the follower surface 444 of the follower element 440. The receiving surface 434 is a close fit with the follower surface 444, ensuring that the bolt 430 is rotationally linked with the follower element 440 with respect to the longitudinal axis A-A.

The bolt 430 also includes a slot 435, the slot 435 aligned with the slot 415 of the bolt carrier 410 when the bolt 430 is in a forward position with respect to the bolt carrier 410 as illustrated. When in a rearward position with respect to the bolt carrier 410, the slot 435 is no longer aligned with the slot 415 due to the rotation of the bolt 430 in response to the engagement of the follower surface 444 with the cam feature 412. The slot 435 extends through the entirety of the bolt 430 in the direction of the longitudinal axis A-A, the slot 435 intersecting the recess but not extending to the longitudinal axis. Otherwise stated, the slot 435 has a constant profile with respect to the longitudinal axis A-A such that the slot 435 is formed between lugs 432 and into at least a portion of the outer surface 433 of the bolt 430.

Preferably, the slot 435 terminates such that ejection portion 281 of the ejector 280 can pass completely through the slot 435 when the firearm 1000 is in the fourth and fifth states. In the fourth and fifth states, the ejection portion 281 of the ejector 280 protrudes beyond the recess 431 and the front surface 436 of the bolt. The ejection portion 281 is located within the slot 415 of the bolt carrier 410 but passes completely through the bolt 430 in the fourth and fifth states. When the bolt carrier assembly 400 is retracted during a transition from the fifth state to the first state, the bolt 430 rotates such that the slot 435 is in alignment with the slot 415, the ejection portion 281 moves into the slot 435, and ultimately extends into the recess 431 and protrudes from a front surface 436 of the bolt 430. The protrusion of the ejection portion 281 into the recess 431 causes the cartridge 102 to be ejected from the firearm 1000 via the ejection port 243.

A method of assembling a firearm 1000 will be discussed in detail. First, an upper receiver 210 is provided, the upper receiver having a passageway 212 extending along a longitudinal axis A-A. A bolt carrier assembly 400 including a bolt carrier 410, a bolt 430, and a follower element 440 is inserted into the passageway 212 of the upper receiver 210 via a rear aperture 227. The bolt carrier assembly 400 may, in this state, be referred to as a bolt carrier subassembly because no operating component has been assembled to the bolt carrier 410. Subsequently, an operating component 450 is assembled to the bolt carrier 410 of the bolt carrier assembly 400 by sliding the pins 458 into the holes 425 of the bolt carrier 410. The assembly of the operating component 450 to the bolt carrier 410 completes the bolt carrier assembly 400, transforming the bolt carrier subassembly into the bolt carrier assembly 400. The bolt carrier assembly 400 cannot be withdrawn from the upper receiver 210 with the operating component 450 assembled to the bolt carrier 410.

Finally, the upper receiver 210 is coupled to a lower receiver 310. The operating component 450 extends through a slot 220 of the upper receiver 210, the operating component 450 prevented from being withdrawn from the upper receiver 210 and the bolt carrier 410 by the slot 220 and the lower receiver 310. The operating component 450 is contained within the slot 220. A first surface 457 of the operating component 450 engages a first guide surface 222 of the slot 220 of the upper receiver 210. A second surface 459 of the operating component 450 engages a second guide surface 322 of the lower receiver 210. The second surface 459 is in direct surface contact with the second guide surface 322 of the lower receiver 310, allowing for some clearance between the second guide surface 322 of the lower receiver 310 and the second surface 459 to allow sliding motion.

A method of operating the firearm 1000 will also be discussed in detail. In a first step, the bolt carrier assembly 400 is positioned in a first position within the passageway 212 of the upper receiver 210. The passageway 212 extends along a longitudinal axis A-A such that the follower element 440 engages first and second surfaces 231, 232 of the cam portion 216 of the passageway 212. The first and second surfaces 442, 443 of the follower element 440 engage the first and second surfaces 231, 232 of the cam portion 216 of the passageway 212. Concurrently, the operating component 450 engages the first guide surface 222 of the slot 220 of the upper receiver 210 and the second guide surface 322 of the lower receiver 310. The first position may be the fully retracted position where the operating component 450 is in contact with the stop surface 218 of the upper receiver. No portion of the bolt carrier assembly 410 extends beyond the rear aperture 227 of the passageway 212 of the upper receiver 210 in the fully retracted position. Thus, the bolt carrier assembly 410 is completely contained within the passageway 212. In other implementations, the bolt carrier assembly 410 may extend through the rear aperture 227 of the passageway 212 of the upper receiver 210 in the fully retracted position, but the bolt carrier assembly 410 does not extend beyond the lower receiver 310 in the fully retracted position.

Second, the bolt carrier assembly 400 is translated along the longitudinal axis A-A to a second position, the operating component 450 engaging the first guide surface 222 and the second guide surface 322. The second position may be intermediate between the fully retracted position and the closed position. In the second position, the follower element 440 remains constrained by the cam portion 216 of the passageway 212.

Next the bolt carrier assembly 400 is moved to a third position. The third position may be the same as the closed position. In the third position, the bolt 430 is rotated because the follower surface 444 of the follower element 440 is moved along the cam feature 412 of the bolt carrier 410, the follower element 440 no longer constrained by the cam portion 216 of the passageway 212. The bolt 430 is coupled to the follower element 440, causing the bolt 430 to rotate when the bolt carrier assembly 400 is moved to the third position. The operating component 450 continues to engage the first guide surface 222 and the second guide surface 322 in the third position.

Turning to FIGS. 51-55B, another embodiment of the firearm 1000 is illustrated. Features of the detent 202 are shown in greater detail. The features of this embodiment are identical to those of discussed above, except as noted. The same reference numbers have been used for consistency, with distinct reference numbers applied as required. FIGS. 52A and 52B illustrate a cross-section view of the detent 202 engaging the operating component 450. The operating component 450 differs slightly from the one disclosed above, because it incorporates a ramp feature 462 formed into a leading edge 461 of a front surface 460, the front surface 460 opposite the stop surface 453. The ramp feature 462 is configured as an angled surface which joins the front surface 460 to the second surface 459. As discussed above, the second surface 459 is opposite the first surface 457, the first surface 457 engaging the second surface 418 of the bolt carrier 410.

The second surface 459 further incorporates a recess 463 which is positioned to engage the detent 202 when the firearm 1000 is in battery and the bolt carrier assembly 400 is in the fully closed or fifth state. Thus, the detent 202 engages the recess 463 to maintain the bolt carrier assembly 400 in battery despite changes in orientation of the firearm 1000 or other potential disturbances. The detent 202 may be a ball detent and may further incorporate a spring 204 and a body 205. The detent 202, spring 204, and body 205 may be located within a pocket 323 formed in the second guide surface 322 of the lower receiver 310. The body 205 may also incorporate a flange 203 which provides repeatable positioning of the detent 202, spring 204, and body 205 within the pocket 323 to ensure a consistent retention force. The body 205 is formed so as to prevent removal of the detent 202 from the body 205.

The detent 202 may be alterable from a fully extended position to a compressed position, the compressed position being any position where the detent 202 is less than fully extended. Otherwise stated, the compressed position is any position where the detent 202 is not prevented from further extension by the body 205. As the bolt carrier assembly 400 is transitioned from an out of battery condition to a battery condition, the bolt carrier assembly 400 translates rightward as viewed in FIGS. 52A and 52B.

In one method of operation, the firearm 1000 starts in an out of battery condition, with the bolt carrier assembly 400 in a first position with respect to the longitudinal axis A-A. In the first position, the detent 202 is in a fully extended position. The firearm 1000 is then transitioned to a second position with respect to the longitudinal axis A-A where the bolt carrier assembly 400 is translated until the operating component 450 encounters the detent 202. When the operating component 450 encounters the detent 202, the detent 202 must be compressed, transitioning the detent 202 from the fully extended position to the compressed position. The ramp feature 462 reduces a force that must be applied to the operating component 450 to compress the detent 202 as the operating component 450 encounters the detent 202. The detent 202 then remains compressed against the second surface 459.

Next, the bolt carrier assembly 400 is translated along the longitudinal axis A-A until it encounters the recess 463 in a third position with respect to the longitudinal axis A-A. The recess 463 allows the detent 202 to extend slightly and increases the force required to retract the operating component 450 and take the firearm 1000 out of battery. The detent 202 remains in the compressed position but is less compressed than it was when in the second position.

Figure 53:
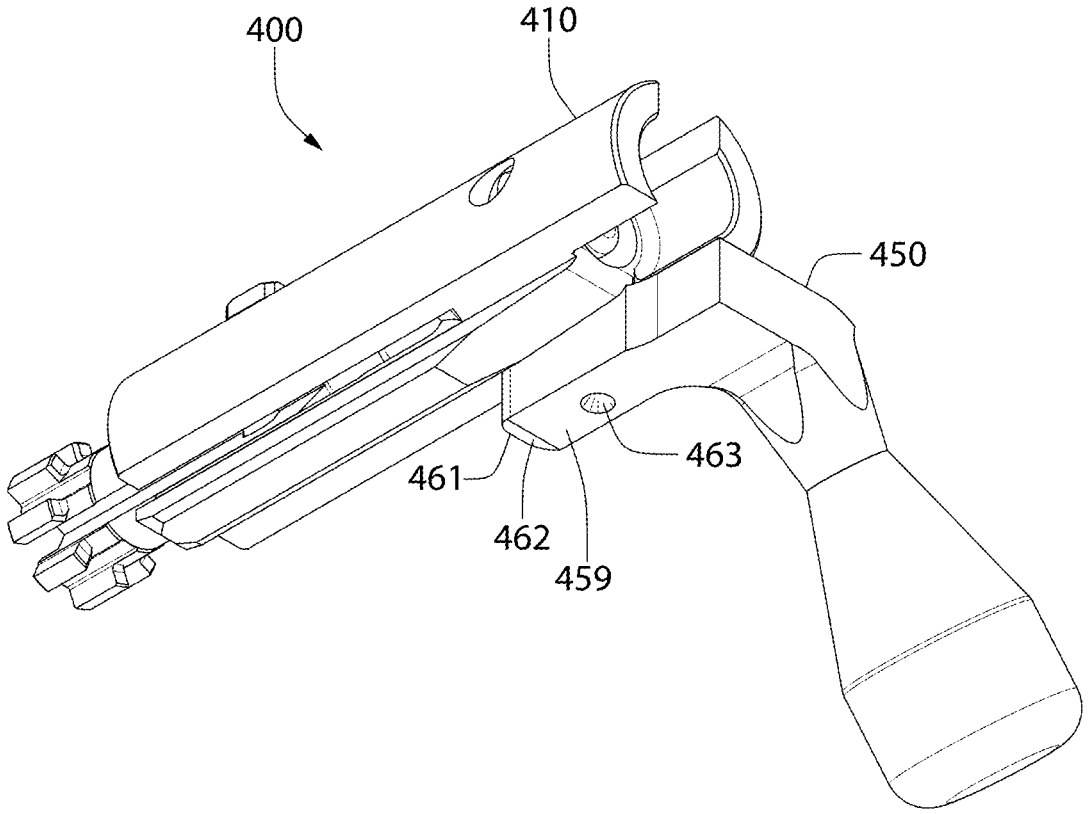
FIG. 53 is a lower perspective view of the bolt carrier assembly of the firearm of FIG. 51.
Figure 54:
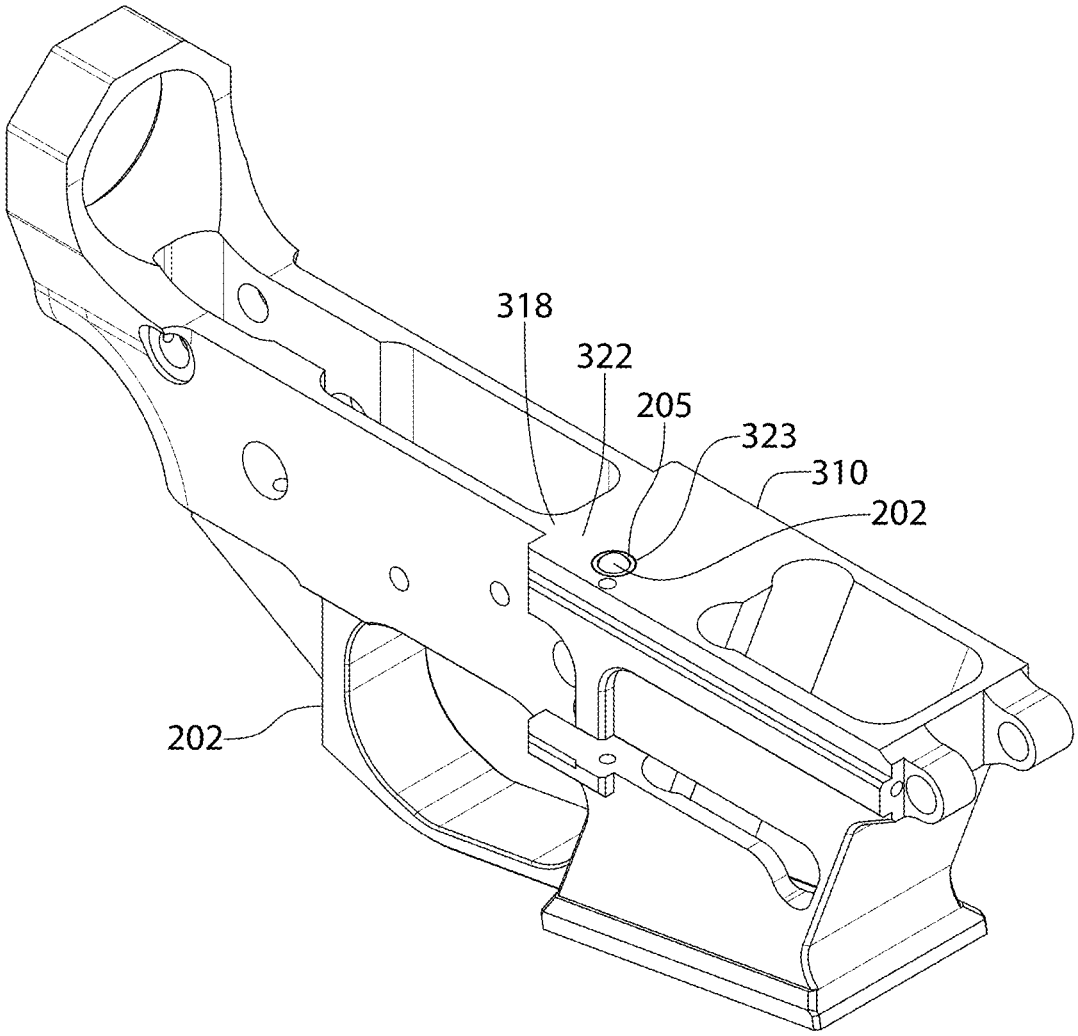
FIG. 54 is a perspective view of the lower receiver of the firearm of FIG. 51.

FIG. 53 illustrates the bolt carrier assembly 400, showing the ramp feature 462 at the leading edge 461 and the recess 463 formed in the second surface 459. FIG. 54 illustrates the detent 202 and body 205 located within the pocket 323 of the lower receiver 310. As noted above, the pocket 323 is formed within the upper surface 318, the upper surface 318 forming the second guide surface 322. Alternate arrangements for the detent 202 are contemplated, with the detent 202 engaging other features of the bolt carrier assembly 400 in some other implementations. In addition, it is contemplated that the body 205 may be omitted or the detent 202 may take a form other than a ball.

Figure 55A:
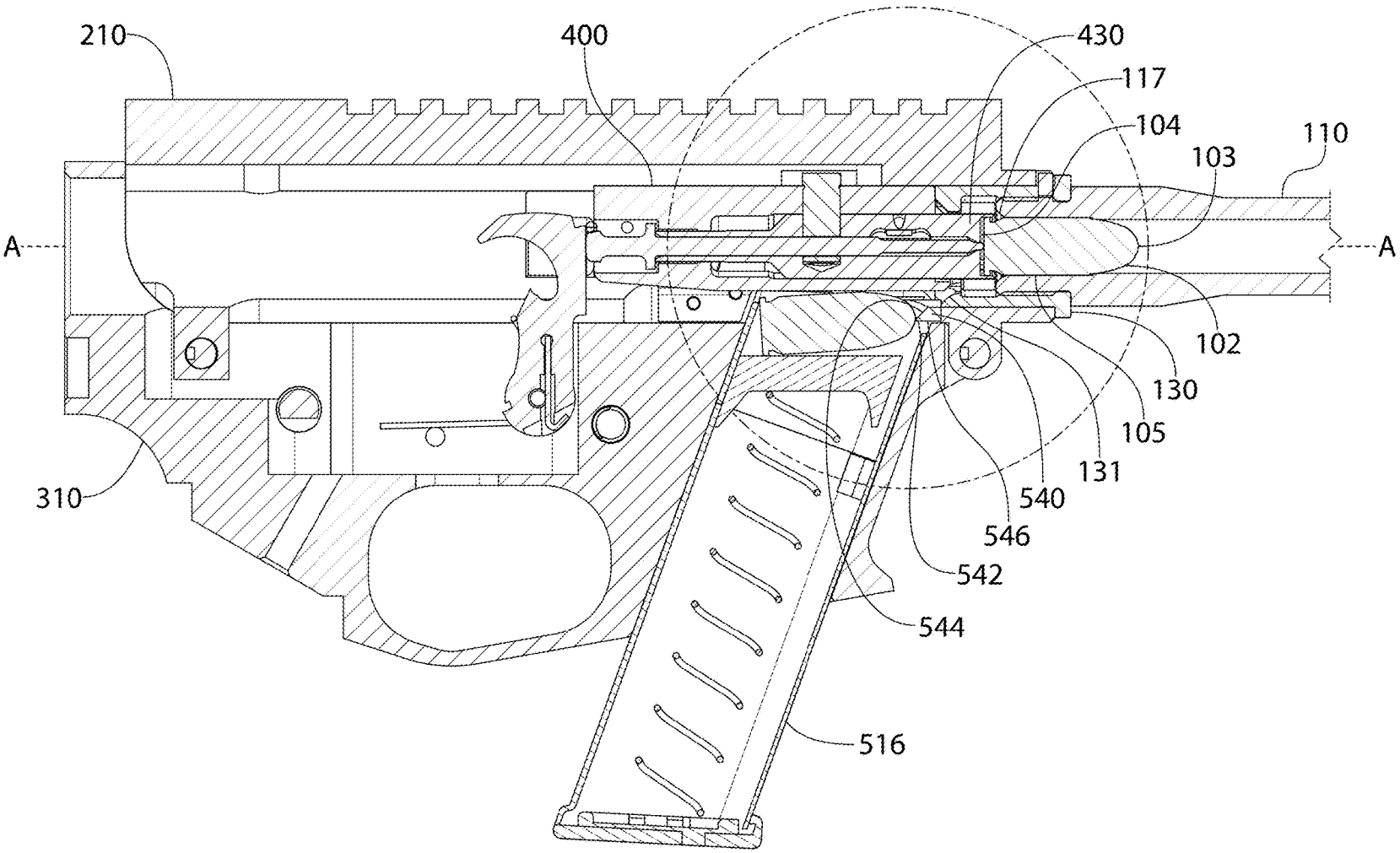
FIG. 55A is a cross-section view of the firearm taken along line 55A-55A of FIG. 51.
Figure 55B:
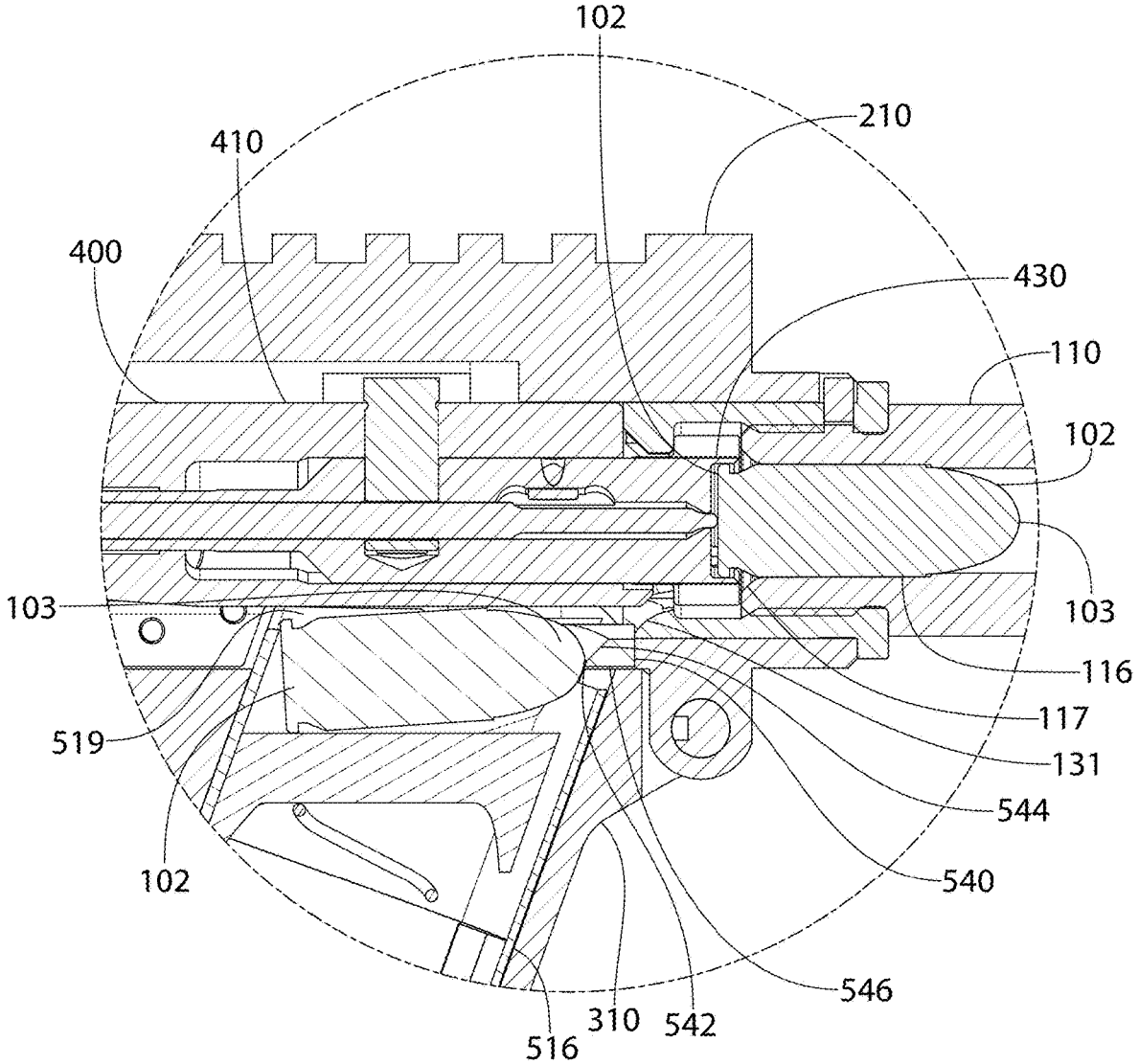
FIG. 55B is a detail cross-section view of area 55B of FIG. 52A.

FIGS. 55A and 55B illustrate the operation of a feed insert 540 in the firearm 1000. The feed insert 540 serves to aid in feeding by extending the feed ramp 131 of the barrel extension 130. The feed insert 540 incorporates a clearance path 542 to allow passage of the cartridges 102 upward through the magazine body 516 to the feed lips 519. The feed insert 540 utilizes the clearance path 542 to allow a secondary ramp 544 to extend as close as possible to the cartridges 102. The clearance path 542 is sized to allow passage of bullets 103 of varying shapes but conform to the shape of the cartridges 102 as closely as possible.

As the cartridges 102 are fed from the magazine 510 to the chamber 116 of the barrel 110, the bullets 103 of the cartridges 102 first engage the secondary ramp 544. The cartridges 102 are fed from the magazine 510 by the bolt 430 as the bolt carrier assembly 400 is moved toward the barrel 110. The bolt 430 engages the rear portion 104 of the cartridge 102 and pushes the cartridge 102 out of the magazine 510, causing the bullet 103 to engage the secondary ramp 544, lifting the bullet 103 toward the chamber 116.

As the bolt carrier assembly 400 continues to advance, the bullet 103 and case 105 continue to engage the secondary ramp 544 until they contact the feed ramp 131 of the barrel extension 130. The cartridge 102 continues to be raised up and moved forward toward the chamber 116 until the cartridge 102 is moved past the feed lips 519. Finally, the cartridge 102 is guided into the chamber 116 by the bolt 430, the feed ramp 131, and the feed cone 117 of the barrel 110. The secondary ramp 544 may be considered an extension of the feed ramp 131 but is preferably formed as a separate surface either formed in the upper receiver 210 or in the feed insert 540. Thus, it is contemplated that the feed insert 540 may be separately formed, or may be integrally formed with the upper receiver 210. Thus, the secondary ramp 544 may be formed as a part of the upper receiver 210 rather than a separate feed insert 540.

As the cartridge 102 is fed into the chamber 116, another cartridge 102 passes upward, biased by the spring 514 and the follower 512 against the feed lips 519. As the cartridge 102 moves upward against the feed lips 519, the bullet 103 passes through the clearance path 542 of the feed insert 540. When all of the cartridges have been exhausted, the follower 512 may rest against a bottom surface 546 of the feed insert 540, the follower 512 configured not to pass through the clearance path 542.

Figure 56:
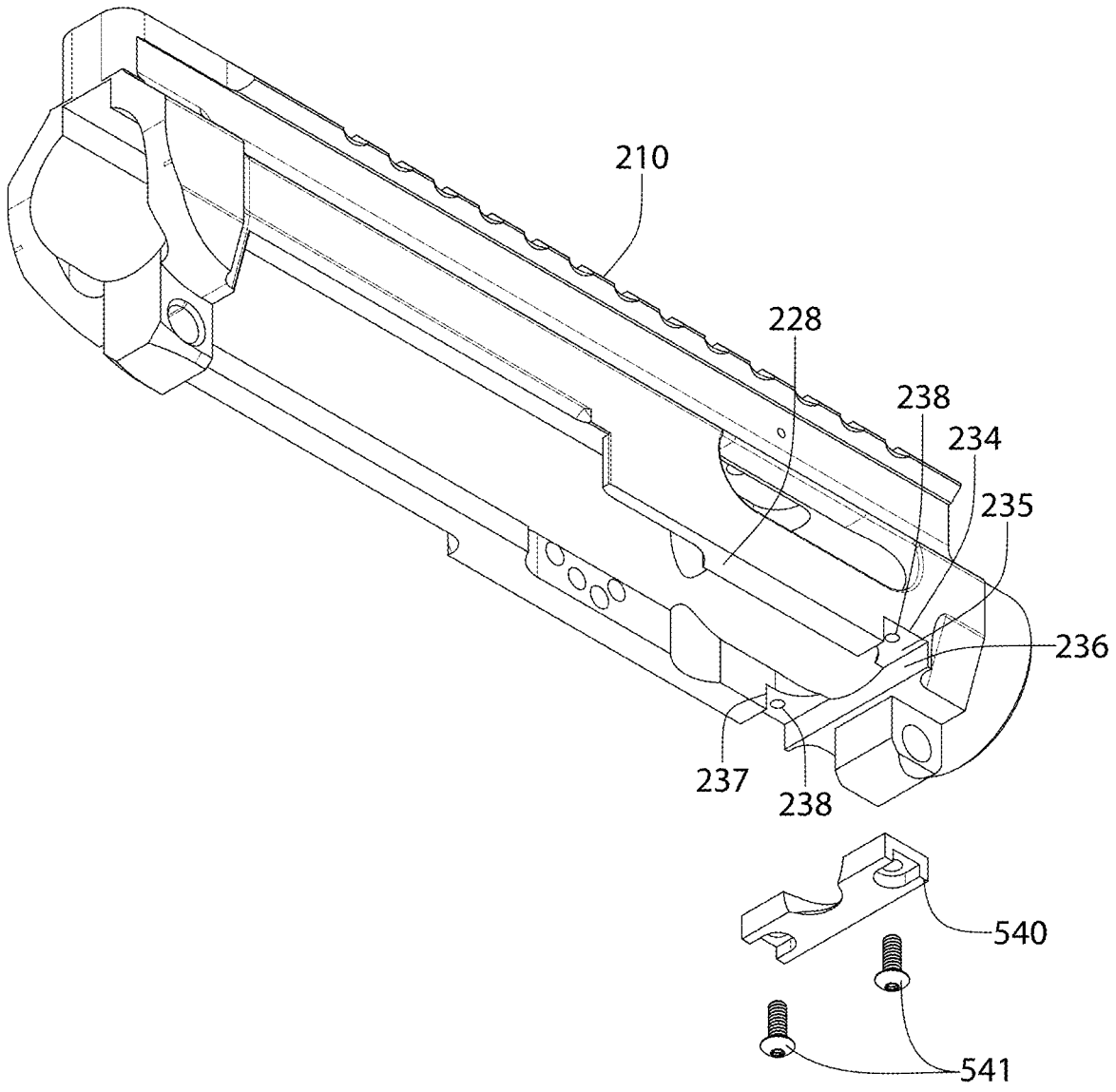
FIG. 56 is an exploded view of the upper receiver, a feed insert, and fasteners of the firearm of FIG. 51.
Figure 57:
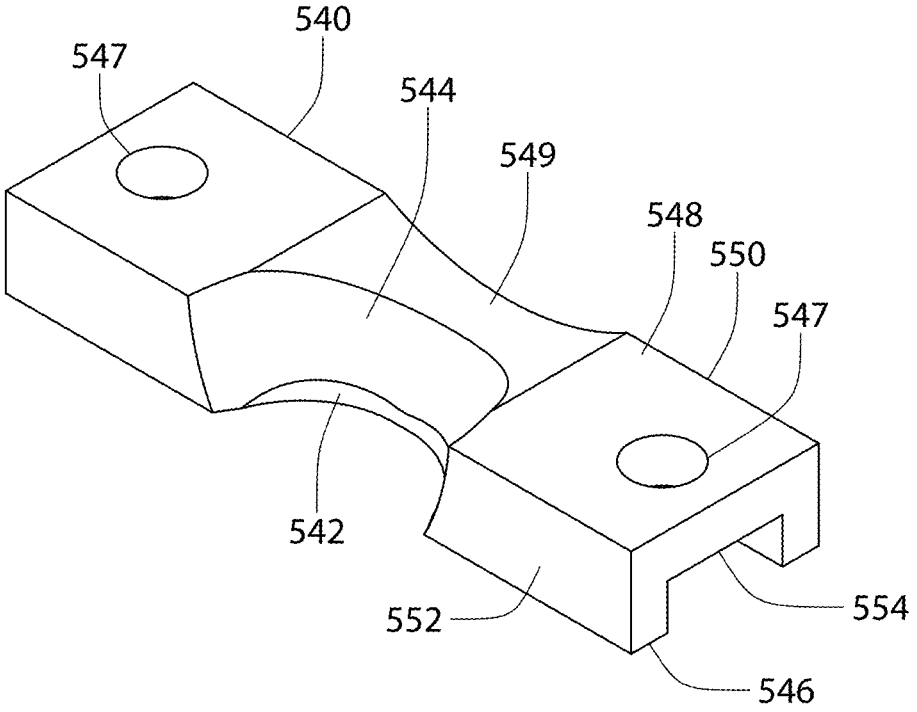
FIG. 57 is a perspective view of the feed insert.
Figure 58:
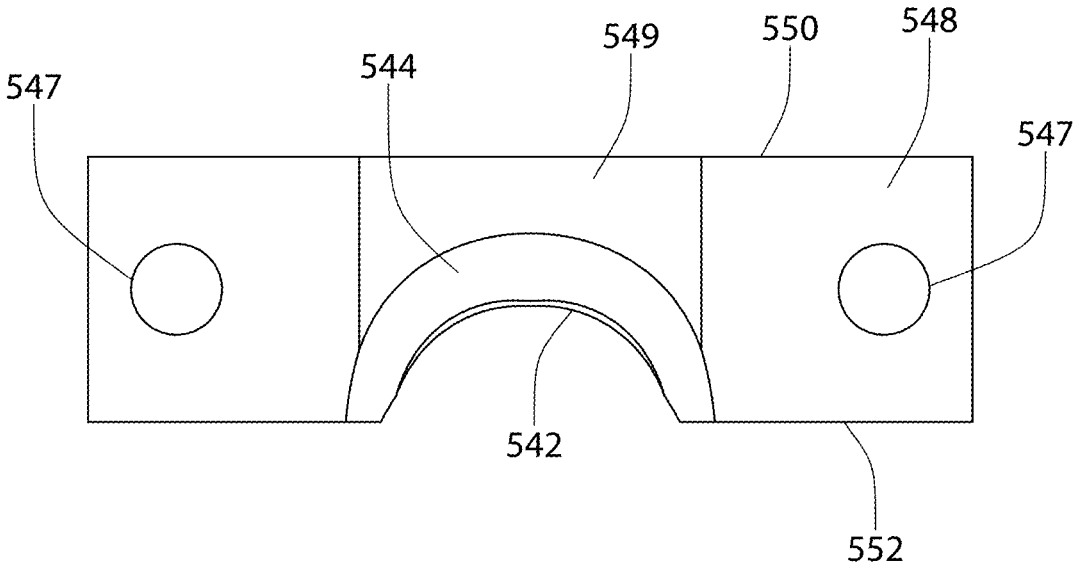
FIG. 58 is a top view of the feed insert.
Figure 59:
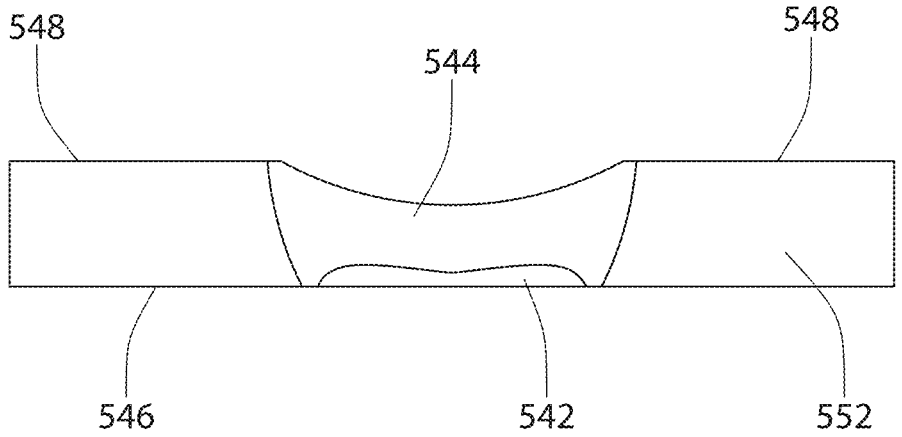
FIG. 59 is a left view of the insert.
Figure 60:
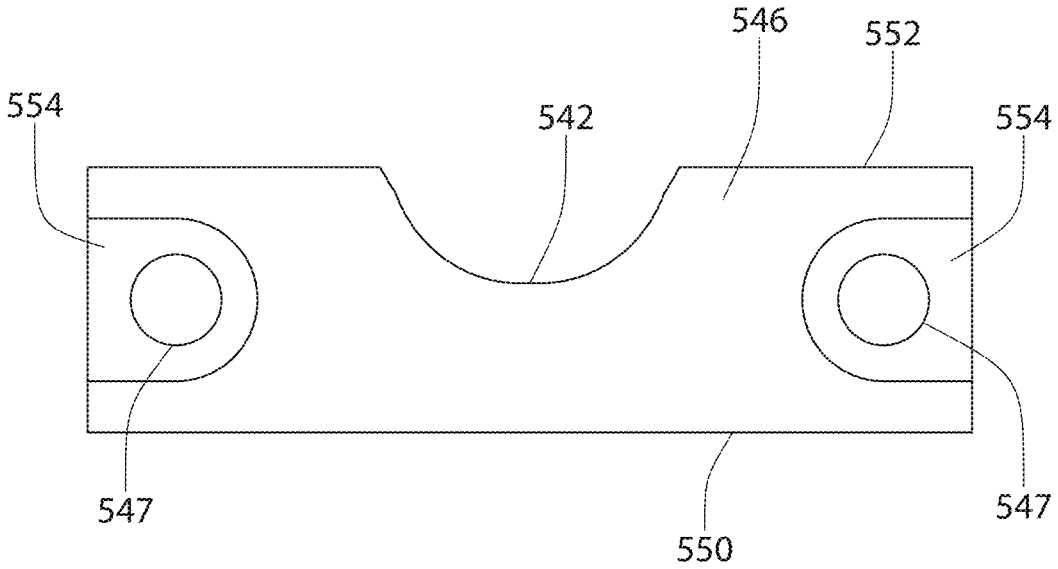
FIG. 60 is a bottom view of the insert.

Turning to FIG. 56, the feed insert 540 is coupled to the upper receiver 210 via a plurality of fasteners 541. The fasteners 541 may be screws and may engage corresponding threads formed in a recess 234 of the upper receiver 210. The recess 234 is formed into the lower surface 228 of the upper receiver 210. The recess 234 may optionally extend across a width of the upper receiver 210 to form a slot. The recess 234 has a floor surface 235, a front surface 236, and a rear surface 237. Preferably, fastener receiving holes 238 are formed in the floor surface 235, the fastener receiving holes 238 having threads to retain the fasteners 541. Optionally, the feed insert 540 may engage the barrel extension 130, or the feed insert 540 may be spaced from the barrel extension 130.

FIGS. 57-60 illustrate the feed insert 540 in greater detail. The feed insert 540 has a top surface 548 opposite the bottom surface 546. A front surface 550 is opposite a rear surface 552. The top surface 548 may incorporate a depression 549 which accommodates the barrel extension 130. The top surface 548 may also incorporate the secondary ramp 544. The secondary ramp 544 may be inclined at an angle which is greater than an angle of the feed ramp 131 as illustrated in FIGS. 55A and 55B. In other implementations, the secondary ramp 544 may be inclined at the same or a lesser angle than the angle of the feed ramp 131.

A plurality of fastener holes 547 extend from the bottom surface 546 to the top surface 548. The fastener holes 547 may incorporate a counterbore 554 to accommodate heads of the fasteners 541 in the bottom surface 546. In alternate implementations, the fasteners holes 547 may incorporate countersinks or other features which avoid interference between the fasteners 541 and the lower receiver 310. The clearance path 542 is formed into the rear surface 552. The top surface 548 preferably engages the floor surface 235 of the recess 234, while the front surface 550 engages the front surface 236 of the recess 234. The front and floor surfaces 236, 235 provide locating features which ensure that the feed insert 540 is positioned in a repeatable manner.

EXEMPLARY CLAIM SET

Exemplary Claim 1: A firearm comprising: a lower receiver housing a trigger assembly; an upper receiver comprising a longitudinal axis; a bolt carrier assembly located within the upper receiver, the bolt carrier assembly comprising: a bolt carrier configured to translate along the longitudinal axis, the bolt carrier comprising a cam feature; a bolt received by the bolt carrier and configured to rotate about the longitudinal axis; a follower element engaging the bolt and the cam feature of the bolt carrier; and an operating component engaging the bolt carrier, the operating component in surface contact with the upper receiver and the lower receiver.

Exemplary Claim 2: The firearm of exemplary claim 1 wherein the upper receiver comprises a passageway extending along the longitudinal axis and a slot extending from the passageway to an outer surface of the upper receiver.

Exemplary Claim 3: The firearm of exemplary claim 2 wherein the slot and the lower receiver define a closed contour.

Exemplary Claim 4: The firearm of exemplary claim 2 or exemplary claim 3 wherein the operating component is contained within the slot.

Exemplary Claim 5: The firearm of any one of exemplary claims 2 to 4 wherein the slot comprises a first guide surface.

Exemplary Claim 6: The firearm of exemplary claim 5 wherein the operating component engages the first guide surface.

Exemplary Claim 7: The firearm of any one of exemplary claims 2 to 6 wherein the slot comprises a stop surface, the operating component engaging the stop surface in a first position.

Exemplary Claim 8: The firearm of any one of exemplary claims 1 to 7 wherein the operating component is slidably coupled to the bolt carrier in a direction perpendicular to the longitudinal axis.

Exemplary Claim 9: The firearm of any one of exemplary claims 1 to 8 wherein the operating component is fixed to the bolt carrier with respect to the longitudinal axis.

Exemplary Claim 10: The firearm of any one of exemplary claims 1 to 9 wherein the operating component is fixed to the bolt carrier such that the operating component is prevented from rotating relative to the bolt carrier.

Exemplary Claim 11: The firearm of any one of exemplary claims 1 to 10 wherein the operating component is a bolt handle.

Exemplary Claim 12: The firearm of any one of exemplary claims 1 to 11 wherein the firearm is a bolt action firearm.

Exemplary Claim 13: The firearm of any one of exemplary claims 1 to 12 wherein the operating component comprises a base portion and a grasping portion.

Exemplary Claim 14: The firearm of exemplary claim 13 wherein the grasping portion is detachably coupled to the base portion.

Exemplary Claim 15: The firearm of any one of exemplary claims 1 to 14 wherein the upper receiver comprises a first guide surface and the lower receiver comprises a second guide surface, the operating component engaging the first and second guide surfaces.

Exemplary Claim 16: The firearm of any one of exemplary claims 1 to 15 wherein the upper receiver comprises a passageway extending along the longitudinal axis, the passageway comprising a main portion and a cam portion.

Exemplary Claim 17: The firearm of exemplary claim 16 wherein the cam portion comprises first and second surfaces, the follower element constrained by the first and second surfaces.

Exemplary Claim 18: The firearm of exemplary claim 16 or exemplary claim 17 wherein the bolt carrier assembly is configured to translate from a first position to a second position, the follower element constrained from rotation about the longitudinal axis by the cam portion of the passageway in the first position and free to rotate about the longitudinal axis in the second position.

Exemplary Claim 19: The firearm of exemplary claim 18 wherein the follower element is free to rotate about the longitudinal axis in the second position.

Exemplary Claim 20: The firearm of exemplary claim 18 or exemplary claim 19 wherein the bolt carrier of the bolt carrier assembly is constrained from rotation by the operating component in both the first position and the second position.

Exemplary Claim 21: The firearm of any one of exemplary claims 16 to 20 wherein the follower element is constrained from rotation by the cam portion of the passageway.

Exemplary Claim 22: The firearm of any one of exemplary claims 1 to 21 wherein no portion of the bolt carrier extends into a cam portion of the passageway, an entirety of the bolt carrier located within a main portion of the passageway.

Exemplary Claim 23: The firearm of any one of exemplary claims 1 to 22 wherein the bolt carrier is free to rotate when the operating component is detached from the bolt carrier.

Exemplary Claim 24: The firearm of any one of exemplary claims 1 to 23 wherein the bolt carrier comprises a cylindrical outer surface.

Exemplary Claim 25: The firearm of exemplary claim 24 wherein the cylindrical outer surface of the bolt carrier is concentric with the longitudinal axis.

Exemplary Claim 26: The firearm of exemplary claim 24 or exemplary claim 25 wherein no portion of the bolt carrier extends beyond the cylindrical outer surface.

Exemplary Claim 27: The firearm of any one of exemplary claims 24 to 26wherein the operating component extends beyond the cylindrical outer surface of the bolt carrier.

Exemplary Claim 28: The firearm of any one of exemplary claims 24 to 27wherein no portion of the bolt carrier assembly extends beyond the cylindrical outer surface except the operating component and the follower component.

Exemplary Claim 29: A firearm comprising: a lower receiver housing a trigger assembly; an upper receiver comprising a longitudinal axis and a passageway extending along the longitudinal axis, the passageway comprising a main portion and a cam portion; a bolt carrier assembly located within the passageway of the upper receiver, the bolt carrier assembly comprising: a bolt carrier configured to translate along the longitudinal axis, the bolt carrier comprising a cam feature; a bolt received by the bolt carrier and configured to rotate about the longitudinal axis; a follower element engaging the bolt and the cam feature of the bolt carrier; and an operating component engaging the bolt carrier; wherein the operating component engages a first guide surface, the first guide surface preventing rotation of the bolt carrier.

Exemplary Claim 30: The firearm of exemplary claim 29 wherein the upper receiver comprises a slot extending from the passageway to an outer surface of the upper receiver.

Exemplary Claim 31: The firearm of exemplary claim 30 wherein the slot and the lower receiver define a closed contour.

Exemplary Claim 32: The firearm of exemplary claim 30 or exemplary claim 31 wherein the operating component is contained within the slot.

Exemplary Claim 33: The firearm of any one of exemplary claims 30 to 32 wherein the slot comprises the first guide surface.

Exemplary Claim 34: The firearm of any one of exemplary claims 30 to 33 wherein the slot comprises a stop surface, the operating component engaging the stop surface in a first position.

Exemplary Claim 35: The firearm of any one of exemplary claims 29 to 34 wherein the lower receiver comprises a second guide surface, the operating component engaging the second guide surface.

Exemplary Claim 36: The firearm of any one of exemplary claims 29 to 35 wherein the operating component is slidably coupled to the bolt carrier in a direction perpendicular to the longitudinal axis.

Exemplary Claim 37: The firearm of any one of exemplary claims 29 to 36 wherein the operating component is fixed to the bolt carrier with respect to the longitudinal axis.

Exemplary Claim 38: The firearm of any one of exemplary claims 29 to 37 wherein the operating component is fixed to the bolt carrier such that the operating component is prevented from rotating relative to the bolt carrier.

Exemplary Claim 39: The firearm of any one of exemplary claims 29 to 38 wherein the operating component is a bolt handle.

Exemplary Claim 40: The firearm of any one of exemplary claims 29 to 39 wherein the firearm is a bolt action firearm.

Exemplary Claim 41: The firearm of any one of exemplary claims 29 to 40 wherein the operating component comprises a base portion and a grasping portion.

Exemplary Claim 42: The firearm of exemplary claim 41 wherein the grasping portion is detachably coupled to the base portion.

Exemplary Claim 43: The firearm of any one of exemplary claims 29 to 42 wherein the operating component is in surface contact with both the upper and lower receivers.

Exemplary Claim 44: The firearm of any one of exemplary claims 29 to 43 wherein the passageway comprises a main portion and a cam portion.

Exemplary Claim 45: The firearm of exemplary claim 44 wherein the cam portion comprises first and second surfaces, the follower element constrained by the first and second surfaces.

Exemplary Claim 46: The firearm of exemplary claim 44 or exemplary claim 45 wherein the bolt carrier assembly is configured to translate from a first position to a second position, the follower element constrained from rotation about the longitudinal axis by the cam portion of the passageway in the first position and free to rotate about the longitudinal axis in the second position.

Exemplary Claim 47: The firearm of exemplary claim 46 wherein the follower element is free to rotate about the longitudinal axis in the second position.

Exemplary Claim 48: The firearm of exemplary claim 46 or exemplary claim 48 wherein the bolt carrier of the bolt carrier assembly is constrained from rotation by the operating component in both the first position and the second position.

Exemplary Claim 49: The firearm of any one of exemplary claims 44 to 48 wherein the follower element is constrained from rotation by the cam portion of the passageway.

Exemplary Claim 50: The firearm of any one of exemplary claims 29 to 49 wherein no portion of the bolt carrier extends into the cam portion of the passageway, an entirety of the bolt carrier located within the main portion of the passageway.

Exemplary Claim 51: The firearm of any one of exemplary claims 29 to 50 wherein the bolt carrier is free to rotate when the operating component is detached from the bolt carrier.

Exemplary Claim 52: The firearm of any one of exemplary claims 29 to 51 wherein the bolt carrier comprises a cylindrical outer surface.

Exemplary Claim 53: The firearm of exemplary claim 52 wherein the cylindrical outer surface of the bolt carrier is concentric with the longitudinal axis.

Exemplary Claim 54: The firearm of exemplary claim 52 or exemplary claim 53 wherein no portion of the bolt carrier extends beyond the cylindrical outer surface.

Exemplary Claim 55: The firearm of any one of exemplary claims 52 to 54 wherein the operating component extends beyond the cylindrical outer surface of the bolt carrier.

Exemplary Claim 56: The firearm of any one of exemplary claims 52 to 55 wherein no portion of the bolt carrier assembly extends beyond the cylindrical outer surface except the operating component and the follower component.

Exemplary Claim 57: A firearm comprising: a lower receiver housing a trigger assembly; an upper receiver comprising a longitudinal axis and a passageway extending along the longitudinal axis, the passageway comprising a main portion and a cam portion, the cam portion having a first surface and a second surface; a bolt carrier assembly located within the passageway of the upper receiver, the bolt carrier assembly comprising: a bolt carrier configured to translate along the longitudinal axis, the bolt carrier comprising a cam feature; a bolt received by the bolt carrier and configured to rotate about the longitudinal axis; a follower element engaging the bolt and the cam feature of the bolt carrier; and an operating component engaging the bolt carrier; wherein when the bolt carrier is in a first position, the follower element constrained from rotation about the longitudinal axis by the first and second surfaces of the cam portion; and wherein the operating component engages a first guide surface.

Exemplary Claim 58: The firearm of exemplary claim 57 wherein the upper receiver comprises a slot extending from the passageway to an outer surface of the upper receiver.

Exemplary Claim 59: The firearm of exemplary claim 58 wherein the slot and the lower receiver define a closed contour.

Exemplary Claim 60: The firearm of exemplary claim 58 or exemplary claim 59 wherein the operating component is contained within the slot.

Exemplary Claim 61: The firearm of any one of exemplary claims 58 to 60 wherein the slot comprises the first guide surface.

Exemplary Claim 62: The firearm of any one of exemplary claims 58 to 61 wherein the slot comprises a stop surface, the operating component engaging the stop surface in a first position.

Exemplary Claim 63: The firearm of any one of exemplary claims 57 to 62 wherein the lower receiver comprises a second guide surface, the operating component engaging the second guide surface.

Exemplary Claim 64: The firearm of any one of exemplary claims 57 to 63 wherein the operating component is slidably coupled to the bolt carrier in a direction perpendicular to the longitudinal axis.

Exemplary Claim 65: The firearm of any one of exemplary claims 57 to 64 wherein the operating component is fixed to the bolt carrier with respect to the longitudinal axis.

Exemplary Claim 66: The firearm of any one of exemplary claims 57 to 65 wherein the operating component is fixed to the bolt carrier such that the operating component is prevented from rotating relative to the bolt carrier.

Exemplary Claim 67: The firearm of any one of exemplary claims 57 to 66 wherein the operating component is a bolt handle.

Exemplary Claim 68: The firearm of any one of exemplary claims 57 to 67 wherein the firearm is a bolt action firearm.

Exemplary Claim 69: The firearm of any one of exemplary claims 57 to 68 wherein the operating component comprises a base portion and a grasping portion.

Exemplary Claim 70: The firearm of exemplary claim 69 wherein the grasping portion is detachably coupled to the base portion.

Exemplary Claim 71: The firearm of any one of exemplary claims 57 to 70 wherein the operating component is in surface contact with both the upper and lower receivers.

Exemplary Claim 72: The firearm of any one of exemplary claims 57 to 71 wherein the bolt carrier assembly is configured to translate from the first position to a second position, the follower element constrained from rotation about the longitudinal axis by the cam portion of the passageway in the first position and free to rotate about the longitudinal axis in the second position.

Exemplary Claim 73: The firearm of exemplary claim 72 wherein the follower element is free to rotate about the longitudinal axis in the second position.

Exemplary Claim 74: The firearm of exemplary claim 72 or exemplary claim 73 wherein the bolt carrier of the bolt carrier assembly is constrained from rotation by the operating component in both the first position and the second position.

Exemplary Claim 75: The firearm of any one of exemplary claims 57 to 74 wherein no portion of the bolt carrier extends into the cam portion of the passageway, an entirety of the bolt carrier located within the main portion of the passageway.

Exemplary Claim 76: The firearm of any one of exemplary claims 57 to 75 wherein the bolt carrier is free to rotate when the operating component is detached from the bolt carrier.

Exemplary Claim 77: The firearm of any one of exemplary claims 57 to 76 wherein the bolt carrier comprises a cylindrical outer surface.

Exemplary Claim 78: The firearm of exemplary claim 77 wherein the cylindrical outer surface of the bolt carrier is concentric with the longitudinal axis.

Exemplary Claim 79: The firearm of exemplary claim 77 or exemplary claim 78 wherein no portion of the bolt carrier extends beyond the cylindrical outer surface.

Exemplary Claim 80: The firearm of any one of exemplary claims 77 to 79 wherein the operating component extends beyond the cylindrical outer surface of the bolt carrier.

Exemplary Claim 81: The firearm of any one of exemplary claims 77 to 80 wherein no portion of the bolt carrier assembly extends beyond the cylindrical outer surface except the operating component and the follower component.

Exemplary Claim 82: A bolt carrier assembly for a firearm, the bolt carrier assembly comprising: a bolt carrier configured to translate along a longitudinal axis, the bolt carrier comprising a cam feature; a bolt received by the bolt carrier and configured to rotate about the longitudinal axis; a follower element engaging the bolt and the cam feature of the bolt carrier; and an operating component engaging the bolt carrier; wherein the operating component is slidably coupled to the bolt carrier along a coupling direction perpendicular to the longitudinal axis.

Exemplary Claim 83: The bolt carrier assembly of exemplary claim 82 wherein the bolt carrier comprises a cylindrical outer surface.

Exemplary Claim 84: The bolt carrier assembly of exemplary claim 83 wherein the cylindrical outer surface of the bolt carrier is concentric with the longitudinal axis.

Exemplary Claim 85: The bolt carrier assembly of exemplary claim 83 or exemplary claim 84 wherein no portion of the bolt carrier extends beyond the cylindrical outer surface.

Exemplary Claim 86: The bolt carrier assembly of any one of exemplary claims 83 to 85 wherein the operating component extends beyond the cylindrical outer surface of the bolt carrier.

Exemplary Claim 87: The bolt carrier assembly of any one of exemplary claims 83 to 86 wherein no portion of the bolt carrier assembly extends beyond the cylindrical outer surface except the operating component and the follower component.

Exemplary Claim 88: The bolt carrier assembly of any one of exemplary claims 82 to 87 wherein the operating component is a bolt handle.

Exemplary Claim 89: The bolt carrier assembly of any one of exemplary claims 82 to 88 wherein the operating component is fixed to the bolt carrier with respect to the longitudinal axis.

Exemplary Claim 90: The bolt carrier assembly of any one of exemplary claims 82 to 89 wherein the operating component is fixed to the bolt carrier such that the operating component is prevented from rotating relative to the bolt carrier Exemplary Claim 91: The bolt carrier assembly of any one of exemplary claims 82 to 90 wherein the firearm is a bolt action firearm.

Exemplary Claim 92: The bolt carrier assembly of any one of exemplary claims 82 to 91 wherein the operating component comprises a base portion and a grasping portion.

Exemplary Claim 93: The bolt carrier assembly of exemplary claim 92 wherein the grasping portion is detachably coupled to the base portion.

Exemplary Claim 94: The bolt carrier assembly of any one of exemplary claims 82 to 93 wherein the bolt carrier comprises first and second cylindrical bores and the operating component comprises first and second cylindrical protuberances, the first cylindrical protuberance engaging the first cylindrical bore and the second cylindrical protuberance engaging the second cylindrical bore when the operating component is slidably coupled to the bolt carrier.

Exemplary Claim 95: A method of operating a firearm comprising: a) positioning a bolt carrier assembly of a firearm in a first position within a passageway extending along a longitudinal axis of an upper receiver so that a follower element engages first and second surfaces of a cam portion of the passageway and an operating component engages a first guide surface; b) translating the bolt carrier assembly along the longitudinal axis to a second position, the operating component engaging the first guide surface; c) rotating a bolt of the bolt carrier assembly by moving the bolt carrier assembly to a third position, the bolt engaging the follower element, the follower element moving along a cam feature of the bolt carrier and the operating component engaging the first guide surface.

Exemplary Claim 96: The method of exemplary claim 95 wherein, in steps a) and b), the operating component engages a second guide surface of a lower receiver.

Exemplary Claim 97: The method of exemplary claim 95 or exemplary claim 96 wherein the first guide surface is formed on the upper receiver.

Exemplary Claim 98: The method of any one of exemplary claims 95 to 97 wherein the upper receiver comprises a slot extending from the passageway to an outer surface of the upper receiver.

Exemplary Claim 99: The method of exemplary claim 98 wherein the slot and a lower receiver define a closed contour.

Exemplary Claim 100: The method of exemplary claim 98 or exemplary claim 99 wherein the operating component is contained within the slot.

Exemplary Claim 101: The method of any one of exemplary claims 98 to 100 wherein the slot comprises the first guide surface.

Exemplary Claim 102: The method of any one of exemplary claims 98 to 101 wherein the slot comprises a stop surface, the operating component engaging the stop surface in the first position.

Exemplary Claim 103: The method of any one of exemplary claims 95 to 102 wherein the operating component is fixed to the bolt carrier with respect to the longitudinal axis.

Exemplary Claim 104: The method of any one of exemplary claims 95 to 103 wherein the operating component is a bolt handle.

Exemplary Claim 105: The method of any one of exemplary claims 95 to 104 wherein the firearm is a bolt action firearm.

Exemplary Claim 106: The method of any one of exemplary claims 95 to 105 wherein the operating component comprises a base portion and a grasping portion.

Exemplary Claim 107: The method of exemplary claim 106 wherein the grasping portion is detachably coupled to the base portion.

Exemplary Claim 108: The method of any one of exemplary claims 95 to 107 wherein, in steps a), b), and c), the bolt carrier assembly is constrained from rotation by the first guide surface and a second guide surface of a lower receiver.

Exemplary Claim 109: The method of exemplary claim 108 wherein, in steps a) and b), the first and second surfaces of the cam portion constrain the follower element.

Exemplary Claim 110: The method of exemplary claim 109 wherein, in step c), the first and second surfaces of the cam portion do not constrain the follower element.

Exemplary Claim 111: The method of any one of exemplary claims 95 to 110 wherein no portion of the bolt carrier extends into a cam portion of the passageway, an entirety of the bolt carrier located within a main portion of the passageway.

Exemplary Claim 112: The method of any one of exemplary claims 95 to 111 wherein the bolt carrier is free to rotate when the operating component is detached from the bolt carrier.

Exemplary Claim 113: The method of any one of exemplary claims 95 to 112 wherein the bolt carrier comprises a cylindrical outer surface.

Exemplary Claim 114: The method of exemplary claim 113 wherein the cylindrical outer surface of the bolt carrier is concentric with the longitudinal axis.

Exemplary Claim 115: The method of exemplary claim 113 or exemplary claim 114 wherein no portion of the bolt carrier extends beyond the cylindrical outer surface.

Exemplary Claim 116: The method of any one of exemplary claims 113 to 115 wherein the operating component extends beyond the cylindrical outer surface of the bolt carrier.

Exemplary Claim 117: The method of any one of exemplary claims 113 to 116 wherein no portion of the bolt carrier assembly extends beyond the cylindrical outer surface except the operating component and the follower component.

Exemplary Claim 118: A method of assembling a firearm comprising: a) providing an upper receiver comprising a passageway extending along a longitudinal axis; b) inserting a bolt carrier assembly within the passageway through a rear aperture of the upper receiver; c) engaging an operating component with a bolt carrier of the bolt carrier assembly; and d) coupling the upper receiver to a lower receiver.

Exemplary Claim 119: The method of exemplary claim 118 wherein the upper receiver comprises a slot, the operating component located within the slot in step c).

Exemplary Claim 120: The method of exemplary claim 119 wherein the slot and the lower receiver define a closed contour.

Exemplary Claim 121: The method of any one of exemplary claims 118 to 120 wherein, in step c), the operating component engages a first guide surface of the upper receiver.

Exemplary Claim 122: The method of any one of exemplary claims 118 to 121 wherein, in step d), the operating component engages a second guide surface of the lower receiver.

Exemplary Claim 123: The method of any one of exemplary claims 118 to 122 wherein, in step b), the bolt carrier comprises a follower element, the follower element engaging first and second surfaces of the passageway of the upper receiver.

Exemplary Claim 124: The method of any one of exemplary claims 118 to 123 further comprising step e), wherein the bolt carrier is translated from a first position to a second position along the longitudinal axis, the operating component in contact with a first guide surface.

Exemplary Claim 125: The method of exemplary claim 124 further comprising step f), wherein the bolt carrier is translated from a second position to a third position, a bolt of the bolt carrier assembly rotating about the longitudinal axis, the bolt carrier remaining stationary with respect to the longitudinal axis.

Exemplary Claim 126: The method of any one of exemplary claims 118 to 125 wherein, in step d), the upper and lower receiver prevent removal of the operating component from the bolt carrier of the bolt carrier assembly.

Exemplary Claim 127: The method of any one of exemplary claims 118 to 126 wherein, in step c), the operating component is slidably coupled to the bolt carrier in a direction perpendicular to the longitudinal axis.

Exemplary Claim 128: The method of any one of exemplary claims 118 to 127 wherein, in step c), the operating component is fixed to the bolt carrier with respect to the longitudinal axis.

Exemplary Claim 129: The method of any one of exemplary claims 118 to 128 wherein, in step c), the operating component is fixed to the bolt carrier such that the operating component is prevented from rotating relative to the bolt carrier.

Exemplary Claim 130: The method of any one of exemplary claims 118 to 129 wherein the operating component is a bolt handle.

Exemplary Claim 131: The method of any one of exemplary claims 118 to 130 wherein the firearm is a bolt action firearm.

Exemplary Claim 132: The method of any one of exemplary claims 118 to 131 wherein the operating component comprises a base portion and a grasping portion.

Exemplary Claim 133: The method of exemplary claim 132 wherein the grasping portion is detachably coupled to the base portion.

Exemplary Claim 134: A firearm comprising: a lower receiver housing a trigger assembly; an upper receiver comprising a longitudinal axis, a passageway extending along the longitudinal axis, and a slot extending from the passageway to an outer surface of the upper receiver; and a bolt carrier assembly located within the passageway of the upper receiver, the bolt carrier assembly comprising a bolt carrier and an operating component, the operating component detachably coupled to the bolt carrier.

Exemplary Claim 135: The firearm of exemplary claim 134 wherein the slot of the upper receiver and the lower receiver collectively define a closed contour.

Exemplary Claim 136: The firearm of exemplary claim 134 or exemplary claim 135 wherein the operating component is slidably coupled to the bolt carrier in a direction perpendicular to the longitudinal axis.

Exemplary Claim 137: The firearm of any one of exemplary claims 134 to 136 wherein the operating component is contained within the slot.

Exemplary Claim 138: The firearm of any one of exemplary claims 134 to 137 wherein the slot comprises a first guide surface.

Exemplary Claim 139: The firearm of exemplary claim 138 wherein the operating component engages the first guide surface.

Exemplary Claim 140: The firearm of any one of exemplary claims 134 to 139 wherein the slot comprises a stop surface, the operating component engaging the stop surface in a first position.

Exemplary Claim 141: The firearm of any one of exemplary claims 134 to 140 wherein the operating component is slidably coupled to the bolt carrier in a direction perpendicular to the longitudinal axis.

Exemplary Claim 142: The firearm of any one of exemplary claims 134 to 141 wherein the operating component is fixed to the bolt carrier with respect to the longitudinal axis.

Exemplary Claim 143: The firearm of any one of exemplary claims 134 to 142 wherein the operating component is fixed to the bolt carrier such that the operating component is prevented from rotating relative to the bolt carrier.

Exemplary Claim 144: The firearm of any one of exemplary claims 134 to 143 wherein the operating component is a bolt handle.

Exemplary Claim 145: The firearm of any one of exemplary claims 134 to 143 wherein the firearm is a bolt action firearm.

Exemplary Claim 146: The firearm of any one of exemplary claims 134 to 145 wherein the operating component comprises a base portion and a grasping portion.

Exemplary Claim 147: The firearm of exemplary claim 146 wherein the grasping portion is detachably coupled to the base portion.

Exemplary Claim 148: The firearm of any one of exemplary claims 134 to 147 wherein the upper receiver comprises a first guide surface and the lower receiver comprises a second guide surface, the operating component engaging the first and second guide surfaces.

Exemplary Claim 149: The firearm of any one of exemplary claims 134 to 148 wherein the passageway comprises a main portion and a cam portion.

Exemplary Claim 150: The firearm of exemplary claim 149 wherein the cam portion comprises first and second surfaces, a follower element of the bolt carrier assembly constrained by the first and second surfaces.

Exemplary Claim 151: The firearm of exemplary claim 149 or exemplary claim 150 wherein the bolt carrier assembly is configured to translate from a first position to a second position, a follower element of the bolt carrier assembly constrained from rotation about the longitudinal axis by the cam portion of the passageway in the first position and free to rotate about the longitudinal axis in the second position.

Exemplary Claim 152: The firearm of exemplary claim 151 wherein the follower element is free to rotate about the longitudinal axis in the second position.

Exemplary Claim 153: The firearm of exemplary claim 151 or exemplary claim 152 wherein the bolt carrier of the bolt carrier assembly is constrained from rotation by the operating component in both the first position and the second position.

Exemplary Claim 154: The firearm of any one of exemplary claims 150 to 153 wherein the follower element is constrained from rotation by the cam portion of the passageway.

Exemplary Claim 155: The firearm of any one of exemplary claims 149 to 154 wherein no portion of the bolt carrier extends into a cam portion of the passageway, an entirety of the bolt carrier located within a main portion of the passageway.

Exemplary Claim 156: The firearm of any one of exemplary claims 134 to 155 wherein the bolt carrier is free to rotate when the operating component is detached from the bolt carrier.

Exemplary Claim 157: The firearm of any one of exemplary claims 134 to 156 wherein the bolt carrier comprises a cylindrical outer surface.

Exemplary Claim 158: The firearm of exemplary claim 157 wherein the cylindrical outer surface of the bolt carrier is concentric with the longitudinal axis.

Exemplary Claim 159: The firearm of exemplary claim 157 or exemplary claim 158 wherein no portion of the bolt carrier extends beyond the cylindrical outer surface.

Exemplary Claim 160: The firearm of any one of exemplary claims 157 to 159 wherein the operating component extends beyond the cylindrical outer surface of the bolt carrier.

Exemplary Claim 161: The firearm of any one of exemplary claims 157 to 160 wherein no portion of the bolt carrier assembly extends beyond the cylindrical outer surface except the operating component and the follower component.

Exemplary Claim 162: The firearm of any one of exemplary claims 134 to 161 wherein the upper receiver comprises a lower opening extending from the passageway to a lower surface.

Exemplary Claim 163: The firearm of exemplary claim 162 wherein the lower opening and the slot collectively form a closed contour.

Exemplary Claim 164: The firearm of exemplary claim 162 or exemplary claim 163 wherein the upper receiver comprises a rear aperture, the passageway extending from the rear aperture.

Exemplary Claim 165: The firearm of exemplary claim 164 wherein the rear aperture forms a closed contour.

Exemplary Claim 166: The firearm of any one of exemplary claims 134 to 165 wherein the upper receiver comprises a rear hoop completely encircling the passageway, the slot terminating at the rear hoop.

Exemplary Claim 167: The firearm of exemplary claim 166 wherein the rear hoop forms a stop surface for the operating component.

Exemplary Claim 168: The firearm of exemplary claim 167 wherein the stop surface limits travel of the bolt carrier assembly within the passageway.

Exemplary Claim 169: A firearm comprising: a lower receiver housing a trigger assembly; an upper receiver comprising a longitudinal axis, a passageway extending along the longitudinal axis; a bolt carrier assembly located within the passageway of the upper receiver, the bolt carrier assembly comprising a bolt carrier and an operating component; a detent configured to engage the bolt carrier assembly to maintain the firearm in battery.

Exemplary Claim 170: The firearm of exemplary claim 169 wherein the detent is located within a pocket in the lower receiver.

Exemplary Claim 171: The firearm of exemplary claim 169 or exemplary claim 170 wherein the detent engages the operating component.

Exemplary Claim 172: The firearm of exemplary claim 171 wherein the operating component comprises a ramp feature at a leading edge.

Exemplary Claim 173: The firearm of exemplary claim 172 wherein the ramp feature transitions the detent from a fully extended position to a compressed position.

Exemplary Claim 174: The firearm of any one of exemplary claims 171 to 173 wherein the operating component comprises a first surface engaging the bolt carrier, a second surface opposite the first surface, and a recess formed in the second surface.

Exemplary Claim 175: The firearm of exemplary claim 174 wherein the detent engages the recess when the firearm is in battery.

Exemplary Claim 176: The firearm of any one of exemplary claims 169 to 175 wherein the detent is in a fully extended position when the bolt carrier assembly is in a first position along the longitudinal axis and the firearm is out of battery.

Exemplary Claim 177: The firearm of exemplary claim 176 wherein the detent is in a compressed position when the bolt carrier assembly is in a second position, the detent engaging a ramp feature of the operating component.

Exemplary Claim 178: The firearm of exemplary claim 176 or exemplary claim 177 wherein the detent is in a compressed position and rests within a recess of the operating component when the bolt carrier assembly is in a third position, the firearm in battery when the bolt carrier assembly is in the third position.

Exemplary Claim 179: The firearm of any one of exemplary claims 169 to 176 wherein a guide surface engages the operating component, the detent located within the guide surface.

Exemplary Claim 180: A firearm comprising: a lower receiver housing a trigger assembly; a magazine located within a magazine well formed in the lower receiver, the magazine comprising a magazine body, a follower, a spring configured to provide a biasing force to the follower, and a plurality of cartridges, the plurality of cartridges biased against feed lips of the magazine body by the follower; an upper receiver comprising a longitudinal axis, a passageway extending along the longitudinal axis; a bolt carrier assembly located within the passageway of the upper receiver, the bolt carrier assembly comprising a bolt; a barrel assembly coupled to the upper receiver, the barrel assembly comprising a barrel aligned with the longitudinal axis and a barrel extension configured to receive the bolt of the bolt carrier assembly, the barrel extension comprising a feed ramp; and a feed insert coupled to the upper receiver, the feed insert comprising: a clearance path configured to allow passage of the plurality of cartridges; and a secondary ramp configured to engage a first one of the plurality of cartridges and direct the first one of the plurality of cartridges to the feed ramp of the barrel extension.

Exemplary Claim 181: The firearm of exemplary claim 180 wherein the clearance path is configured to allow passage of a bullet of each of the plurality cartridges.

Exemplary Claim 182: The firearm of exemplary claim 180 or exemplary claim 181 wherein the clearance path is configured to allow passage of each of the plurality of cartridges as they are advanced to engage the feed lips of the magazine body.

Exemplary Claim 183: The firearm of any one of exemplary claims 180 to 182 wherein subsequent to feeding of a last one of the plurality of cartridges, the follower engages the feed insert.

Exemplary Claim 184: The firearm of any one of exemplary claims 180 to 183 wherein the feed insert comprises a top surface, the top surface engaging the barrel extension.

Exemplary Claim 185: A firearm comprising: a lower receiver housing a trigger assembly; an upper receiver comprising a longitudinal axis, a passageway extending along the longitudinal axis; an ejector coupled to the upper receiver, the ejector comprising an ejection portion extending into the passageway; and a bolt carrier assembly located within the passageway of the upper receiver, the bolt carrier assembly comprising a bolt carrier and a bolt, the bolt and the bolt carrier each comprising a slot, the ejection portion configured to pass within the slots of each of the bolt carrier and the bolt when the bolt carrier assembly is transitioned from a first position to a second position along the longitudinal axis.

Exemplary Claim 186: The firearm of exemplary claim 185 wherein the ejector comprises a base portion and a plurality of protuberances, the protuberances engaging holes formed in the upper receiver.

Exemplary Claim 187: The firearm of exemplary claim 186 wherein the protuberances and the ejector are a single integrally formed, monolithic, component.

Exemplary Claim 188: The firearm of any one of exemplary claims 185 to 187 wherein the ejector is coupled to a lateral surface of the upper receiver, the lateral surface extending from the passageway to a lower surface of the upper receiver.

Exemplary Claim 189: The firearm of exemplary claim 188 wherein a base portion of the ejector is coupled to the lateral surface and a plurality of fasteners extend through holes in the upper receiver to engage the base portion of the ejector.

Exemplary Claim 190: The firearm of any one of exemplary claims 185 to 189 wherein the ejection portion extends beyond the bolt when the bolt carrier assembly is in the first position.

While the foregoing description and drawings represent some examples, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm comprising:

a lower receiver housing a trigger assembly;

an upper receiver comprising a longitudinal axis;

a bolt carrier assembly located within the upper receiver, the bolt carrier assembly comprising:

a bolt carrier configured to translate along the longitudinal axis, the bolt carrier comprising a cam feature;

a bolt received by the bolt carrier and configured to rotate about the longitudinal axis;

a follower element engaging the bolt and the cam feature of the bolt carrier; and an operating component engaging the bolt carrier, the operating component in surface contact with the upper receiver and the lower receiver.

2. The firearm of claim 1 wherein the upper receiver comprises a passageway extending along the longitudinal axis and a slot extending from the passageway to an outer surface of the upper receiver; and wherein the slot and the lower receiver define a closed contour.

3. The firearm of claim 2 wherein the operating component is contained within the slot.

4. The firearm of claim 2 wherein the slot comprises a first guide surface; and wherein the operating component engages the first guide surface.

5. The firearm of claim 2 wherein the slot comprises a stop surface, the operating component engaging the stop surface in a first position.

6. The firearm of claim 1 wherein the operating component is slidably coupled to the bolt carrier in a direction perpendicular to the longitudinal axis.

7. The firearm of claim 1 wherein the operating component is a bolt handle.

8. The firearm of claim 1 wherein the upper receiver comprises a first guide surface and the lower receiver comprises a second guide surface, the operating component engaging the first and second guide surfaces.

9. The firearm of claim 1 wherein the upper receiver comprises a passageway extending along the longitudinal axis, the passageway comprising a main portion and a cam portion; and wherein the cam portion comprises first and second surfaces, the follower element constrained by the first and second surfaces.

10. The firearm of claim 9 wherein the bolt carrier assembly is configured to translate from a first position to a second position, the follower element constrained from rotation about the longitudinal axis by the cam portion of the passageway in the first position and free to rotate about the longitudinal axis in the second position; wherein the follower element is free to rotate about the longitudinal axis in the second position; and wherein the bolt carrier of the bolt carrier assembly is constrained from rotation by the operating component in both the first position and the second position.

11. The firearm of claim 1 wherein no portion of the bolt carrier extends into a cam portion of the passageway, an entirety of the bolt carrier located within a main portion of the passageway.

12. The firearm of claim 1 wherein the bolt carrier comprises a cylindrical outer surface, no portion of the bolt carrier extends beyond the cylindrical outer surface.

13. A firearm comprising:

a lower receiver housing a trigger assembly;

an upper receiver comprising a longitudinal axis and a passageway extending along the longitudinal axis, the passageway comprising a main portion and a cam portion;

a bolt carrier assembly located within the passageway of the upper receiver, the bolt carrier assembly comprising:

a bolt carrier configured to translate along the longitudinal axis, the bolt carrier comprising a cam feature;

a bolt received by the bolt carrier and configured to rotate about the longitudinal axis;

a follower element engaging the bolt and the cam feature of the bolt carrier; and an operating component engaging the bolt carrier;

wherein the operating component engages a first guide surface, the first guide surface preventing rotation of the bolt carrier.

14. The firearm of claim 13 wherein the upper receiver comprises a slot extending from the passageway to an outer surface of the upper receiver, the operating component contained within the slot.

15. The firearm of claim 14 wherein the slot comprises a stop surface, the operating component engaging the stop surface in a first position.

16. The firearm of claim 13 wherein the lower receiver comprises a second guide surface, the operating component engaging the second guide surface.

17. A firearm comprising:

a lower receiver housing a trigger assembly;

an upper receiver comprising a longitudinal axis and a passageway extending along the longitudinal axis, the passageway comprising a main portion and a cam portion, the cam portion having a first surface and a second surface;

a bolt carrier assembly located within the passageway of the upper receiver, the bolt carrier assembly comprising:

a bolt carrier configured to translate along the longitudinal axis, the bolt carrier comprising a cam feature;

a bolt received by the bolt carrier and configured to rotate about the longitudinal axis;

a follower element engaging the bolt and the cam feature of the bolt carrier; and an operating component engaging the bolt carrier;

wherein when the bolt carrier is in a first position, the follower element constrained from rotation about the longitudinal axis by the first and second surfaces of the cam portion; and wherein the operating component engages a first guide surface.

18. The firearm of claim 17 wherein the lower receiver comprises a second guide surface, the operating component engaging the second guide surface.

19. The firearm of claim 17 wherein the bolt carrier assembly is configured to translate from the first position to a second position, the follower element constrained from rotation about the longitudinal axis by the cam portion of the passageway in the first position and free to rotate about the longitudinal axis in the second position.

20. The firearm of claim 17 wherein the bolt carrier comprises a cylindrical outer surface, no portion of the bolt carrier assembly extending beyond the cylindrical outer surface except the operating component and the follower component.

* * * * *